US008531337B2

(12) United States Patent
Soler Castany et al.

(10) Patent No.: US 8,531,337 B2
(45) Date of Patent: Sep. 10, 2013

(54) ANTENNA DIVERSITY SYSTEM AND SLOT ANTENNA COMPONENT

(75) Inventors: Jordi Soler Castany, Mataró (ES); José Mumbru Forn, Barcelona (ES); Carles Puente Baliarda, Barcelona (ES)

(73) Assignee: Fractus, S.A., Barcelona (ES)

( * ) Notice: Subject to any disclaimer, the term of this patent is extended or adjusted under 35 U.S.C. 154(b) by 1008 days.

(21) Appl. No.: 11/914,178

(22) PCT Filed: May 12, 2006

(86) PCT No.: PCT/EP2006/062285

§ 371 (c)(1),
(2), (4) Date: Nov. 12, 2007

(87) PCT Pub. No.: WO2006/120250

PCT Pub. Date: Nov. 16, 2006

(65) Prior Publication Data

US 2008/0198082 A1 Aug. 21, 2008

Related U.S. Application Data

(60) Provisional application No. 60/680,693, filed on May 13, 2005, provisional application No. 60/778,323, filed on Mar. 2, 2006.

(30) Foreign Application Priority Data

May 13, 2005 (EP) ..... 05104026
Feb. 27, 2006 (EP) ..... 06110437

(51) Int. Cl.
*H01Q 1/24* (2006.01)
*H01Q 13/10* (2006.01)

(52) U.S. Cl.
USPC ..... 343/702; 343/767

(58) Field of Classification Search
USPC ..... 343/700 MS, 767, 770, 893, 702, 343/846
See application file for complete search history.

(56) References Cited

U.S. PATENT DOCUMENTS 3,680,135 A 7/1972 Boyer
3,750,017 A * 7/1973 Bowman et al. ..... 324/72

(Continued)

FOREIGN PATENT DOCUMENTS

EP 0108816 A 5/1984
EP 0969375 1/2000

(Continued)

OTHER PUBLICATIONS

Plicanic, V., Antenna diversity studies and evaluation, University of Carolina and Ericsson Mobile Communications, MAster of Science Thesis, May 2004.

(Continued)

*Primary Examiner* — Michael C Wimer
*Assistant Examiner* — Hasan Islam
(74) *Attorney, Agent, or Firm* — Kenyon & Kenyon LLP

(57) ABSTRACT

The present invention refers to an antenna diversity system comprising at least a first antenna and a second antenna wherein the first antenna substantially behaves as an electric current source or as a magnetic current source, and the second antenna substantially behaves as an electric current source or as a magnetic current source and a corresponding wireless device. Further the invention relates to an SMT-type slot-antenna component comprising at least one conductive surface or sheet of metal in which the pattern of a slot is created, at least one contact terminal accessible from the exterior of said component to electrically connect the conductive surface included in the slot-antenna component with the ground plane of a circuit board such as a printed circuit board and a corresponding wireless device.

110 Claims, 26 Drawing Sheets

(56) References Cited

U.S. PATENT DOCUMENTS

Figure 1A:
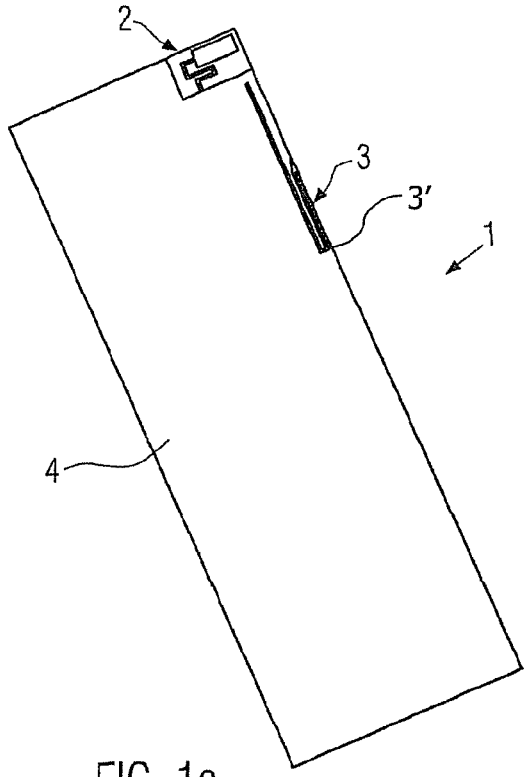

| | | | | |
|---|---|---|---|---|
| 4,633,519 | A | 12/1986 | Gotoh et al. | |
| 4,843,468 | A | 6/1989 | Drewery | |
| 5,363,114 | A | 11/1994 | Shoemaker | |
| 5,420,599 | A | 5/1995 | Erkocevic | |
| 5,572,226 | A * | 11/1996 | Tuttle | 343/726 |
| 5,608,413 | A * | 3/1997 | Macdonald | 343/700 MS |
| 5,719,586 | A * | 2/1998 | Tuttle | 343/726 |
| 5,778,308 | A | 7/1998 | Sroka et al. | |
| 5,784,032 | A | 7/1998 | Johnston et al. | |
| 5,867,126 | A | 2/1999 | Kawahata | |
| 5,990,838 | A | 11/1999 | Burns | |
| 6,005,524 | A | 12/1999 | Hayes | |
| 6,011,518 | A | 1/2000 | Yamagishi et al. | |
| 6,040,803 | A | 3/2000 | Spall | |
| 6,052,093 | A * | 4/2000 | Yao et al. | 343/770 |
| 6,087,990 | A | 7/2000 | Thill et al. | |
| 6,326,924 | B1 * | 12/2001 | Muramoto et al. | 343/702 |
| 6,448,933 | B1 | 9/2002 | Hill | |
| 6,535,172 | B2 | 3/2003 | Hirabayashi | |
| 6,570,538 | B2 | 5/2003 | Väisänen et al. | |
| 6,657,593 | B2 | 12/2003 | Nagumo | |
| 6,781,545 | B2 | 8/2004 | Sung | |
| 6,806,835 | B2 | 10/2004 | Iwai | |
| 6,836,254 | B2 * | 12/2004 | Kalis et al. | 343/770 |
| 6,882,320 | B2 | 4/2005 | Park | |
| 7,209,011 | B2 * | 4/2007 | Welland et al. | 331/36 L |
| 7,233,291 | B2 * | 6/2007 | Elkobi et al. | 343/702 |
| 7,511,675 | B2 | 3/2009 | Puente-Baliarda et al. | |
| 7,796,956 | B2 * | 9/2010 | Khayrallah et al. | 455/75 |
| 2001/0050637 | A1 | 12/2001 | Aoyama | |
| 2002/0033773 | A1 | 3/2002 | Hirabayashi | |
| 2003/0193437 | A1 * | 10/2003 | Kangasvieri et al. | 343/702 |
| 2004/0137971 | A1 | 7/2004 | Shoji | |
| 2005/0179607 | A1 | 8/2005 | Gorsuch | |
| 2006/0076658 | A1 * | 4/2006 | Wu | 257/678 |
| 2007/0152885 | A1 | 7/2007 | Sorvala | |
| 2007/0171131 | A1 | 7/2007 | Sorvala et al. | |
| 2007/0194992 | A1 | 8/2007 | Puente Baliarda et al. | |
| 2008/0088511 | A1 | 4/2008 | Sorvala et al. | |

FOREIGN PATENT DOCUMENTS

| | | | |
|---|---|---|---|
| EP | 1137100 | A2 | 9/2001 |
| EP | 1248317 | A1 | 10/2002 |
| EP | 1280230 | A1 | 1/2003 |
| EP | 009090089.5 | B1 | 8/2005 |
| ES | 2112163 | | 3/1998 |
| FR | 2849288 | | 6/2004 |
| JP | 9083240 | A | 3/1997 |
| JP | 11220319 | | 8/1999 |
| JP | 2001332924 | | 11/2001 |
| JP | 2006174449 | | 6/2006 |
| WO | 9706578 | | 2/1997 |
| WO | 9927608 | | 6/1999 |
| WO | 0154225 | A1 | 7/2001 |
| WO | 02089246 | A2 | 11/2002 |
| WO | 03073552 | A | 9/2003 |
| WO | 03096475 | A1 | 11/2003 |
| WO | 2004042868 | A1 | 5/2004 |
| WO | 2004070874 | A1 | 8/2004 |
| WO | 2004105182 | A1 | 12/2004 |
| WO | 2005081358 | A1 | 9/2005 |
| WO | 2006097496 | | 9/2006 |

OTHER PUBLICATIONS

Rowell, C.R et al., Design of diversity antennas for mobile telephones, International Symposium on Radio Propagation, Agosto, 1997.

Cetiner, B.A., Diversity characterization of a wideband multi-element antennas for indoor wireless communication, ICCES 03 international Conference on Computational and Experimental Engineering and Sciences, 2003, Corfu, Greece.

Cetiner, B.A., Small size broadband multielement antenna for RF/Wireless systems, Antennas and Wireless Propagation Letters, 2003.

Ramirez, R., Small size single and multiband antenna arrays with diversity capabilities for portable devices, IEEE Radio and Wireless Conference, 2001. RAWCON 2001.

Karaboikis, M., Compact dual-printed inverted-F antenna diversity systems for portable wireless devices, IEEE Antennas and Propagation Letters, 2004, vol. 3.

Antenna designs for MIMO systems, Antennova, 2004.

Green, B., Diversity performance of dual-antenna handsets near operator tissue, IEEE Transactions on Antennas and Propagation, Jul. 2000, vol. 48, No. 7.

Braun, C. Antenna diversity for mobile telephones, IEEE Antennas and Propagation, Jun. 1998.

Kim, H.J., Dual-frequency small-chip meander antenna, Microwave and Optical Technology Letters, Nov. 2002, vol. 35, No. 4.

Moon, S. Folded meander line and multilayered dielectric chip antenna for surface mount, Proceedings of APMC2001, Taipei, Taiwan.

Choi, W., Ceramic chip antenna using meander conductor lines, Electronic Letters, Jul. 2001, vol. 37, No. 15.

Behdad, N., Bandwith enhancement and further size reduction of a class of miniaturized slot antennas, IEEE Transactions on Antennas and Propagation, Aug. 2004, vol. 52, No. 8.

Waldschmidt, C., Compact wide-band multimode antennas for MIMO and Diversity, IEEE Transactions on Antennas and Propagation, Aug. 2004, vol. 52, No. 8.

Pham, N. Minimized dual-band coupled line meander antenna for system-in-a-package applications, IEEE Antennas and Propagations Society International Symposium, Jun. 2004.

Soler, J., FracWave Antenna Technology for full wireless system in package (FWSiP), Sep. 2005.

Bhavsar, Samir A.: Letter: *Fractus* v. *Samsung et al*., Case No. 6:09-cv-00203-LED: Disclosure of Material Information to the USPTO; Oct. 28, 2009.

Wille, David G.: HTC's First Amended Answer and Counterclaim; Oct. 2, 2009.

Wimer, Michael C.; USPTO Office Actions for U.S. Appl. No. 10/422,578; Oct. 4, 2004, Apr. 7, 2005, Aug. 24, 2005, Jan. 26, 2006, Mar. 12, 2007, Aug. 23, 2007 and Mar. 26, 2008.

D.A. Russell, J.D. Hanson, E. Ott, "Dimension and Strange Attractors", Phys. Rev. Lett. 45 (1980) 1175-1178.

Paul So., Ernest Barreto, and Brian R. Hunt, "Box-counting dimension without boxes: Computing D0 from average expansion rates", Physical Review E (Statistical Physics, Plasmas, Fluids, and Related Interdisciplinary Topics)—Jul. 1999—vol. 60, Issue 1, pp. 378-385.

http://www.redbrick.dcu.ie/~bolsh/thesis/node16.html.

http://www.redbrick.dcu.ie/~bolsh/thesis/node22.html.

http://www.sewanee.edu/physics/PHYSICS123/BOX%20COUNTING%20DIMENSION.html.

Heinz-Otto Peitgen, et al, "Chaos and Fractals—New Frontiers of Science" (1992), pp. 212-216, 387-388.

Paul S. Addison, "Fractals and Chaos—An illustrated Course" (Institute of Physics Publishing, Bristol and Philadelphia; IOP Publishing 1997), pp. 30, 31 &33.

Kenneth Falconer, "Fractal Geometry—Mathematical Foundations and Applications" (2nd edition) (John Wiley & Sons. Ltd., 2003) (the first edition is from 1990).

Yuan Y. Tang. et al., "The application of Fractal Analysis to Feature Extraction" (1999 IEEE). pp. 875-879.

Vincent Ng. et al., "Diagnosis of Melanoma with Fractal Dimensions" (IEEE TENCON'93 / Beijing), pp. 514-517.

S. Kobayashi et al., "Estimation of 3d Fractal Dimension of Real Electrical Tree Patterns" (IEEE 1994; Proceedings of the 4th International Conference on Properties and Applications of Dielectric Materials, Jul. 3-8, 1994 Brisbane, Australia), pp. 359-362.

Jie Feng et al., "Fractional Box-Counting Approach to Fractal Dimension Estimation", (IEEE 1996; Proceedings of ICPR'96), pp. 854-858.

S. Rouvier, et al., "Fractal Analysis of Bidimensional Profiles and Application to Electromagnetic Scattering from Soils" (1996 IEEE), pp. 2167-2169.

Nirupam Sarkar, et al., "An Efficient Differential Box-Counting Approach to Compute Fractal Dimension of Image" (IEEE Transactions on Systems, Man, and Cybernetics, vol. 24, No. 1, Jan. 1994), pp. 115-120.
Susan S. Chen, et al., "On the Calculation of Fractal Features from Images" (IEEE Transactions on Pattern Analysis and Machine Intelligence, vol. 15, No. 10, Oct. 1993), pp. 1087-1090.
Alan I. Penn, et al., "Fractal Dimension of Low-Resolution Medical Images" (18th Annual International Conference of the IEEE Engineering in Medicine and Biology Society, Amsterdam 1996; 4.5.3: Image Pattern Analysis I), pp. 1163-1165.
Fabrizio Berizzi, et al., "Fractal Analysis of the Signal Scattered from the Sea Surface" (IEEE Transactions on Antennas and Propagation, vol. 47, No. 2, Feb. 1999), pp. 324-338.
Hendrik F. V Boshoff, "A Fast Box Counting Algorithm for Determining the Fractal Dimension of Sampled Continuous Functions" (1992 IEEE), pp. 43-48.
Aug. 14, 2003 Reply to Examination Report for EP1258054 (00909089.5).
Oct. 28, 2004 Summons for EP1258054 (00909089.5).
Dec. 15, 2004 Letter Dealing with Oral Proceedings for EP1258054 (00909089.5).
Jan. 2005 Minutes from Oral Proceedings for EP1258054 (00909089.5).
International Preliminary Examination Report and International Search Report of Aug. 29, 2002 for PCT/EP00/00411 published as WO 01/54225 A1.
EPO Office Action for EP1258054 (00909089.5) dated Feb. 7, 2003.
Hansen, R. C.: "Fundamental Limitations in Antennas"; Proceedings of the IEEE, IEEE. New York, US; Feb. 1981; ISSN 0018-9219, vol. 2, NR. 69, pp. 170-182.
Ramesh Garg et al., "Microstrip Antenna Design Handbook" (2001, Artech House, Inc.), selected pages.
Richard C. Johnson (Editor), "Antenna Engineering Handbook" (McGraw Hill Inc.), Chapter "Microstrip Antennas" by Robert E. Munson, selected pages.
Constantine A. Balanis, "Antenna Theory" (1982, John Wiley & Sons, Inc.),selected pages.
Keith R. Carver et al., "Microstrip Antenna Technology" (IEEE Transactions on Antennas and Propagation, vol. AP-29, No. 1, Jan. 1981), pp. 2-23.
David M. Pozar et al., "Microstrip Antennas—The Analysis and Design of Microstrip Antennas and Arrays" (1995, Institute of Electrical and Electronic Engineers, Inc.), p. ix and 3.
John D. Kraus, "Antennas" (1988, McGraw-Hill, Inc.), preface and list of contents.
Waldschmidt, C. Compact wide-band multimode antenna for MIMO and diversity, IEEE Transactions on Antennas and Propagation, Aug. 2004, vol. 52, No. 8.
Kemp, D.C., Antenna diversity and user interaction at 1800 MHz, IEEE Antennas and Propagtion Society International Symposium, 2005, vol. 3A, pp. 479-482.
Dietrich C., Adaptive arrays and diversity antenna configurations for handheld wireless communication terminals, Dissertation submitted to the Faculty of the Virginia Polytechnic Institute, Feb. 15, 2005.
Martin, C., Multiple-input multiple-output (MIMO) radio channel measurements, IEEE Antennas and Propagation Society International Symposium, 2001.
Breur, J.J. et al., Bluetooth radio module with embedded antenna diversity, Proceedings of the 6th European Conference on Wireless Technologies, Oct. 2003, pp. 221-225, Munich.
Rosengren, K. et al. Radiation efficiency, correlation, diversity gain and capacity of a six-monopole antenna array for a MIMO system: theory, simulation and measurement in reverberation chamber, IEE Proceedings Microwave Antennas and Propagation, Feb. 2005, vol. 152.
Loredo, S. et al, An experimental analysis of the advantages of polarization diversity in indoor scenarios at 1.8 and 2.5 GHz, Microwave and optical technology letters, Dec. 5, 2001.
Zhang, Y.P., Antenna-in-package technology for modern radio systems, IWAT, Mar. 6, 2006.
Latif, S.I. et al, Bandwidth enhancement and size reduction of microstrip slot antennas, IEEE Transactions on Antennas and Propagation, Mar. 2005.
FLOWS project—Antenna feasibility study on the printed antenna elements and the multiple input multiple output ( MIMO ) antenna topologies to be used in Flow mobile terminals, FLOWS project, Nov. 18, 2002.
Raman, J. et al, Single- and dual-polarized millimeter-wave slot-ring antennas, IEEE Transactions on antennas and propagation, Nov. 1996.
Jaggard, D. L. Rebuttal expert report of Dr. Dwight L. Jaggard (redacted version). Fractus. Feb. 16, 2011.
Long, S. A. Rebuttal expert report of Dr. Stuart A. Long (redacted version). Fractus. Feb. 16, 2011.
Jaggard, D. L. Expert report of Dwight L. Jaggard (redacted)—expert witness retained by Fractus. Jan. 18, 2011.
Ko, S. Compact integrated diversity antenna for wireless communications, IEEE Transactions on Antennas and Propagation, vol. 49, No. 6, Jun. 2001.

* cited by examiner

ANTENNA DIVERSITY SYSTEM AND SLOT ANTENNA COMPONENT

This application is related to the European patent applications EP 05104026 filed on May 13, 2005 and EP06110437 filed on Feb. 27, 2006 and to the U.S. patent applications US60/680,693 filed on May 13, 2005 and US60/778,323 filed on Mar. 2, 2006. The priority of those four applications is claimed and they are incorporated herein by reference.

BACKGROUND OF THE INVENTION

The present invention relates to an antenna diversity system in particular to an antenna diversity system of a wireless device.

In known wireless systems, different mechanisms contribute to the propagation of a radio frequency signal. As the radiated electromagnetic waves travel from the emitter to the receiver, they encounter obstacles (like for example walls and furniture in indoor environments, or buildings, trees and vehicles in outdoor environments) and as a result some of the energy carried by the waves is absorbed, reflected, scattered and/or diffracted. Thus, not only the signal component that comes from the emitter following a direct path arrives at the receiver, but also other components of the same signal that follow either reflected, diffracted or scattered paths. However, since these other components follow longer paths, they arrive at a later time (i.e., with different phase) than the direct path. The propagation can be furthermore complicated by the fact that in some cases no direct path (or line-of-sight, LOS) will be possible between emitter and receiver.

In typical wireless systems the transmitted signal will encounter several obstacles, giving rise to a multiplicity of propagation paths, and signal components arriving at the receiver with different delays. Furthermore, since the transmitter, the receiver and the obstacles can change their position over time, the characteristics of the multipath propagation channel will be time-variant.

The multipath propagation results in the combination of several signal components with different phases at the receiving antenna. This out-of-phase addition can result in a temporary cancellation of the received signal (phenomenon known as fading), with the subsequent loss of information. This problem becomes more critical for wireless systems involving data transmission, because fading is responsible for the interruption of the communication, the loss of data (and subsequent increase in bit error rate, BER), and the decrease of the data bit rate. All these aspects degrade the quality of service (QoS) of the system.

An important technique used to overcome these impairments of the quality of communication available in the wireless channel is antenna diversity. The basic concept of diversity is to provide the receiver with more than one versions (also referred to as branches) of the transmitted signal, where each version is received through a different channel. If the channels are substantially independent (or uncorrelated), then the probability of having simultaneously a fading in all of them will be very small, which means that the signal formed from combining all the branches at the receiver will have many fewer deep fades than either one of the individual signals.

Antenna diversity is also useful in Multiple-input Multiple-Output (MIMO) systems. In such systems, a transmitter uses a first set of antennas to transmit different data streams over the same wireless propagation channel. At the receiver, a second set of antennas (wherein said second set does not need to comprise the same number of antennas as the ones in said first set) provides a MIMO detector with a plurality of received signals. Each one of these signals comprises multipath components of different transmitted data streams. A MIMO detector is able to extract from the received signals at least some of the data streams sent by the transmitter. Therefore, the use of antenna diversity in MIMO systems makes it possible to attain higher data bit rates and/or higher capacity.

There are several ways of implementing diversity using more than one antenna like space diversity, polarization diversity and radiation pattern diversity. Although these techniques can improve substantially the QoS of the system, it is difficult to implement an effective antenna diversity system in a wireless portable device (such as for instance a mobile phone, a smartphone, a PDA, a MP3 player, a headset, a USB dongle, a laptop, a PCMCIA or Cardbus 32 card) due to the reduced dimensions and form factors of current wireless devices, which will become even more critical in future devices as the trend is towards reducing even further their dimensions.

Space diversity is achieved by having at least two antennas separated in space as to obtain sufficiently low correlation between the signals received by any pair of antennas. It is known by a skilled-in-the-art person that low correlation will occur when the antennas are separated a distance of at least a half of the free-space operation wavelength of the antennas.

However, the typical dimensions of the printed circuit boards (PCB) of wireless devices makes space diversity difficult to implement in such devices and lead to a poor diversity gain (i.e., improvement in the QoS). Furthermore, the real estate requirements of several printed antennas or chip antennas (both in terms of antenna footprint and antenna clearance from ground plane) on the same PCB might be prohibitive for a typical wireless device. The problem will only aggravate as the trend is to put more functionality and services in smaller PCBs.

Polarization diversity takes advantage of the fact that the propagation phenomena in the wireless channel tend to be independent for orthogonal polarizations. This diversity technique can be implemented using two collocated antennas with orthogonal polarizations, or instead one cross-polarized antenna. Although this approach would ease the requirements of PCB area for the antenna, the shapes and form factors of real PCBs make it difficult to obtain nearly orthogonal polarizations.

Radiation pattern diversity uses directional antennas oriented to cover different angular regions of the space to obtain little correlation between the detected signals. However, as it happens with polarization diversity, the shapes and form factors of real PCBs lead to antennas with fairly omnidirectional pattern, hence resulting in poor diversity gain.

Further the invention relates to an antenna in a package or an antenna component.

The current trend in the market of wireless handheld devices, and more generally wireless portable devices, is the addition of more and more functionality and added-value services (such as for instance but not limited to internet and/or email browsing, personal organizers, geo-positioning and emergency location services, short-range connectivity with peripherals, television and/or radio receivers using DVB-H, DMB or DAB standards, MP3 player, digital cameras, or digital video recorders and/or players) into the devices, while at the same time reducing their overall dimensions.

Typically, a wireless handheld device contains a multilayer PCB which carries the electronic components, modules and other circuitry of said device. One or more layers of the multilayer PCB contain tracks that interconnect the different electronic components or modules mounted on the PCB. Other layers of said PCB are used to power the electronic components or modules and to ground them. These layers are commonly referred to as the power plane and the ground plane respectively.

A technique commonly used to mount electronic components on the PCB is the surface mount technology (SMT). An SMT component can be mounted (for example by means of soldering) directly onto a surface of the PCB without requiring fitting components with wire leads into holes in the PCB. Moreover, an SMT component is usually smaller than its leaded counterpart because it has either no leads, or smaller leads. An SMT component can have short pins, flat contacts, a matrix of balls (Ball Grid Array or BGA), terminations on the body of the component (passives), or short leads in a gull-wing formation (Quad Flat Package or QFP).

As the dimensions of a wireless handheld device or a wireless portable device are reduced, so does its PCB, requiring a high density of components on the PCB. Since SMT allows electronic components to be smaller in size and be mounted on both sides of the PCB of a handheld device, this technology has widely replaced through-hole technology in the electronics industry.

As far as the integration of the antenna into a wireless handheld device or a wireless portable device is concerned, small-sized antenna solutions requiring a small region of ground plane clearance are clearly preferred. Moreover, standard low-cost antenna solutions that can be used throughout a wide range of wireless devices with different shapes and form factors are highly desired.

In some cases, a wireless handheld device or a wireless portable device comprises an antenna printed on a layer of the multilayer PCB. However, printed antennas typically are not small in size, since their dimensions are approximately a quarter of an operating wavelength of the antenna. In addition to it, they have the disadvantage of not being modular, making it necessary to design the antenna to fit in a specific device. Therefore, for the sake of modularity, it is advantageous to embed an antenna into a standard SMT-type component featuring small dimensions and low profile, and that can be mounted on the PCB of a handheld device or a portable device.

Known SMT-type antenna components use monopole antennas or inverted-F antennas (IFAs), which despite achieving some degree of miniaturization (for instance by loading the antenna with a material with high dielectric constant) still require a ground plane clearance region around the extension of the SMT antenna component to enhance the radiation process of the antenna.

WO2004042868 discloses an integrated circuit (IC) package comprising an antenna. Although the antenna comprised in the IC package can take the form of a slot antenna, the document does not provide indication on how a conducting sheet internal to the IC package and containing the slot of a slot antenna should be connected to an external ground plane (such as for example that of a PCB) in order to ensure good grounding of said conducting sheet.

Moreover, in the case of an IC package comprising an antenna as described in WO2004042868, the antenna is fed with a radio-frequency (RF) feeding signal originating in a die also contained in the IC package (i.e., no coupling of the RF feeding signal from the outside of the IC package to the inside of said IC package is required).

OBJECT OF THE INVENTION

The present invention discloses a new antenna diversity system for wireless devices (such as for instance a mobile phone, a smartphone, a PDA, a MP3 player, a headset, a USB dongle, a laptop, a PCMCIA or Cardbus 32 card) that exhibits good diversity gain, while requiring little PCB area overhead.

One aspect of the invention relates to the technique to implement polarization diversity in a wireless device combining a first antenna and a second antenna, with the second antenna being a slot antenna and requiring very small area of the PCB.

According to the present invention, good polarization diversity can be obtained by appropriately choosing the orientation on the PCB, and by selecting the antenna type (i.e., whether a given antenna substantially behaves as an electric current source, or as a magnetic current source) for each one of the antennas comprised in the diversity system.

Figure 3A:
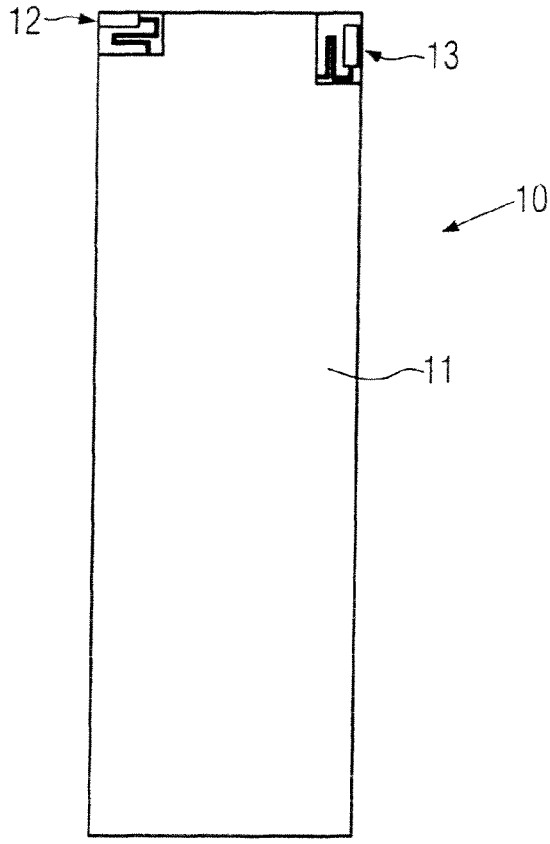
Figure 3B:
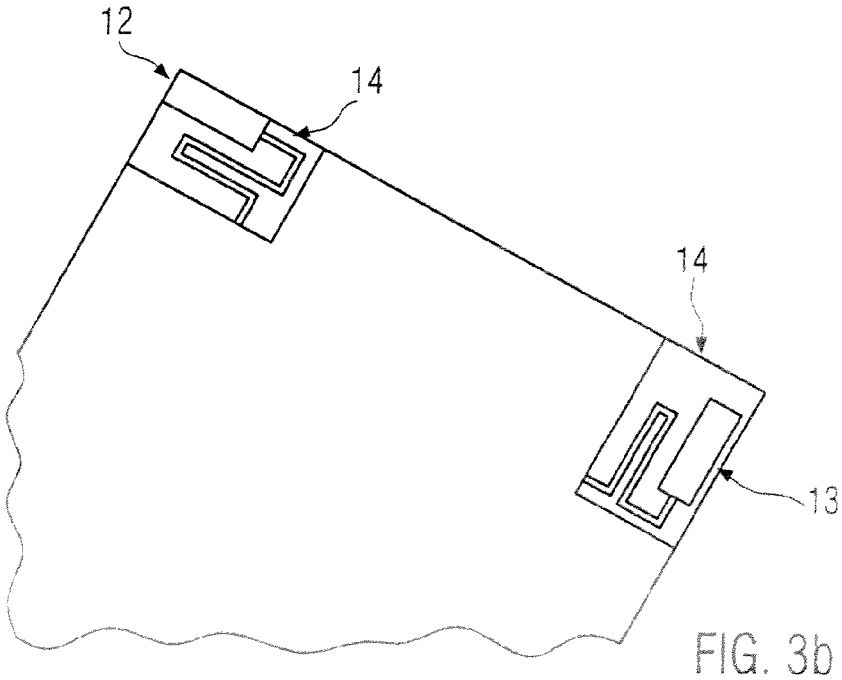

A diversity system for a wireless device 10 subject of an investigative study, like the one presented in FIG. 3, consists of a first antenna 12 placed on the top left corner of the PCB 11 of the wireless device 10, and a second antenna 13 placed on the top right corner of the PCB 11. For illustrative purposes, the first and second antennas 12 and 13 are surface mount technology (SMT) components mounted on the PCB 11, although either one could have been replaced by an antenna printed on the PCB 11. The placement and orientation of the first and second antennas 12 and 13 on the PCB 11, as well as the ground plane clearance 14 around the antennas has been selected to make the polarization of the first antenna 12 as orthogonal as possible to the polarization of the second antenna 13.

In some cases each antenna, the first antenna and the second antenna, can be for instance and without limitation a monopole antenna, an inverted-F antenna (IFA), a patch antenna, or a planar inverted-F antenna (PIFA).

Figure 4A:
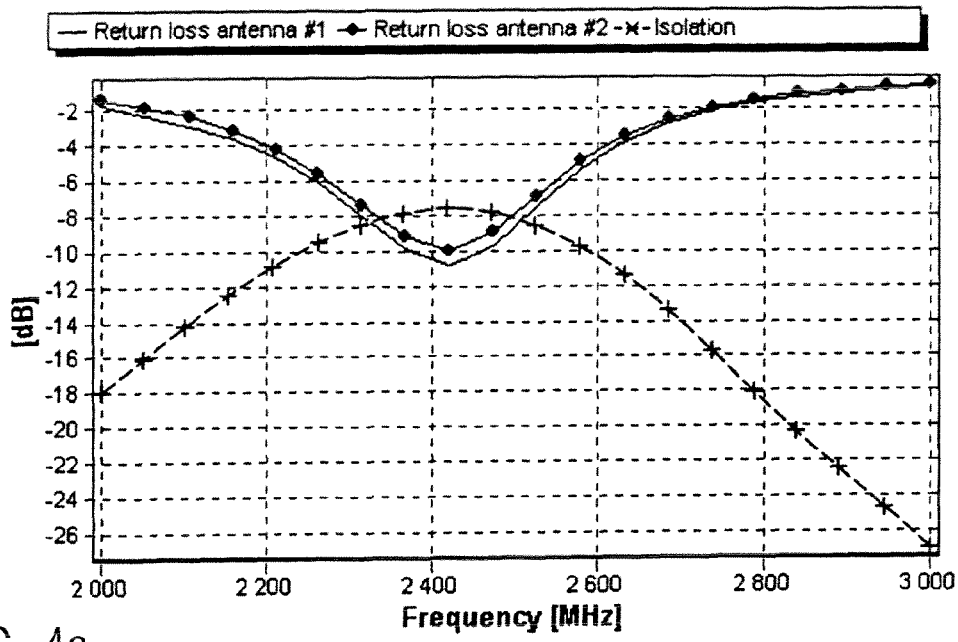
Figure 4B:
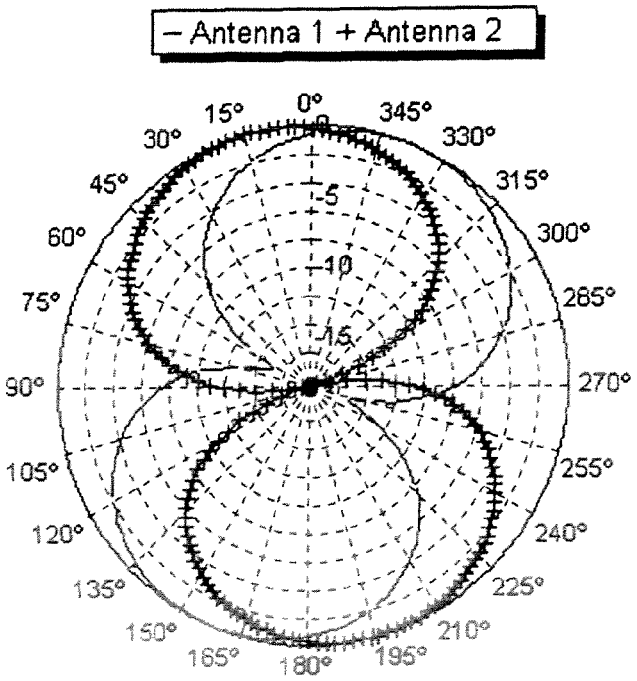

The typical electrical results for a wireless device with the antenna diversity system of FIG. 3 are shown in FIG. 4. In this example, the antennas were tuned in the 2400-2500 MHz band, as it can be observed in the input return losses of FIG. 4*a*. This frequency range has been selected just to illustrate the example, but the antennas could work in any frequency band included in the range from 400 MHz to 12 GHZ. The polarization pattern of the first antenna 12 and the second antenna 13, in FIG. 4*b*, shows that the angle between the two polarizations is smaller than 45 degrees (well below the desired 90 degrees for orthogonal polarizations). Therefore, the solution of FIG. 3 for polarization diversity in a wireless device has poor diversity gain.

The present invention relates to a slot-antenna component that can be mounted in a wireless handheld device, and generally in any wireless portable device, to enable the transmission and reception of electromagnetic wave signals.

It is an object of the present invention to provide a handheld or portable device (such as for instance a mobile phone, a smartphone, a PDA, an MP3 player, a headset, a USB dongle, a laptop computer, a gaming device, a digital camera, a PCMCIA or Cardbus 32 card), which comprises an antenna for mobile communications and/or wireless connectivity services, said antenna being a slot antenna, being at least partially embedded in a surface mount technology (SMT) component, and requiring very small area on a printed circuit board (PCB) of said handheld or portable device.

Another aspect of the invention relates to the corresponding technique to feed and to ground a slot-antenna component. Further aspects of the present invention relate to the control over the electrical parameters of the slot-antenna component, by appropriately selecting the placement and orientation of the slot-antenna component on the PCB of a handheld or portable device, and by carefully defining a portion of the slot on said PCB.

Another aspect of the invention relates to the technique to control the electrical parameters of the slot-antenna component (such as for instance its polarization) by appropriately selecting the placement and orientation of said slot-antenna component on the PCB of a handheld or portable device.

SUMMARY OF THE INVENTION

The above mentioned drawbacks are overcome with an antenna diversity system as of claim 1 and 47 and a wireless device as of claim 48. Further embodiments are disclosed in the dependent claims.

The present invention discloses a new antenna diversity system for wireless devices (such as for instance a mobile phone, a smartphone, a PDA, a MP3 player, a headset, a USB dongle, a laptop, a PCMCIA or Cardbus 32 card) that exhibits good diversity gain, while requiring little PCB area overhead.

One aspect of the invention relates to the technique to implement polarization diversity in a wireless device combining a first antenna and a second antenna, with the second antenna being a slot antenna and requiring very small area of the PCB.

In an antenna diversity system at least one operating frequency or frequency band of the two or more antennas is the same or at least partially overlapping.

The first antenna may be an electric current source and the second antenna may be a magnetic current source. The magnetic current source may be e.g. a slot antenna or a slot-loop antenna.

The first antenna may be e.g. a monopole, a dipole, a patch antenna, and IFA (inverted F-antenna) a PIFA (planar inverted F-antenna). Further it may be a multiband band antenna which has multiple operating frequency bands. In general any of those antennas may be formed by being printed as a conductive layer on a circuit board or by being etched from a conductive layer of a circuit board. Circuit boards in general are also referred to by the term printed circuit board or in short PCB. A conductive layer of a circuit board preferably is adapted such that it may at the same time act as a ground plane.

In some examples, it will be advantageous to have the slot antenna inscribed in a rectangular area of width smaller than $1/50$ of the free-space operating wavelength, and length smaller than $1/4$ of the free-space operating wavelength. Being more general, in some embodiments the said width divided by the free-space operating wavelength of the slot antenna will be smaller than, or equal to, at least one of the following fractions: $1/10$, $1/30$, $1/50$, $1/60$, $1/70$, or $1/80$. In the same way, for some embodiments the said length divided by the free-space operating wavelength of the slot antenna will be smaller than, or equal to, at least one of the following fractions: $1/2$, $1/3$, or $1/4$, or even smaller than, or equal to, at least one of the following fractions: $1/5$, $1/6$, $1/8$. In some other instances, it will be advantageous that the sum of the length and the width of the rectangular area in which the slot is inscribed be smaller than $1/2$ of the free-space operating wavelength, or even smaller than $1/4$ of the free-space operating wavelength.

Furthermore, it will be advantageous in some cases that the separation between the two edges of the slot to be within a range from approximately the 0.08% of the free-space operating wavelength to approximately the 8% of the free-space operating wavelength, including any subinterval of said range. Some possible lower bounds and/or upper bounds within said range include: 0.08%, 0.16%, 0.32%, 0.5%, 1%, 2%, 4%, 6% and 8%.

The shape of the slot can comprise straight and curved segments, not necessarily all segments being of the same length. They may, however, also all, or all but one, two or three, be of the same length. In the same way, the separation between the conductive edges of each segment of the slot does not have to be the same for all segments, nor constant for any given segment (i.e., any segment of the slot can be tapered). The separation may, however, be the same for all segments, or all but one, two or three segments. Further the separation may be constant in one, two three or more or all segments.

In some cases, it is advantageous to design the slot such that it is substantially parallel to the longer side of the PCB, because the currents excited on said PCB by the resonating mode of the first antenna tend to be substantially parallel to said longer side of the PCB. The same effect can be achieved if the longest straight segment of the slot is arranged substantially parallel to the longest extension or to the longest symmetry axis (symmetry axis which extends the longest way inside the PCB).

At least one end of the slot is preferably open. In this way short slot antennas can be realized. Further like this it is conveniently possible to connect such an open end to another slot of another conducting layer or surface or of a ground plane such that a combined slot is formed.

The slot antenna in some examples will be implemented as a slot printed or etched on the ground plane of the PCB, while in other cases the slot will be contained in a SMT type component mounted on the PCB of the wireless device. When the slot is contained in a SMT type component, said component will comprise a sheet of metal on which the slot is created. The SMT type component will provide at least one contact terminal accessible from the exterior of said SMT component to electrically connect said sheet of metal with the ground plane of the PCB. In some embodiments, this contact terminal can take the form of a pad, or a pin, or a solder ball.

It will be advantageous in some cases to define on the PCB a region of clearance of the ground plane on the orthogonal projection of the component on the PCB on which it is mounted. In other cases, there will be ground plane on a portion of the orthogonal projection of the SMT component on the PCB, but not under the orthogonal projection of the slot on said PCB.

Details of such a component are given in any of claims 52 to 76 and explained in more detail below and details of a wireless device with such a component are given in any of claims 77 to 109 and explained in more detail below.

Further it is advantageous, that at least two, three, four or more portions of the slot are parallel to each other. This may apply to straight and to non-straight segment. With this parallel arrangement very compact antennas can be achieved.

In order to maintain as much space as possible for other devices within the wireless device it will be advantageous to have the slot of the slot antenna occupying as little area as possible. Preferred values of the fraction which is occupied by the slot are indicated in claim 24.

In yet other cases, wherein the first antenna substantially behaves as an electric current source and the second antenna substantially behaves as a magnetic current source, good polarization diversity is achieved when the electric currents excited on at least a portion of the PCB by the radiating mode of the said first antenna are substantially parallel to the magnetic currents excited on at least a portion of the extension of the said second antenna.

In the context of this application, two directions are considered to be substantially parallel if they form an angle of less than, or equal to, approximately 30, approximately 20 or approximately 10 degrees.

It is also possible two have two antennas which are magnetic current sources such as e.g. slot or slot-loop antennas.

In some cases, the first antenna and the second antenna will be slot antennas aligned respectively along a first direction and a second direction, being said first direction substantially orthogonal to said second direction. In the context of this application, two directions are considered to be substantially orthogonal if they form an angle in the range from approximately 60 degrees to approximately 120 degrees, approximately 70 degrees to approximately 110 degrees or approximately 80 degrees to approximately 100 degrees. Also in the context of this application, the direction of slot can e.g. be defined by the direction of the longest side of the rectangular area in which said slot is inscribed.

In other cases, wherein the first and second antenna behave as magnetic current sources (for instance, but not limited to, slot antennas), good polarization diversity is achieved when the magnetic currents excited on at least a portion of the extension of the first antenna are substantially orthogonal to the magnetic currents excited on at least a portion of the extension of the second antenna.

Each of the first and second antenna or only one of those first and second antennas may have any of the characteristics of any of claims 6 to 10, 12 to 25. The ground plane of a circuit board on which the first and second antennas are provided may have the characteristic of claim 11.

Any slot antenna mentioned herein may be a multiband slot antenna.

It will also be possible to have two electric current sources as antennas.

In those cases, wherein the first and second antenna substantially behave as electric current sources (for instance, but not limited to, monopole antennas), good polarization diversity is achieved when the electric currents excited on the PCB by the radiating mode of the first antenna are substantially orthogonal to the electric currents excited on the said PCB by the radiating mode of the second antenna, in at least a portion of the PCB.

The antennas of the antenna diversity system have at least one operating frequency or frequency band in common. It will be, however, preferable to have at least two, three, four or more operating frequencies or frequency bands in common. Thereby an antenna diversity system can be achieved at multiple operating frequencies or frequency bands. Further at least one, two, three or more of the antennas of the antenna diversity system have operating frequencies or frequency bands which are not in common with the other antennas of the diversity system. This allows the use of such an antenna for other applications where an antenna diversity system is not desired or required without the need of a separate antenna.

The antennas are preferably located on or close to corners of the ground plane. Thereby they are provided close to an area without a ground plane such that radiation can be effectively transmitted to the outside. The same applies to the location of an antenna on or close to an edge of the ground plane.

For symmetry reasons it is advantageous to place at least one antenna on or close to an edge of a ground plane and there on or close to the middle of the edge. Thereby currents in the ground plane which are induced in a direction perpendicular to the longest side or extension of the ground plane are not redirected in this longer direction of the ground plane and therefore a good polarization diversity can be achieved.

In some embodiments, it will be preferable to keep the separation between the first antenna and the second antenna small in order to facilitate the connection of the two antennas to a common radio frequency RF hardware part of the wireless device. However, in other embodiments it will be preferable to have the first antenna and the second antenna further apart to maximize the isolation between the first antenna and the second antenna.

Generally, the present invention can be arranged inside several kinds of wireless devices to facilitate the integration of the antennas in a way that it is compatible with high density of components on the PCB of the device. For miniaturization purposes, at least a portion of the curve defining the conducting trace, conducting wire or contour of the conducting sheet of at least one antenna of the diversity system will advantageously be a space-filling curve, a box-counting, a grid-dimension curve, or a fractal based curve. The conducting trace, conducting wire or contour of the conducting sheet of said at least one antenna might take the form of a single curve, or might branch-out in two or more curves, which at the same time in some embodiments will be also of the space-filling, box-counting, grid-dimension, or fractal kinds. Additionally, in some embodiments a part of the curve will be coupled either through direct contact or electromagnetic coupling to a conducting polygonal or multilevel surface.

In some preferred embodiments the wireless device is operating at one, two, three or more of the following communication and connectivity services: In some preferred embodiments a wireless (e.g. handheld or portable) device including a slot antenna component according to the present invention is operating at one, two, three or more of the following communication and connectivity services: Bluetooth, 2.4 GHz Bluetooth, 2.4 GHz WiMAX, ZigBee, ZigBee at 860 MHz, ZigBee at 915 MHz, GPS, GPS at 1.575 GHz, GPS at 1.227 GHz, Galileo, GSM 450, GSM 850, GSM 900, GSM 1800, American GSM, DCS-1800, UMTS, CDMA, DMB, DVB-H, WLAN, WLAN at 2.4 GHz-6 GHz, PCS 1900, KPCS, WCDMA, SDARs, XDARS, DAB, WiFi, UWB, 2.4-2.483 GHz band, 2.471-2.497 GHz band, IEEE802.11ba, IEEE802.11b, IEEE802.11g and FM.

According to the present invention, good polarization diversity can be obtained by appropriately choosing the orientation on the PCB, and by selecting the antenna type (i.e., whether a given antenna substantially behaves as an electric current source, or as a magnetic current source) for each one of the antennas comprised in the diversity system.

The beforehand mentioned drawbacks of know antenna components are overcome by the SMT-type slot-antenna component of claim 52 and the wireless device of claim 77 and 109. Preferred embodiments are disclosed in the dependent claims.

The present invention discloses a slot antenna integrated in a SMT component that minimizes the ground plane clearance region needed on the PCB. Embedding a slot antenna in a discrete SMT component is difficult due to the necessity to ensure good grounding of the conducting sheet in which the slot has been created, and to the complexity to couple the feeding signal into the SMT component.

One aspect of the present invention relates to the grounding of the slot antenna integrated in an SMT component. Another aspect of the present invention refers to the feeding means to couple an RF feeding signal into the SMT slot-antenna component.

Contrary to the disclosure of WO2004042868, an aspect of a slot-antenna component according to the present invention relates to the feeding means to couple an RF feeding signal coming from the outside of the SMT component into said SMT component to feed the slot contained inside the SMT component.

The present invention discloses a slot-antenna component for mobile communications and/or wireless connectivity services that can be mounted as a standard SMT component on the PCB of a handheld or portable device (such as for instance a mobile phone, a smartphone, a PDA, an MP3 player, a headset, a USB dongle, a laptop computer, a gaming device, a digital camera, a PCMCIA or Cardbus 32 card).

An SMT-type slot-antenna component according to the present invention comprises:

At least one conductive surface (different from the conductive surface of the ground plane of the PCB) or a sheet of metal in which the pattern of a slot is created; and At least one contact terminal (hereinafter referred to as grounding terminal) accessible from the exterior of said component to electrically connect the conductive surface included in the slot-antenna component with the ground plane of the PCB;

With this component it is possible to provide a slot antenna as a separate component which can be connected from the outside. The antenna may further comprise:

At least one contact terminal (hereinafter referred to as feeding terminal) to couple an electrical signal from the outside of the SMT-type slot-antenna component with the slot defined in said at least one conductive surface.

It will in principle also be possible to couple a feeding signal into the component indirectly by a capacitive or inductive coupling. For a good feeding, however, a direct electrical connection is preferred. This can be achieved by the feeding terminal. In any case the component has no internal means for generating an RF signal with which the antenna may be fed.

Further it will be preferred that the component further comprises a dielectric substrate that backs said at least one conductive surface or sheet of metal, or in which said at least one conducting surface or sheet of metal is embedded;

The dielectric substrate allows for the backing of thin metal layers and is a widely used technique for the preparation of components for the electronics industry.

The terms sheet of metal and conductive surface are used for the same namely a conductive layer supported by a circuit board or a rigid piece of metal such as e.g. a stamped metal piece.

The antenna may be part of an antenna diversity system. It may, however also not be part of an antenna diversity system depending on the requirements of the application.

A contact terminal can take the form of a pad, a pin, or a solder ball. In some embodiments according to the present invention, it is advantageous to use a single contact terminal as grounding terminal and as feeding terminal, while in others it is preferred to use a contact terminal as grounding terminal only or as feeding terminal only. Further multiple contacts may be provided each of which is only for grounding, only for feeding or for both.

Additional pads may be provided which are not electrically connected inside the component or to the ground plane or a feeding element of the circuit board. Those pads may be useful fore mechanically holding the antenna component by the solder connection at that pad between the component and the circuit board.

In some embodiments according to the present invention, the SMT component can also include one or several electronic elements or circuits, or the SMT component can take the form of an IC package. When the slot-antenna component takes the form of an IC package, then the slot contained in said IC package is excited with an RF feeding signal coupled from the outside of said IC package, and not directly from a semiconductor die comprised inside said IC package.

In certain of these embodiments, the electronic elements or circuits included in the SMT component or IC package will be preferably placed within the SMT component or IC package in such a way that they are not on the projection of the slot contained in the SMT component.

In some other embodiments, a slot-antenna component may comprise more than one, two or three conductive surfaces in which a slot or a portion of a slot is created. By this technique it will be possible to "fold" the slot in vertical direction away from the PCB. Therefore the footprint area on the PCB required for such an antenna will be significantly reduced in comparison to antennas where the slot is "folded" in a plane parallel to the PCB surface plane. Most conveniently two conducting surfaces can be provided on the two opposite large sides of a circuit substrate. If a multilayer circuit substrate is used, further surfaces can be provided in order to form the slot antenna in the component.

The different surfaces may be connected or may remain unconnected. The connection may be done by a via hole or by a connection around the edge of a circuit substrate.

In order to protect a conducting layer it will be advantageous to cover that layer with a protection layer. This prevents corrosion. Further such a protection layer can be used to define terminals of the conducting layer which are then available for e.g. a solder connection.

The antenna characteristics can further be chosen by using open-ended or closed-ended slot geometries. Any end of the antenna may be open or closed.

In some embodiments it is advantageous to place grounding terminals to connect the conductive surface with the ground plane of the PCB close to at least two opposite edges of the slot-antenna component, preferably those two opposite edges that are the farthest apart from each other, so that the electric currents induced by the operation of the slot antenna on the conductive surface can flow through grounding terminals into the ground plane of the PCB as if the conductive surface and the ground plane of the PCB were one single conductive surface.

In certain cases it might be interesting to place a grounding terminal substantially close to at least two corners of said at least two opposite edges of the component, but preferably the four corners of said two opposite edges of said component.

Further it is preferred to extend one or more ground terminal along a major part of the length of an edge of the component or of the conductive surface. Preferably the ground terminal may extend along at least 40%, 50%, 60%, 70%, 80%, 90% or 95% of the length of an edge. Thereby a good connection of the conducting surface to the ground plane of the PCB is achieved. This is in particular the case where two grounding terminals extend along opposite edges such as the short and/or the long edges. One ground terminal may also be bent such that it is L-, U- or O-shaped and is preferably provided along one, two, three or four neighboring edges.

Furthermore, in some examples it can be advantageous to place grounding terminals at two sides of a feeding terminal and substantially close to said feeding terminal. This arrangement can be used to effectively excite the slot.

Further in some cases it will be advantageous to provide the feeding terminals on two sides of the slot. Then it is possible to combine the slot with another slot by connecting the respective two edges of the two slots, thereby forming a larger slot.

In some embodiments the feeding means of the slot-antenna component comprise a feeding contact and a conductive strip. Said conductive strip can be advantageously printed or etched on the same conductive surface as the slot, thus making the feeding means coplanar with the slot. The conductive strip connects the feeding terminal with the edge of slot that is farther away from the contact terminal.

Preferably a clearance region is provided at least on one, two, or three sides of the feeding terminal. This is in particular useful if the terminal is only used for feeding purposes. If the feeding terminal is also used for grounding purposes such clearance might not be present.

Also for the conductive strip a clearance may be provided. This clearance may not be necessary if the conductive strip is provided on a different level as the conductive surface with the slot. If the conductive strip is provided on a different level it may be connected to the conductive surface of the slot by a via hole or capacitive or inductive coupling. In the same way the coupling between the feeding terminal and the conductive strip may be made by capacitive, inductive or direct electrical contact coupling.

It will be advantageous in some cases to define on the PCB of the wireless device a region of clearance of ground plane on the orthogonal projection of the slot-antenna component on the PCB on which it is mounted. In other cases, there will be some ground plane on a portion of the orthogonal projection of the slot-antenna component on the PCB, but not under the orthogonal projection of the slot created in the conductive surface of the slot-component on the PCB. Yet in other embodiments, there will be ground plane also in a portion of the orthogonal projection of said slot on the PCB. In some examples, the fraction of the projection of the slot occupied by ground plane will be less than, or approximately equal to, a 50%, 40%, 30%, 25%, 20%, 10% or 5% of the projection of the slot on the PCB.

In order to form accepting pads on the PCB for receiving the terminals of the antenna component without however unnecessarily reducing the ground plane clearance it is advantageous to provided protrusions of the ground plane which extend into clearance.

Further the size of the area of the clearance e.g. given in $mm^2$ may be smaller than the size of the antenna component.

In certain embodiments the slot-antenna component is electrically coupled by means of feeding terminals with a slot created on the ground plane of the PCB of the wireless (e.g. handheld or portable) device. In other words, a slot antenna is formed by combining the slot pattern printed or etched in the ground plane of the PCB with the slot pattern included in the SMT component. Having a portion of the slot antenna printed or etched in the ground plane of the PCB can be advantageous, particularly because this:

- allows the fine tuning of the antenna to account for changes in the dimensions and/or form factor of the ground plane of the PCB to which the slot-antenna component is connected, or the effects of dielectric (e.g., plastic) casings or enclosures, by simply acting on the portion of the slot antenna printed on the ground plane of the PCB.
- provides the PCB designer with more flexibility when laying out the different electronic components on the PCB as the shape of the portion of slot antenna created in the ground plane can be selected for example to meet space constraints, or to minimize the distance of the antenna to the RF circuit.

Since this is achieved by acting only on the portion of the slot printed or etched on the ground plane of a PCB, while leaving the geometry of the slot contained in a conductive surface of an SMT component unchanged, such embodiments are effective in providing a standard component that can be used in a great variety of application environments.

In order to arrange the antenna such that as much space as possible is left over for other components it is advantageous to orient an edge and in particular a long edge of the SMT-type slot antenna component substantially parallel to the short or long edge of the circuit board.

The antenna component should not be to far away from the edge of the circuit board. This facilitates providing a clearance and assures good radiation characteristics.

In some embodiments the antenna component is preferably located on or close to the middle of an edge and in particular on or close to the middle of a long edge of the circuit board or the ground plane. A symmetric location with respect to the ground plane can provide a more predictable polarization characteristic since currents induced in the ground plane are not redirected in an asymmetric way by the shape of the ground plane. This may apply even if the antenna itself is not symmetric but the location of the antenna on the ground plane is symmetric or almost symmetric.

The slot of the component may be excited by balanced or unbalanced feeding. This can be done with the help of a coplanar or coaxial transmission line or a microstrip transmission line.

In a preferred embodiment there are two slot-antenna components. This allows for the coverage of different frequencies or frequency bands or the coverage of the same frequency or frequency bands in a diversity system, such as a polarization and/or space diversity system or in MIMO systems. For a polarization diversity system it will be advantageous to provide two slot-antenna components (or their longer sides) substantially orthogonal to each other.

In general the (e.g. two, three or more) antennas of an antenna diversity system may be preferably identical apart from their orientation. This applies in particular to the case where slot antennas in the ground plane and/or in a component are used for forming the diversity system.

The circuit board may comprise a pad which is connected to the feeding pad. Depending on the feeding scheme this pad may or may not be connected to the ground plane of the circuit board.

By combining the slot of a ground plane and the slot of a slot-antenna component it is possible to obtain combined slots which are open at none, one, or two ends.

If such a combined slot is provided this combined slot may be excited by exciting the slot portion of the antenna component or the slot portion of the ground plane. The latter may be preferred since with this technique it is possible to connect to RF-generator directly with the ground plane of the circuit board on which the RF-generator itself is provided.

If the slot of the antenna component or a combined slot (see above) has a closed end it is preferable to excite the slot at a certain distance from the closed end. The distance along the slot geometry divided by the free space operating frequency is preferably less than 0.002, 0.004, 0.008, 0.012, 0.016, 0.025, 0.033, 0.04, 0.08, 0.1 or 0.15.

In some preferred embodiments a wireless (e.g. handheld or portable) device including a slot antenna component according to the present invention is operating at one, two, three or more of the following communication and connectivity services: Bluetooth, 2.4 GHz Bluetooth, 2.4 GHz WiMAX, ZigBee, ZigBee at 860 MHz, ZigBee at 915 MHz, GPS, GPS at 1.575 GHz, GPS at 1.227 GHz, Galileo, GSM 450, GSM 850, GSM 900, GSM 1800, American GSM, DCS-1800, UMTS, CDMA, DMB, DVB-H, WLAN, WLAN at 2.4 GHz-6 GHz, PCS1900, KPCS, WCDMA, SDARs, XDARS, DAB, WiFi, UWB, 2.4-2.483 GHz band, 2.471-2.497 GHz band, IEEE802.11ba, IEEE802.11b, IEEE802.11g and FM.

Any reference in this document to a or the free-space operating wavelength may refer to any free-space operating wavelength of an antenna or in particular to the largest free-space operating wavelength of different possible operating wavelengths.

In wireless devices the possible free-space operating wavelengths are usually given by the RF-generator or RF-receiver circuit which may be included in the wireless device.

LIST OF FIGURES

Figure 6:
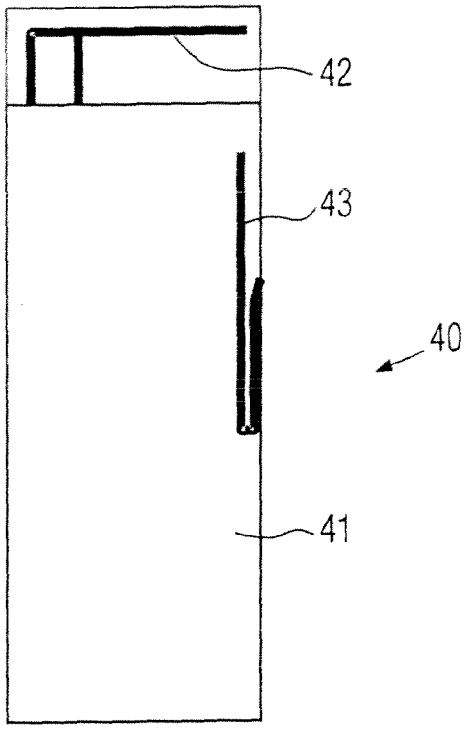
Figure 7:
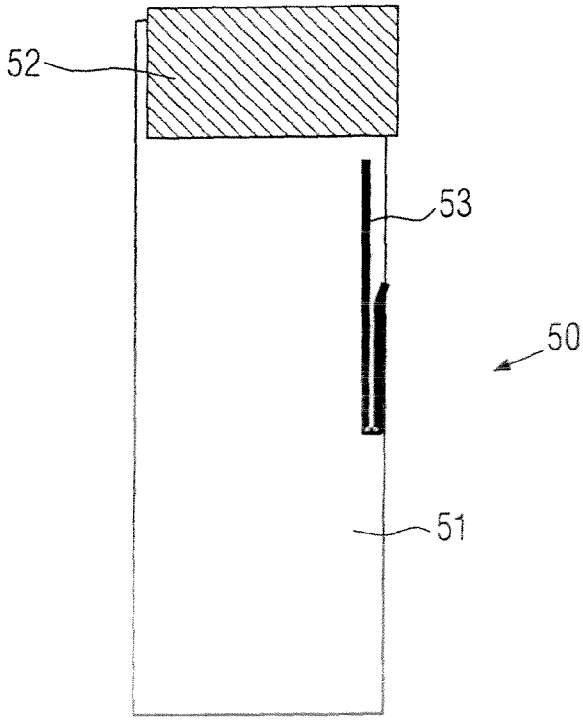
Figure 9A:
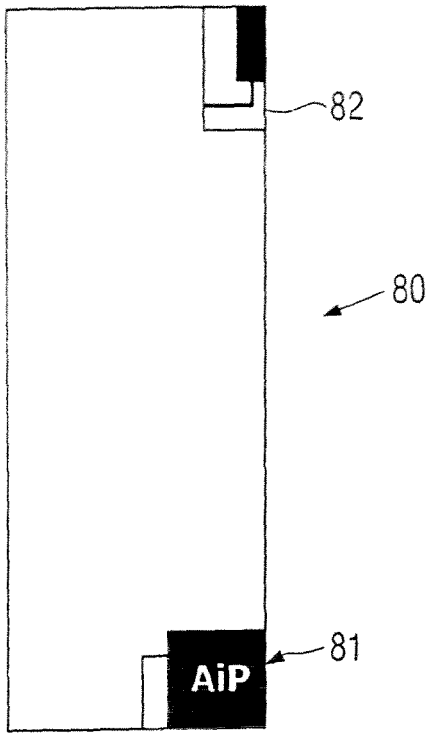
Figure 9B:
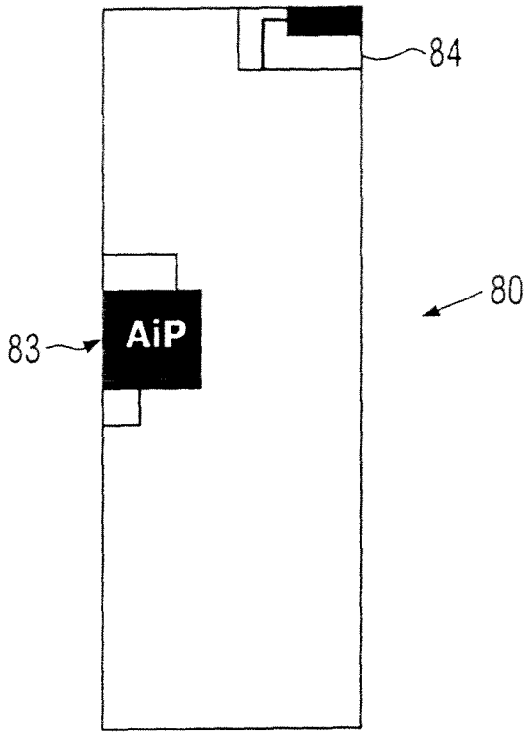
Figure 9C:
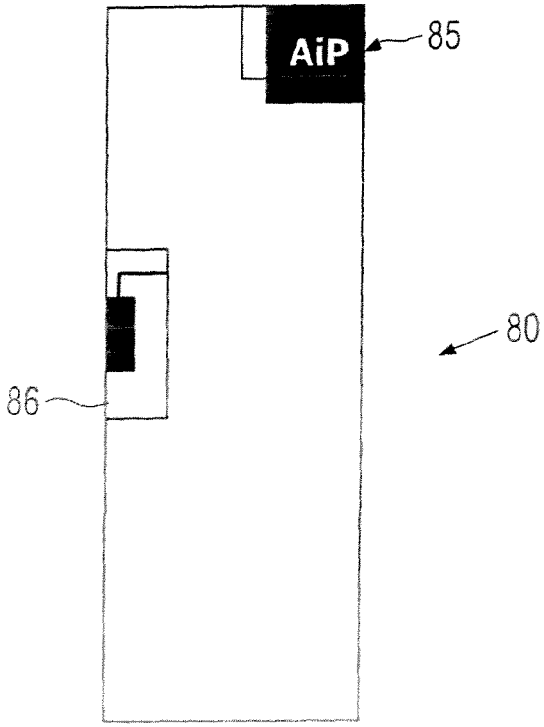
Figure 10:
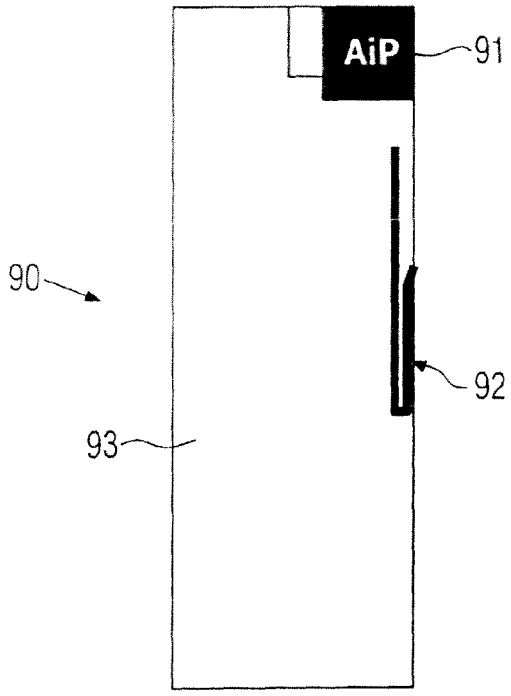
Figure 11:
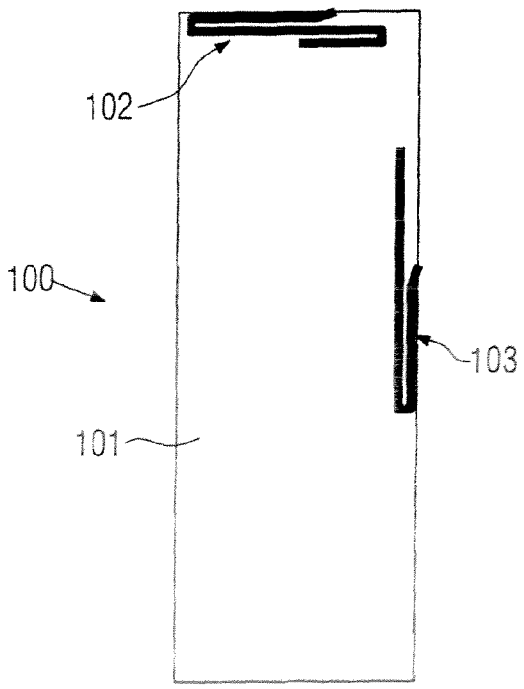

Further characteristics and advantages of the invention will become apparent in view of the detailed description which follows of a preferred embodiment of the invention given for purposes of illustration only and in no way meant as a definition of the limits of the invention, made with reference to the accompanying drawings, in which shows:

FIG. 1 an antenna diversity system of the present invention;

FIG. 2 typical electrical performance of the device of FIG. 1;

FIG. 3 the antenna diversity system of an investigative study;

FIG. 4 typical electrical performance of the device of FIG. 3;

FIG. 5 examples of the possible locations of two antennas according to the present invention;

FIG. 6 an example of an antenna diversity system of the present invention;

FIG. 7 another example of an antenna diversity system of the present invention;

FIG. 8 further examples of antenna diversity systems of the present invention and some further illustrations of terms used within this document;

FIG. 9, FIG. 10 further examples of antenna diversity systems of the present invention;

FIG. 11 an example of an antenna diversity system with two slot antennas according to the present invention.

Figure 14:
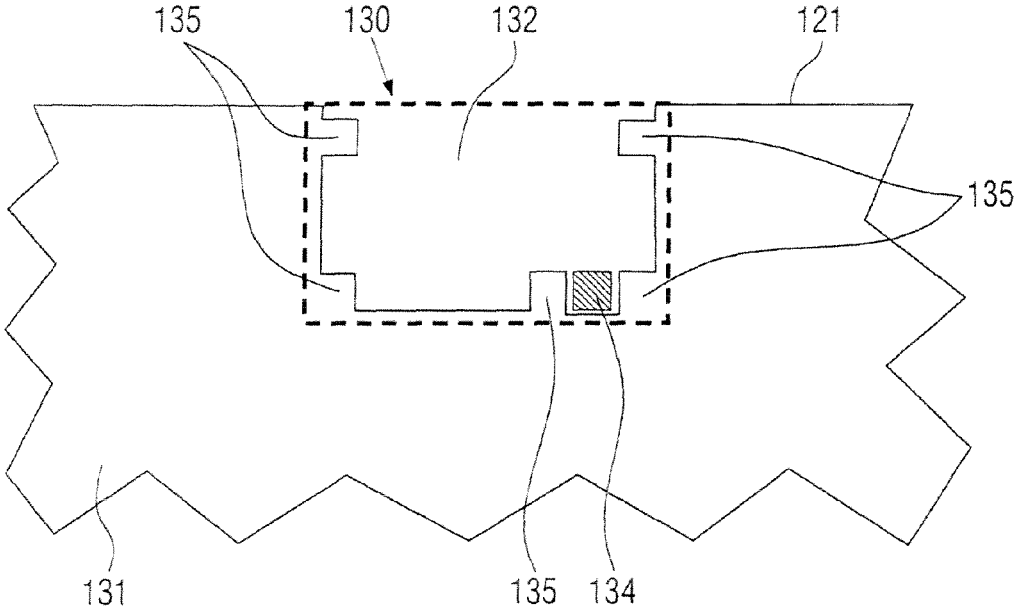

FIG. 12 (*a*) a three dimensional view of a slot antenna component; (*b*) a view onto the slot without the dielectric substrate;

FIG. 13 different possible locations of an antenna component on the circuit board;

FIG. 14 a schematic view of an example of the ground plane clearance and the slot-antenna component location;

FIG. 15 (*a*) a three dimensional view of a slot antenna component; (*b*) a view onto the slot without the dielectric substrate.

FIG. 16 (*a*) a schematic view of an example of the ground plane clearance and a possible slot-antenna component location; (*b*) the ground plane together with the slot antenna component;

FIG. 17 (*a*) a three dimensional view of a slot antenna component; (*b*) a view onto the slot without the dielectric substrate.

Figure 21:
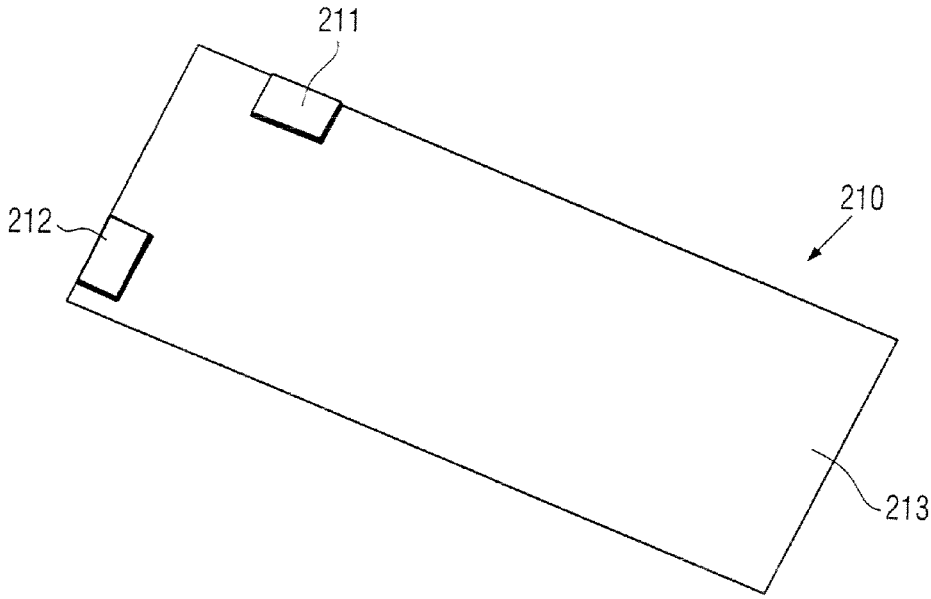
Figure 22:
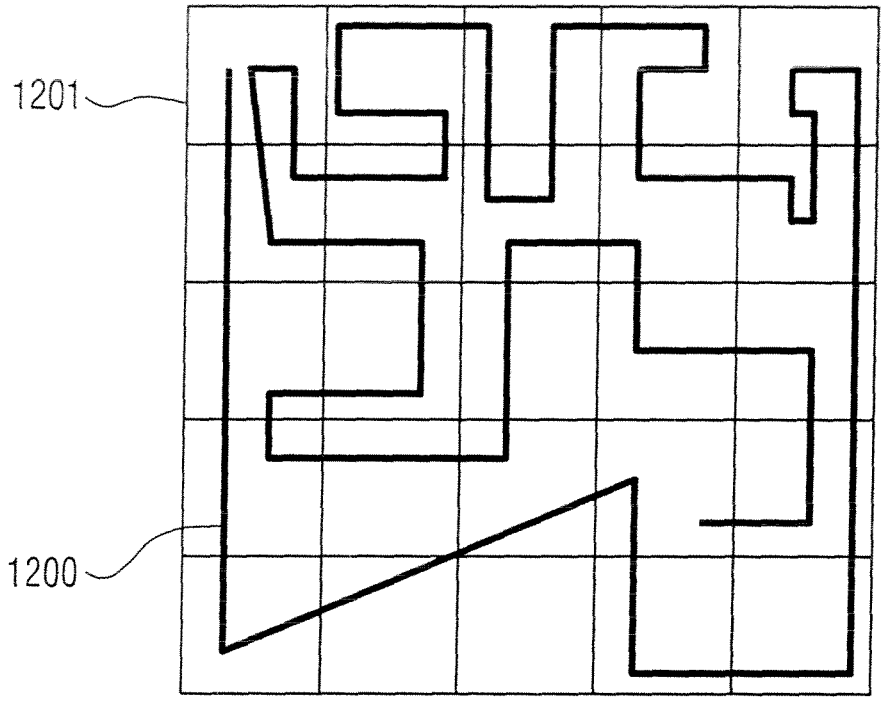
Figure 22:
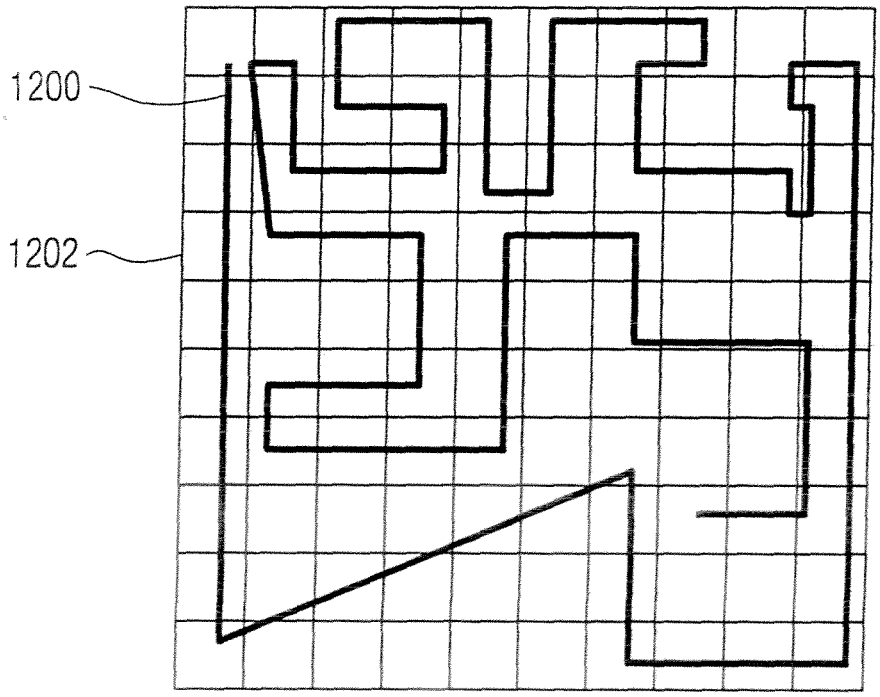
Figure 23:
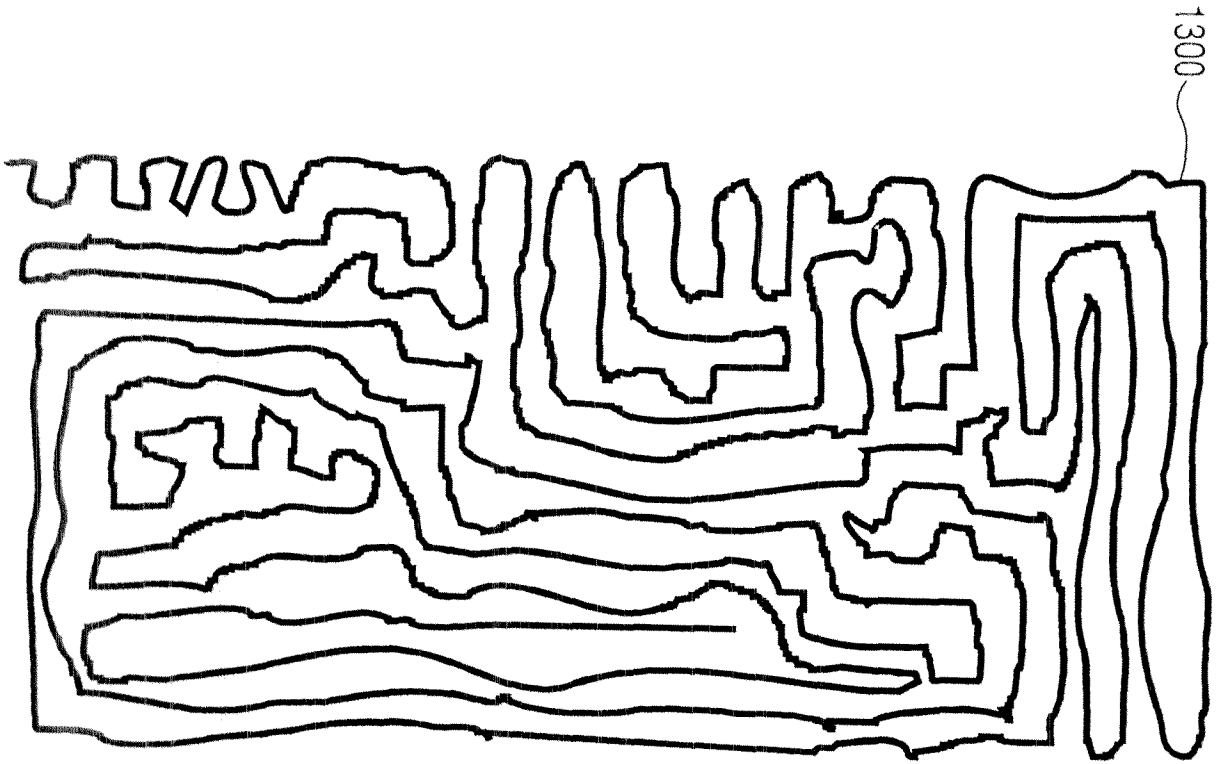
Figure 24:
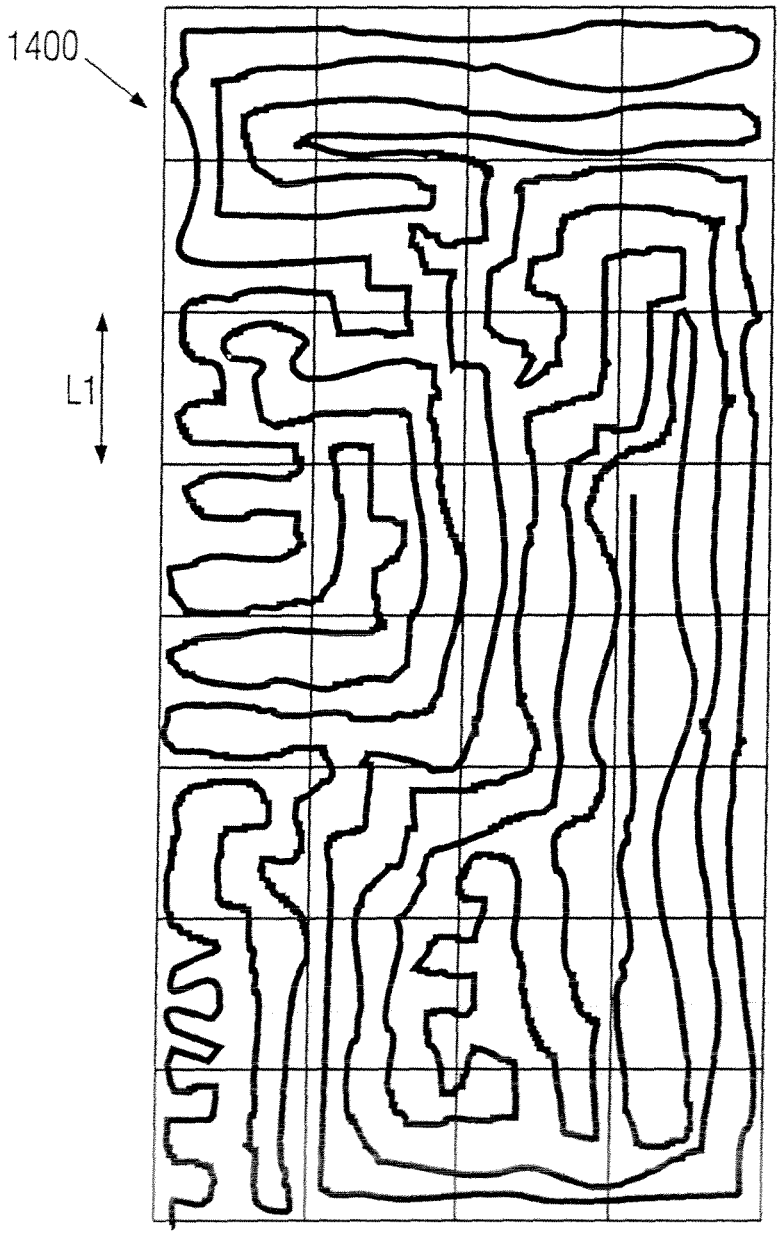
Figure 25:
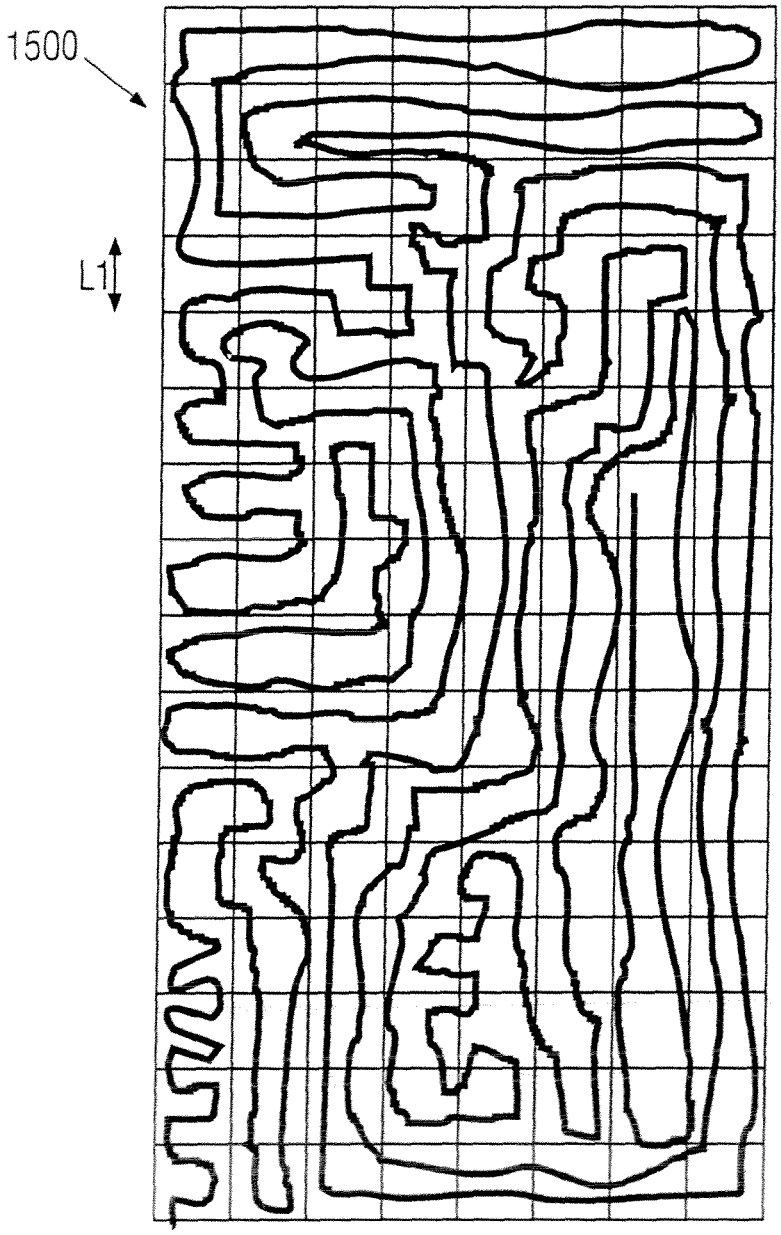
Figure 26:
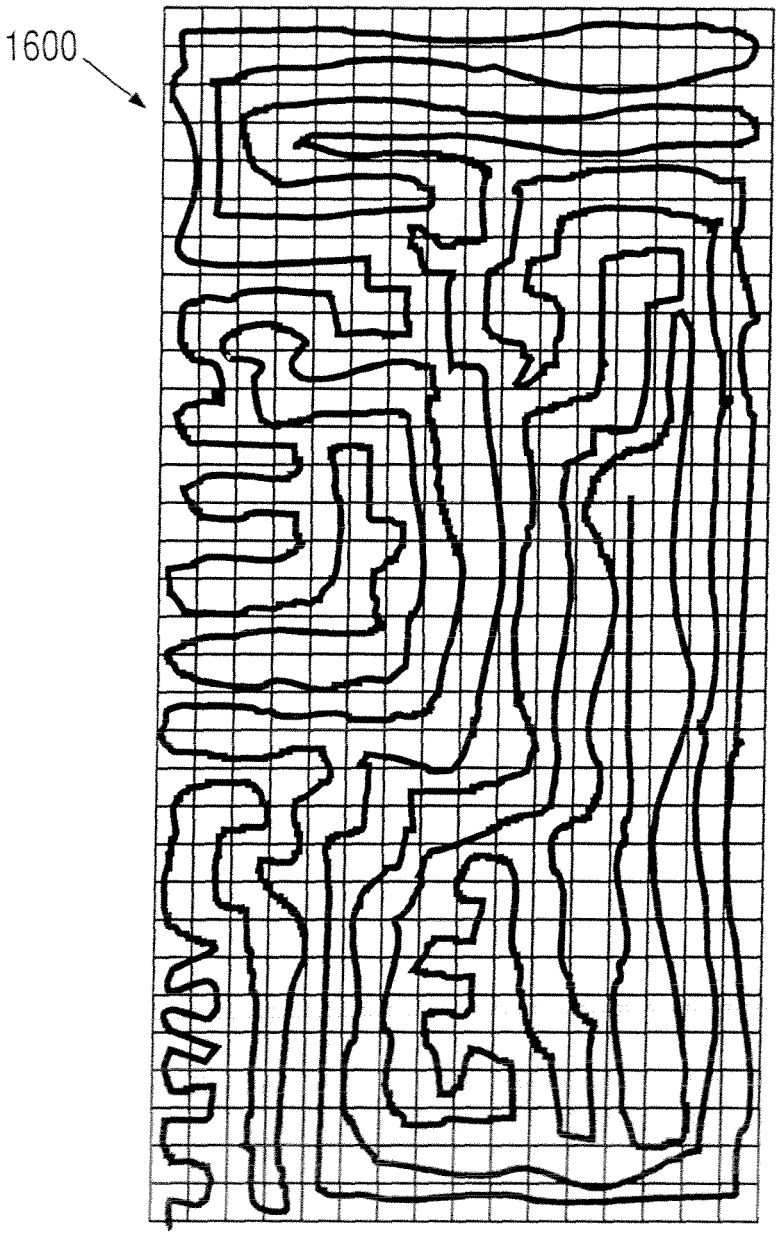

FIG. 18 different possible feeding schemes of the arrangement of FIG. 15;

FIG. 19 different possible feeding means for the arrangement of FIG. 15;

FIG. 20 multiple conducting surfaces of a slot antenna component;

FIG. 21 a possible arrangement of two slot antenna components on a circuit board;

FIG. 22 example of a box counting curve located in a first grid of 5×5 boxes and in a second grid of 10×10 boxes;

FIG. 23 example of a grid dimension curve;

FIG. 24 example of a grid dimension curve located in a first grid;

FIG. 25 example of a grid dimension curve located in a second grid;

FIG. 26 example of a grid dimension curve located in a third grid.

DETAILED DESCRIPTION OF FIGURES

FIG. 1 shows an example of a top plan view of a diversity system 1 for a wireless device formed by two antennas 2, 3 in which one antenna 2 is a component or chip antenna, and the other antenna is a slot antenna 3 printed on the PCB. FIG. 1*a* shows a general view of the PCB (with dimensions 100 mm×40 mm for the purpose of the example) carrying the two antennas 2, 3 and FIG. 1 *b* shows a detailed view of FIG. 1*a* of the region that contains the two antennas 2, 3.

In the example of FIG. 1, and without being a limitation of the invention, the slot 3' has been created on the ground plane of the PCB 4 on its right hand side. The shape of the slot 3', and the length and widths of each one of the segments that form the said slot 3', can be selected to meet the requirements of resonance frequency, electrical performance, and maximum PCB area constraint, of a given wireless device. The design of the slot 3' and its orientation with respect to the PCB 4 is selected such that the slot 3' is substantially parallel to the direction of the currents excited on the PCB 4 by the resonating mode of the first antenna 2, at least on a portion of the PCB 4.

Two segments of the slot 3' including to the longest straight segment are oriented parallel to the edge of the PCB. They are connected by a slot 3' section which is oriented perpendicular to the long two sections. The slot 3' ends open ended since it ends on one edge of the ground plane. The other end of the slot 3' is closed.

In FIG. 1 the first antenna 2 is located in or on a corner of the PCB. The second antenna 3 is located on or close to the edge of the PCB but separated from the corner by the first antenna 2. In FIG. 1 the entire PCB is covered with a ground plane (apart from the place where the slot 3' is formed). Further a portion of the ground plane may be omitted close to the first antenna 2 in order to form a clearance for the first antenna 2.

Figure 1B:
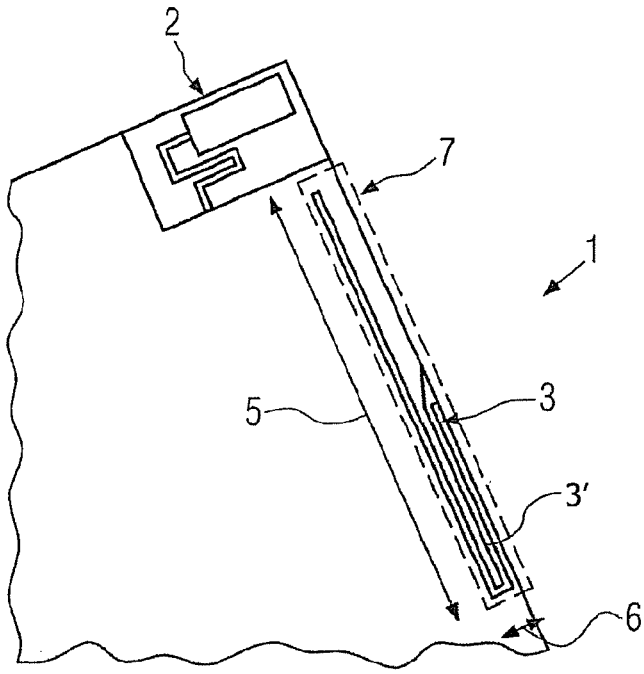

A rectangle 7 in which the slot 3' is inscribed is shown in FIG. 1*b*. The width of the rectangle is indicated with reference sign 6 and the length with reference sign 5.

Figure 2A:
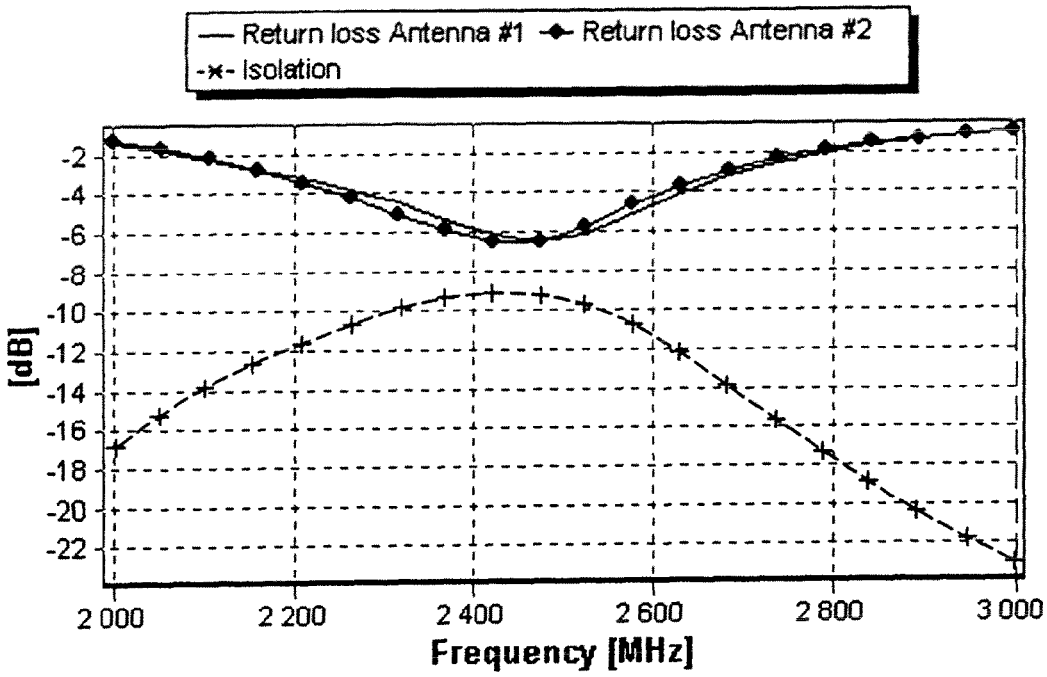
Figure 2B:
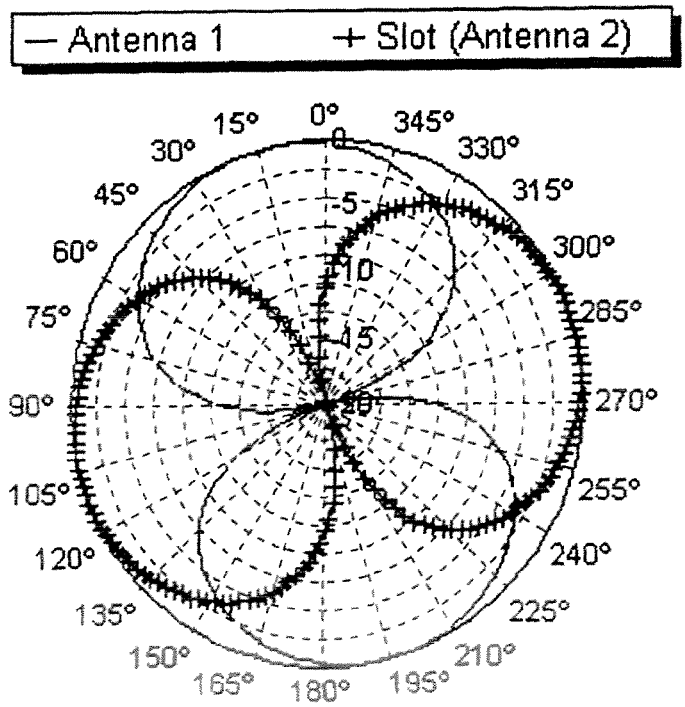

FIG. 2 shows the typical electrical performance of the antennas of the wireless device shown in FIG. 1. FIG. 2*a* shows the return loss of each antenna and isolation between antennas and FIG. 2*b* shows polarization pattern of each antenna.

In FIG. 2 for the purpose of the example, and without loss of generality, the operation band has been selected to be 2400-2500 MHz. As it can be observed, the two-antenna solution of the example provides two polarizations that form the angle of approximately 98 degrees (substantially close to the desired 90 degrees for orthogonal polarizations). In the context of this patent application, two polarizations are considered to be substantially orthogonal if the angle formed by the said two polarizations is in the range from approximately 60 degrees to approximately 120 degrees, from approximately 70 degrees to approximately 110 degrees or from approximately 80 degrees to approximately 100 degrees.

FIG. 5 shows a top view of some implementations of the diversity system for wireless devices comprising a slot antenna (black thick line) on the PCB (large rectangle) of the device. This Fig. presents some possible embodiments for the present invention of a diversity system for a wireless device comprising a slot antenna. For example, isolation between the antennas on the PCB for the case of FIG. 5*b* is expected to be better than for the case of FIG. 5*a*, as the separation between the antennas is larger, although this will complicate the feeding scheme of the two antennas.

Figure 5A:
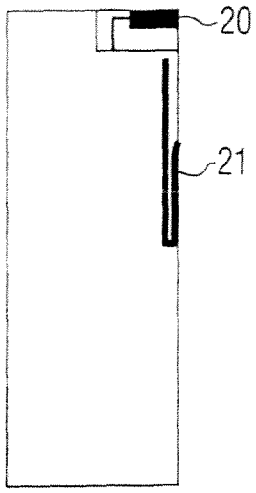
Figure 5B:
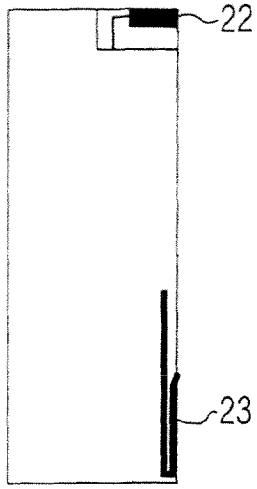
Figure 5C:
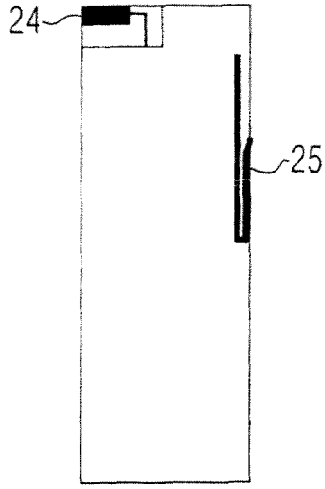
Figure 5D:
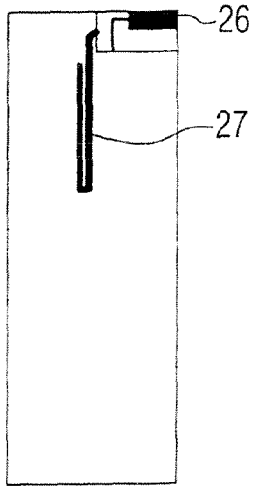
Figure 5E:
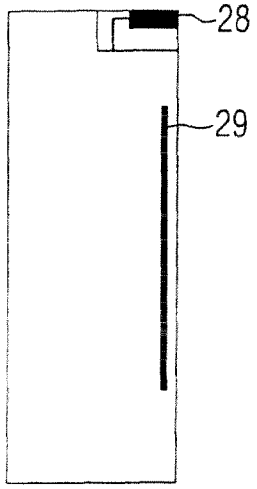
Figure 5F:
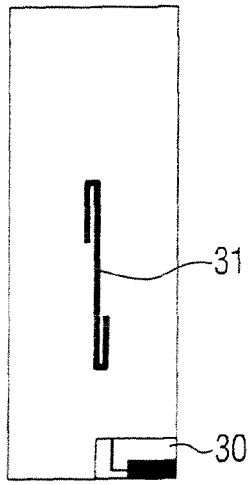

The arrangement of FIG. 5*a* corresponds to that of FIG. 1. In FIGS. 5*a* and 5*b* the two antennas 20, 21 and 22, 23 are located close to the same edge of the PCB. In FIG. 5*c* they are located on or close to opposite edges of the PCB. In FIG. 5*d* the slot 27 is located along and close to the middle line of the PCB. It ends in a clearance area of the first antenna such that one end is open and the other end is closed. In FIGS. 5*e* and 5*f* the slots have two closed ends each. The slot antenna 29 is located parallel and close to the longer edge of the PCB (FIG. 5*e*). In FIG. 5*f* the slot is located close to the middle line.

Figure 5G:
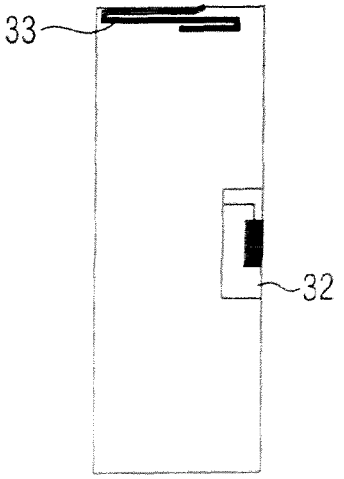

In FIG. 5*a* through 5*f* the slot antenna and its longest straight segment is arranged in parallel to the longer edge or side of the PCB while in FIG. 5*g* the slot antenna is located close to and in parallel to a short edge of the PCB. The slot in FIG. 5*g* ends at the short edge of the PCB (upper edge).

Figure 5H:
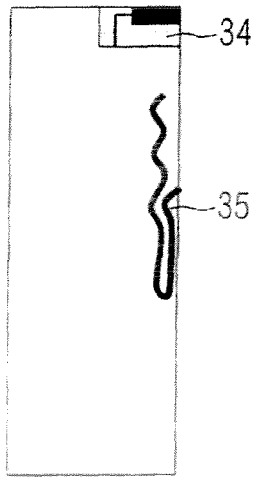
Figure 5I:
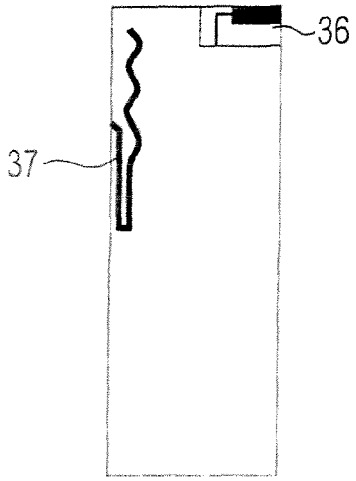

FIGS. 5*h* and 5*i* show that the slot antenna may have non-straight segments. In FIG. 5*h* two curved segments are in parallel.

FIG. 6 shows an example of a diversity system 40 for a wireless device formed by two antennas 42, 43 in which one antenna 43 is a slot antenna, and the other antenna 42 is an IFA printed on the PCB 41 of the device. In the area (smaller upper rectangle) of the IFA no ground plane is provided on the PCB, such that a clearance is given. The slot is formed in an area (lower rectangle) where there is a ground plane.

FIG. 7 shows an example of a diversity system 50 for a wireless device formed by two antennas in which one antenna is a slot antenna 53, and the other antenna is a multiple-band antenna 52. The multiple-band antenna 52 is used for mobile phone communications, but also includes, as one of its operating bands, the same frequency band as the one of the slot antenna. In the area of the multiple-band antenna no clearance may be given, such that e.g. a patch antenna is provided as a multiple-band antenna. The slot antenna 53 is provided separated from the multiple-band antenna 52. In FIG. 7 the multiple-band antenna 52 is shown in a position shifted a little to the left and upwards. This is only to show that there may be a separation between the PCB 51 and the antenna 52. In general the antenna 52 will be located well above the PCB 51 such that the right, top and left edge will coincide.

FIG. 8 shows examples of a diversity system 60 for wireless devices comprising a first antenna 63, 67, 70 integrated in a semiconductor package (AiP: Antenna in Package) that is mounted on the PCB 61 of the device and a second antenna being: in FIG. 8*a* a component or chip antenna 62; or in FIG. 8*b* an antenna (here an IFA 65) printed on the PCB 61; or in FIG. 8*c* a multiple-band antenna with some bands used for cellular communications, but also with a band at the same frequency band as the one of the first antenna 70.

At the first antenna 63, 67 and 70 a clearance 64, 69 of the ground plane is provided. The AiP component is provided partially above the ground plane and partially above the clearance. In FIG. 8*b* the clearance 66 for providing the IFA antenna 65 and a clearance for the AiP component are joint such that only one clearance is given.

Figure 8A:
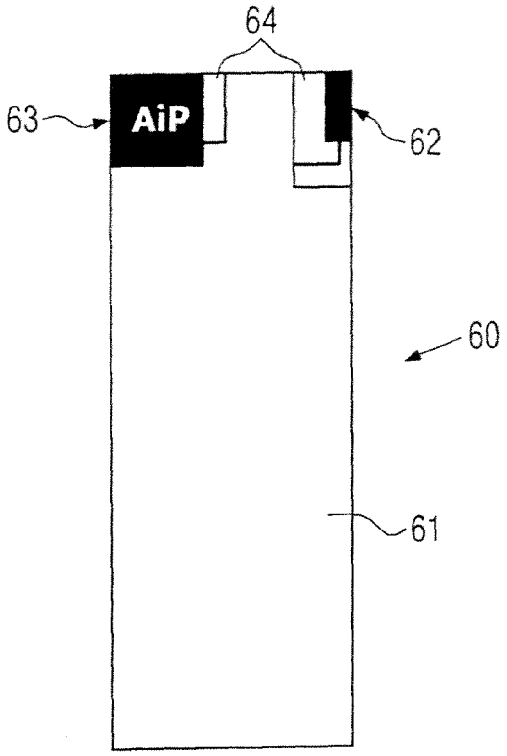
Figure 8B:
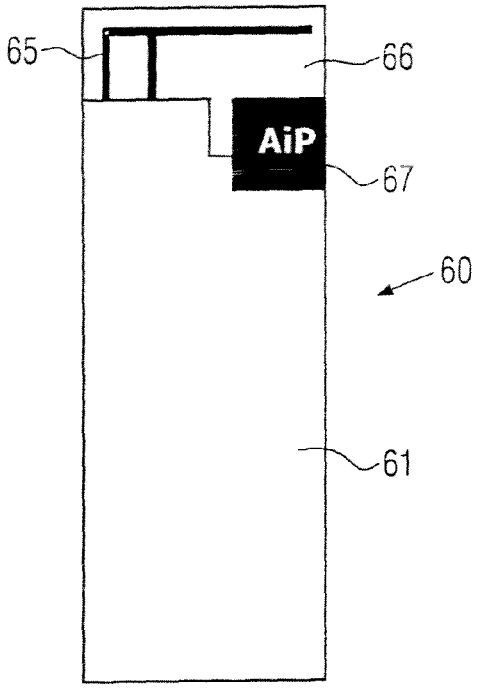
Figure 8C:
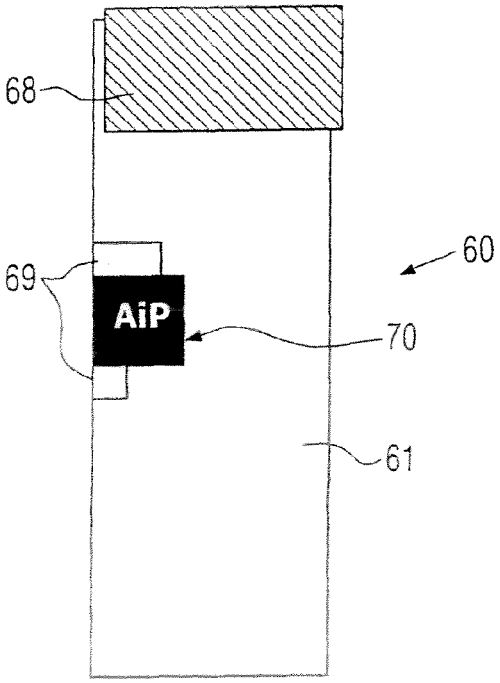
Figure 8D:
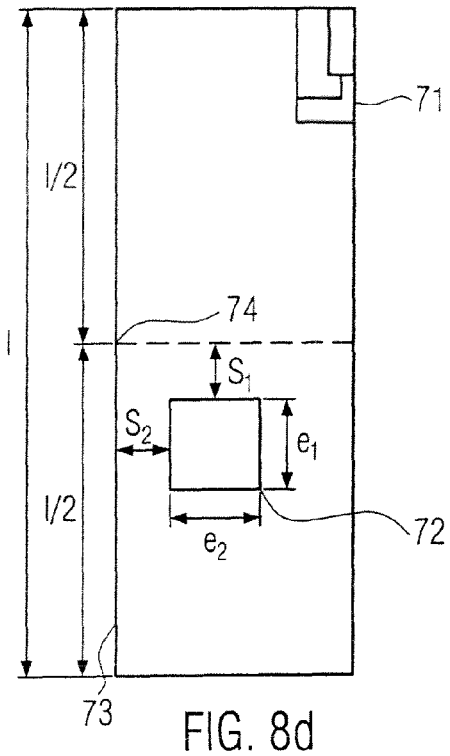

In FIG. 8*d* a PCB is shown with a first antenna 71 in the upper right corner and another antenna 72 provided on the PCB. The antenna 72 is close to the middle 74 of an edge 73 of the PCB. The edge 73 has a length l such that the middle of the edge is given at a distance ½ from the top or bottom edge. The antenna 72 has a rectangular outer shape or is inscribed in a rectangular area. The rectangle has an extension e1 in the vertical direction and e2 in the horizontal direction. In the vertical direction the antenna 72 is not farther away from the middle 74 than a separation s1 which is smaller than e1. In the horizontal direction the antenna 72 is not farther away than a separation s2 which is smaller than the extension e2 in that direction.

Figure 8E:
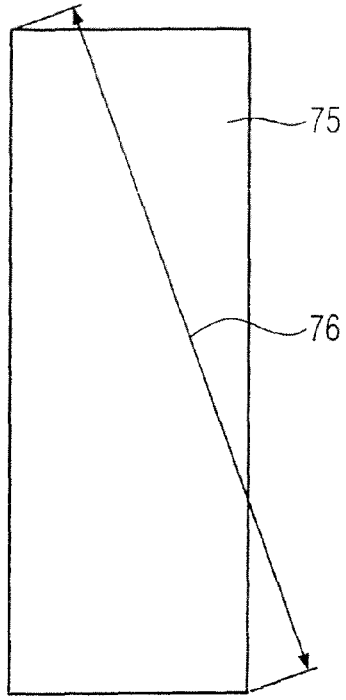

FIG. 8*e* shows the longest extension 76 of a PCB 75.

Figure 8F:
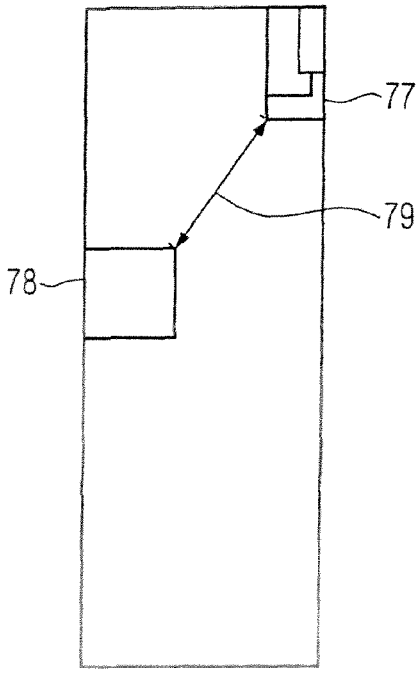

FIG. 8*f* shows the separation 79 between two antennas 77 and 78. The separation is given by the shortest distance between any antenna part such as a part of the slot of a slot antenna or the part of conductive portion of a monopole antenna or the like.

Another aspect of the invention relates to the technique to implement space diversity and/or polarization diversity in a wireless device combining at least two antennas, wherein at least one of the at least two antennas is an antenna integrated in a semiconductor package, as depicted in FIG. 8*a* to FIG. 8*c*. In those figures, the antenna-in-package (AiP) module 63, 67, 70 comprises an antenna and an electronic circuit (like for example and without limitation a semiconductor die) inside the same package. In some examples, the integration of the antenna inside the semiconductor will contribute to reduce the PCB area overhead (in terms of antenna footprint and antenna clearance from ground plane) of having that additional antenna on the wireless device to form part of the diversity system.

In some examples, the diversity system will comprise at least an antenna integrated in a semiconductor package, and at least another antenna that can be a monopole antenna, and IFA, a patch antenna or a PIFA.

FIG. 9 shows some implementations of the diversity system 80 for wireless devices comprising an antenna integrated in a semiconductor package that is mounted on the PCB of the device. In FIG. 9*a* the two antennas 82 and 81 are provided on the same edge of the PCB but on opposite corners of the edge. In FIG. 9*b* one antenna 83 is located close to the middle of the left edge of the PCB, which means close to the middle of one of the longer edges of the PCB. The other antenna 84 is provided in or on a corner of the opposite edge of the PCB.

In comparison to FIG. 9*b* in FIG. 9*c* the two antennas have been exchanged.

FIG. 10 shows an example of a diversity system 90 for a wireless device formed by two antennas 91, 92 in which one antenna is a slot antenna, and the other antenna is an antenna integrated in a semiconductor package mounted on the PCB 93 of the device.

In FIG. 11 an embodiment of a diversity system for a wireless device formed by two antennas in which the two antennas are slot antennas is shown. The two antennas are provided on or close to neighboring edges and are substantially parallel to their respective edges. Both are open at one end. They are oriented substantially orthogonal to each other. Both slot antennas are provided as slots in the ground plane but may nevertheless also be provided as slot antennas in package.

DESCRIPTION OF THE PREFERRED EMBODIMENTS

In some embodiments, the present invention is used to obtain a diversity system for a wireless device that exhibits good diversity gain and requires little PCB area overhead.

Embodiment 1:

In this embodiment (for instance, the one shown in FIG. 1), the wireless device with diversity system comprises a slot antenna 3 printed or etched on the ground plane of the PCB 4, and an antenna component (or chip antenna) 2 that can be mounted on the PCB 4 as an SMT component.

Embodiment 2:

This other embodiment, represented in FIG. 6, implements a diversity system for a wireless device combining a slot antenna 43 printed on the PCB 41 and a printed monopole antenna or IFA 42.

Embodiment 3:

In another example in FIG. 7, the diversity system of the wireless device comprises a first antenna 53 being a printed slot antenna, and a second antenna 52. The second antenna 52 is for operating not only in the same frequency band as the one of the first antenna 53, but also operating, at least, at some other frequency band used for mobile telephone systems. In some cases, the said second antenna 52 will be advantageously a monopole antenna, an IFA, a patch antenna, or a PIFA.

Embodiment 4:

A further embodiment of the wireless device with diversity system shown in FIG. 10 comprises a printed slot antenna 92, and an antenna integrated in a semiconductor package 91, wherein the package can be of any of the technologies and architectures used in the semiconductor industry. Some basic architectures are for example single-in-line (SIL), dual-in-line (DIL), dual-in-line with surface mount technology DIL-SMT, quad-flat-package (QFP), pin grid array (PGA) and ball grid array (BGA) and small outline packages. Other derivatives are for instance: plastic ball grid array (PBGA), ceramic ball grid array (CBGA), tape ball grid array (TBGA), super ball grid array (SBGA), micro ball grid array BGA® and leadframe packages or modules.

Embodiment 5:

In this example, see FIG. 8*a*, the wireless device with diversity system 60 comprises an antenna component 62 and an antenna integrated in a semiconductor package 63 mounted on the PCB 61. Region 64 on the PCB 61 constitutes the clearance region around the antennas (i.e., the region on the PCB 61 is free from ground plane).

Embodiment 6:

Another embodiment, in FIG. 8*c*, discloses a diversity system for a wireless device comprising a first antenna 70 being an antenna integrated in a semiconductor package, and a second antenna 68. The second antenna 68 operating not only in the same frequency band as the one of the first antenna 70, but also operating, at least, at some other frequency band used for mobile telephone systems. In some cases, the said second antenna 68 will be advantageously a monopole antenna, an IFA, a patch antenna, or a PIFA. Region 69 on the PCB 61 is the ground plane clearance region for the first antenna 70.

Embodiment 7:

In yet another embodiment as the one of FIG. 8*b*, the diversity system for a wireless device is implemented combining an antenna integrated in a semiconductor package 67 and a monopole antenna or IFA 65 printed on the PCB 61. Region 66 on the PCB 61 is free from ground plane (i.e., clearance region around the antennas).

Embodiment 8:

This embodiment, represented in FIG. 11, implements a diversity system 100 for a wireless device combining a first slot antenna 102 and a second slot antenna 103. The said first slot antenna 102 is oriented on the PCB 101 in such a way that excites a radiation mode on said PCB 101 responsible for radiation along a first polarization. The said second slot antenna 103 is oriented on the PCB 101 in such a way that it excites a radiation mode on said PCB 101 responsible for radiation along a second polarization, wherein the second polarization is substantially orthogonal to the said first polarization.

More Detailed Description of Slot-Antenna Component

Figure 12A:
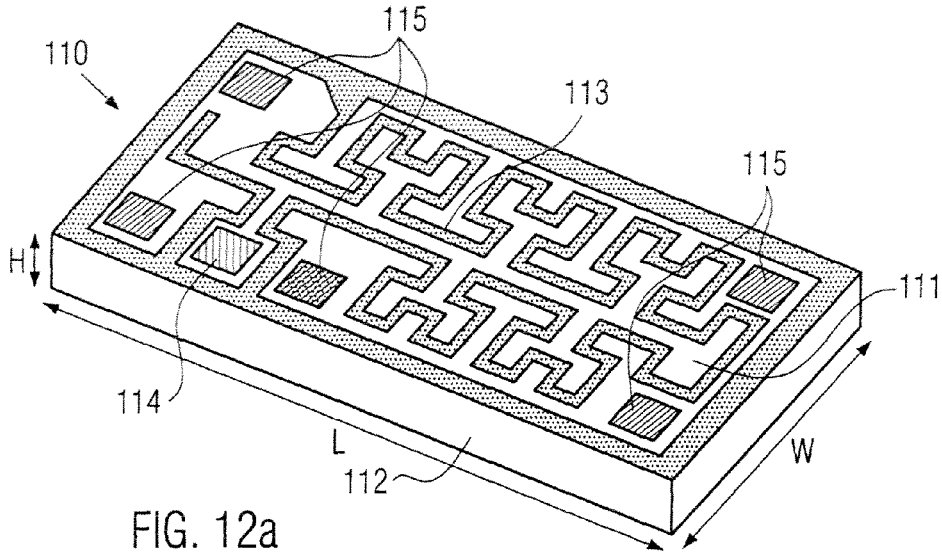
Figure 12B:
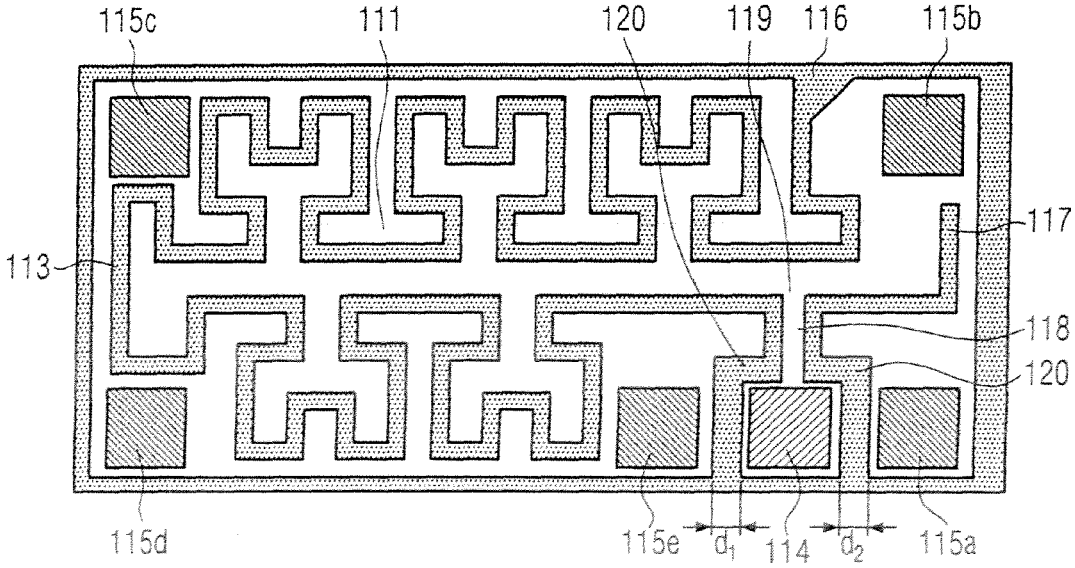

FIG. 12 shows an example of slot-antenna component 110 according to the present invention including a conductive surface 111 (see white area in gray or pointed area), in which a slot 113 has been created, a dielectric substrate 112, five grounding terminals 115 and feeding means comprising a feeding terminal 114. In FIG. 12*a* a perspective bottom view of the slot-antenna component (i.e., as seen from the side of the component facing the PCB on which it is to be mounted) is shown. FIG. 12*b* is a top view of the component (i.e., as seen from the side of the component not facing the PCB on which it is to be mounted) in which the dielectric substrate 112 has been removed to observe the slot 113 in the conductive surface 111 of the component 110 and the contact terminals 114, 115.

The conductive surface 111 is backed by a dielectric substrate 112. In this particular example of FIG. 12, and without limiting purposes, the contour of the slot 113 is inspired in the Hilbert curve; however, other shapes could also be used. In fact, the shape of the slot 113, and the length and width of each one of the segments that form said slot 113, can be selected to meet the requirements of resonance frequency, electrical performance, and maximum size, of a given SMT component.

In a preferred embodiment, the conductive surface 111 is covered by another dielectric layer (such as for example a layer of ink, or a layer of protective epoxy coating for environmental protection), in which some windows are left in order to create one or more contact terminals 114,115 of the component 110. In FIG. 12, the slot-antenna component 110 comprises one feeding terminal 114 and several grounding terminals 115*a* to 115*e*. The contact terminals 114,115 have been depicted as square pads, although they could be shaped differently, or take the form of pins or BGA balls.

All contact terminals 114, 115 are arranged on or close to the edge of the conductive surface 111 and at the same time on or close to the edge of antenna component 110.

Figure 13A:
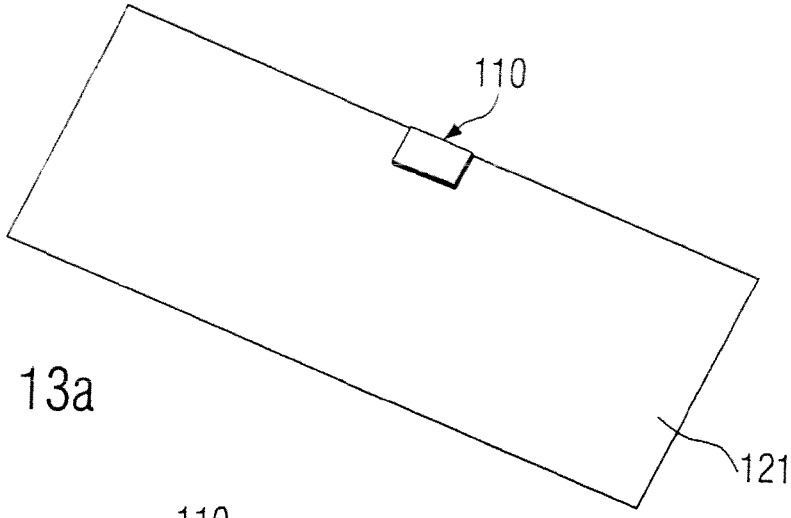
Figure 13B:
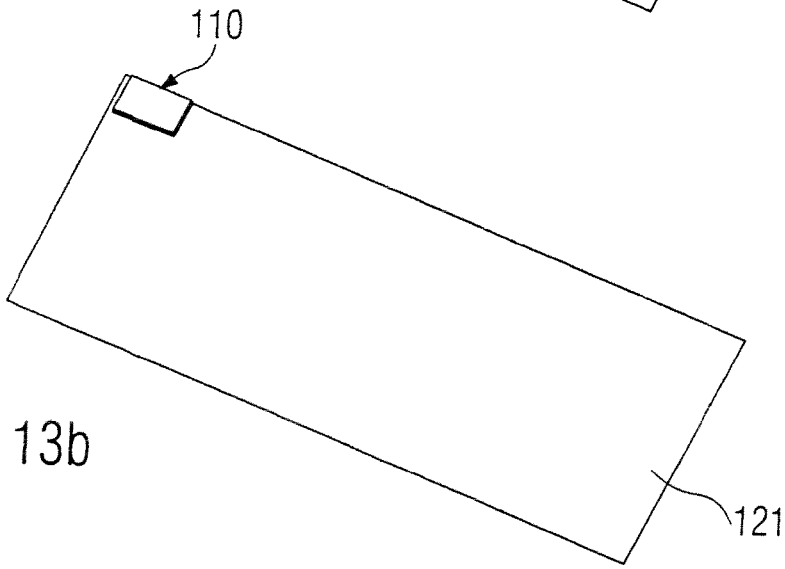
Figure 13C:
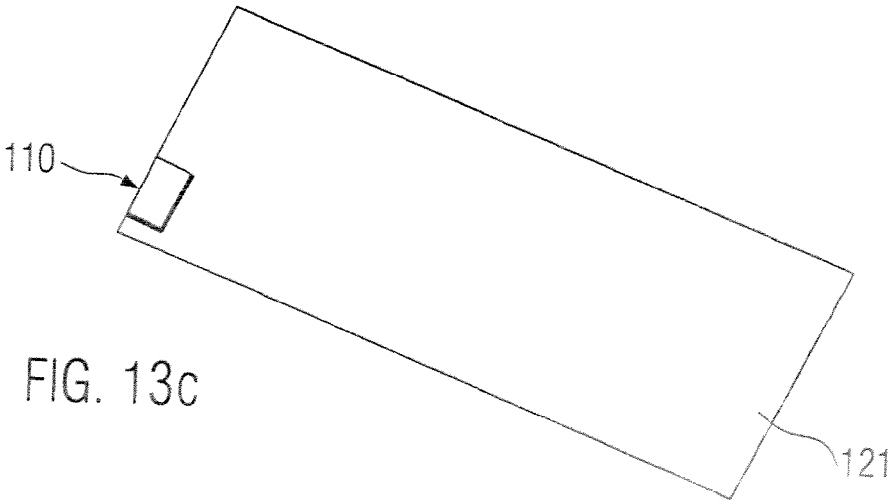

In FIG. 13 examples of how a slot-antenna component 110 can be placed on a substantially rectangular PCB 121 of a wireless (e.g. handheld or portable) device are shown. In FIG. 13*a* the longer dimension of the slot-antenna component 110 is aligned with one of the longer edges of the PCB 121, and substantially centered along said edge. FIG. 13*b* relates to the case where the longer dimension of the slot-antenna component 110 is aligned with one of the longer edges of the PCB 121, and substantially close to a corner of said edge and in FIG. 13*c* the longer dimension of the slot-antenna component 110 is aligned with one of the shorter edges of the PCB 121, and substantially close to a corner of said edge. It may also be centered along the short edge.

In FIG. 13*a* the component 110 has been mounted close to one of the long edges of a substantially rectangular PCB 121. In other cases, as in the example of FIG. 13*c*, the component 110 is mounted substantially close to a shorter edge of the PCB 121, and aligned with said shorter edge.

FIG. 14 provides a detailed view of the PCB of FIG. 13 magnifying the region in which the slot-antenna component 110 is mounted, and showing the ground plane clearance 132 in that region of the PCB and the footprint of the pads 134, 135 to accept the slot-component of FIG. 12.

The major region in FIG. 14 with the zig zag-style line indicates the ground plane 131 of the PCB 121. The outline of the component 110 on the PCB 121 is represented by means of rectangle 130 in dashed line. Inside rectangle 130, there is a region 132 in which there is a clearance of the ground plane 131. In other words, the ground plane 131 extends underneath the projection of the component 110 leaving a region of clearance 132 smaller than the size of the component 110.

Within the rectangle 130, there is the footprint of the accepting pads 135 for the grounding terminals 115. Inside rectangular region 130 there is also the accepting pad 134 for the feeding terminal 114. In a preferred embodiment, pad 134 is not connected to the ground plane of the PCB 131.

As can be seen in FIG. 14 the accepting pads 135 are formed in the shape of protrusions extending into the ground plane clearance 132. The accepting pad 134 is provided between two pads 135 which are provided just next to the side of the accepting pad 134. Four of the five accepting pads 135 are provided in the corners of the clearance 132.

Figure 15A:
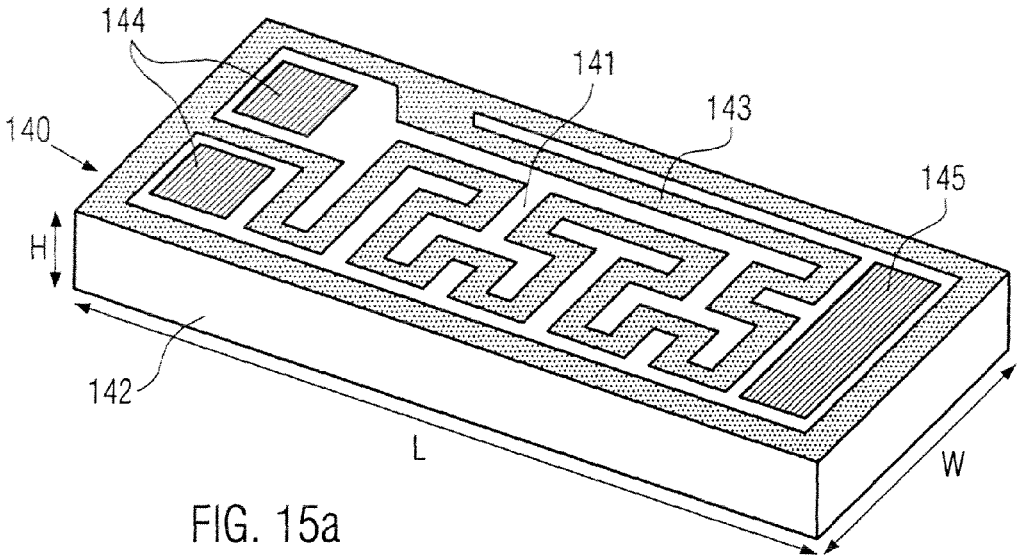
Figure 15B:
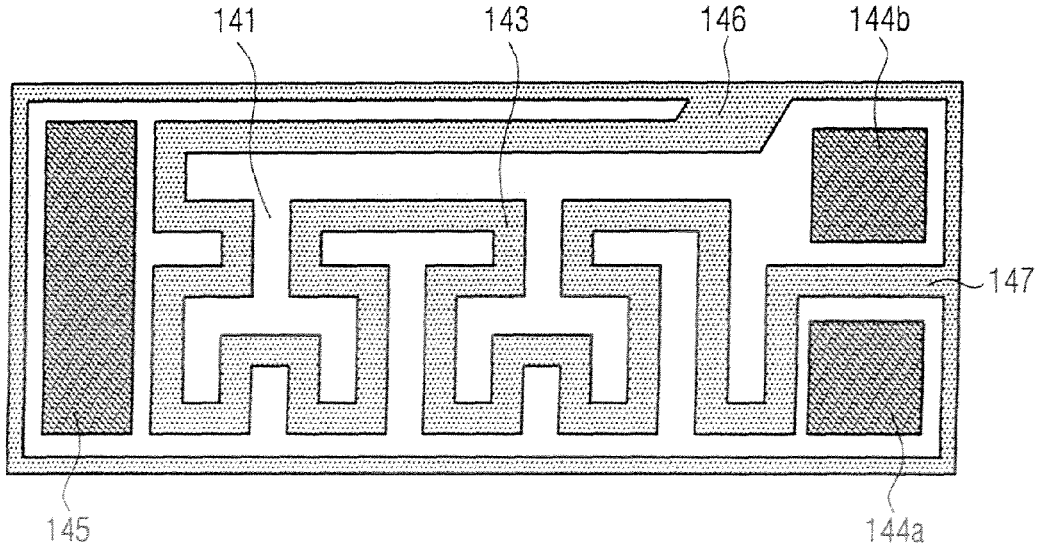

In FIG. 15 an example of a slot-antenna component 140 according to the present invention including a conductive surface 141 (see white area in gray or pointed area) in which a slot 143 has been created is shown. Further a dielectric substrate 142 with contact terminals 144, 145 for grounding purposes and contact terminals 144 to couple electrically said slot with a slot section printed or etched in the ground plane of a PCB are shown. FIG. 15*a* shows a perspective bottom view of the slot-antenna component 140 and FIG. 15*b* a top view of the component 140 in which the dielectric substrate 142 has been removed to observe the slot 143 in the conductive surface 141 of the component 140 and the contact terminals 144, 145.

The component 140 can also include other dielectric layers, such as for instance a cover ink layer. Again in this particular example, and without limiting purposes, the contour of the slot 143 is inspired by the Hilbert curve; however, other shapes (including periodic, irregular, or even random-like shapes) could also be used. In FIG. 15, the slot-antenna component 140 comprises three contact terminals: two of them 144 are used as feeding terminals and also as grounding terminals while the third contact terminal 145 is used as grounding terminal only. In this example, contact terminals 144 are shaped as being substantially square pads, while contact terminal 145 is shaped as being a rectangular pad, however, the contact terminals 144, 145 could have been shaped differently. The contact terminal 145 extends along more than 50% and in particular more than 90% of the length of the short edge of the conductive surface 141. A grounding terminal may also extend along more than a certain percentage of the length of a short or long edge of the component 140 or conductive surface 141.

The slot-antenna component 140 can be mounted in a similar way to the component 110 on a PCB 121 as the one shown in FIG. 13. However, the distribution of the ground plane on said PCB 121 is different.

Figure 16A:
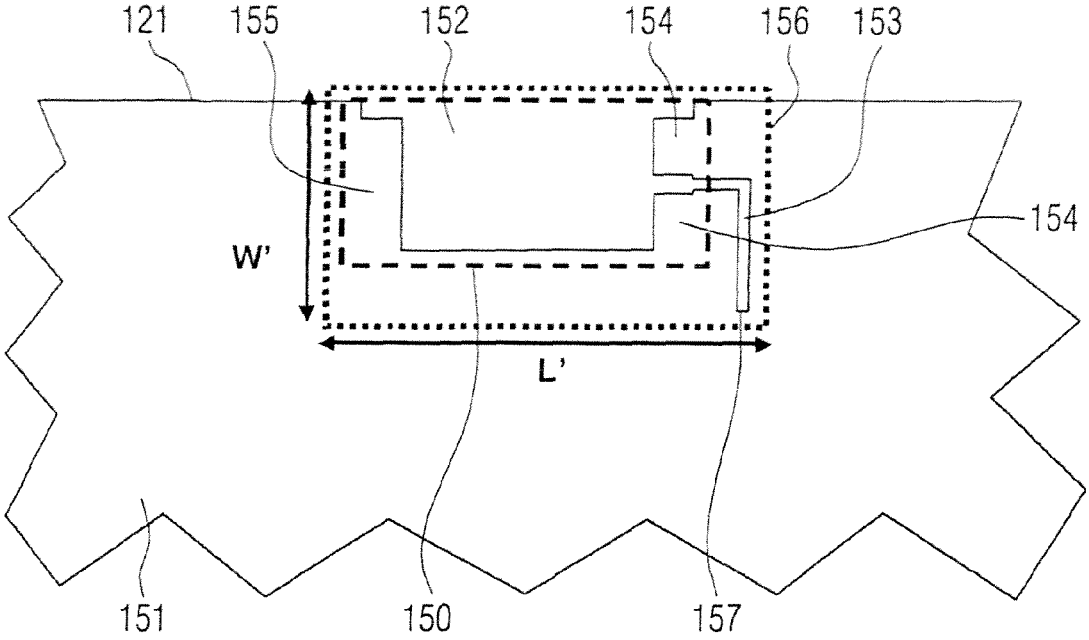
Figure 16B:
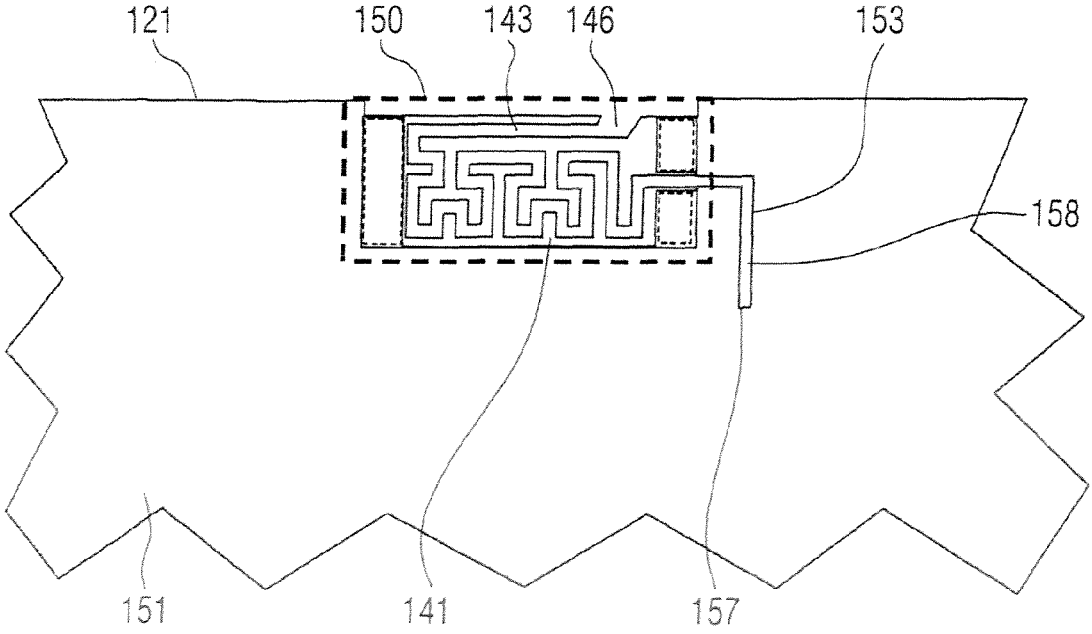

In FIG. 16 a detailed view of the PCB 121 of FIG. 13 is provided magnifying the region in which the slot-antenna component 140 of FIG. 15 is mounted. FIG. 16*a* shows the distribution of the ground plane 151 within the PCB, the ground plane clearance 152 in the projection of the slot-antenna component, the footprint of the pads 154, 155 to accept the slot-component of FIG. 15 and the slot section 153 printed or etched on the ground plane of said PCB. In FIG. 16*b* a view is provided showing the coupling of the slot 143 contained in the component 140 of FIG. 15 with the slot section 153 printed or etched on the ground plane 151 of the PCB to form a single slot antenna. This single slot antenna has a combined slot.

The ground plane 151 has a region of clearance 152 underneath the projection of the component 140, which is indicated by rectangle 150 in dashed line. The ground plane 151 extends partially underneath the projection of the component 140 within the rectangular region 150. Inside said region 150 there is the footprint of the accepting pads 154, 155 for the contact terminals of the component 144, 145. The ground plane 151 further comprises a slot section 153 that is connected to the accepting pads 154.

FIG. 16*b* is the same detailed view of the ground plane of the PCB 151 as in FIG. 16*a*, but in which the conductive surface 141 of the component 140 has been added to visualize how the slot 143 is completed by the slot section 153 printed or etched on the ground plane 151, forming a slot antenna. The contact terminals 144 are advantageously used to couple an electrical signal that excites the slot section 153 into the component 140 to excite the slot 143 contained in said component 140. For such a combined slot it is, however, also possible to excite the slot 143 in the component 140 by further feeding terminals such that the electrical signal is provided from the excited slot 143 to the slot section 153 through the contact terminals 144 and the accepting pads 154.

In some embodiments it will be preferred not to have electronic components or modules mounted on the PCB 121 and connected to its ground plane 151, if they are in the projection of the slot section 153.

Figure 17A:
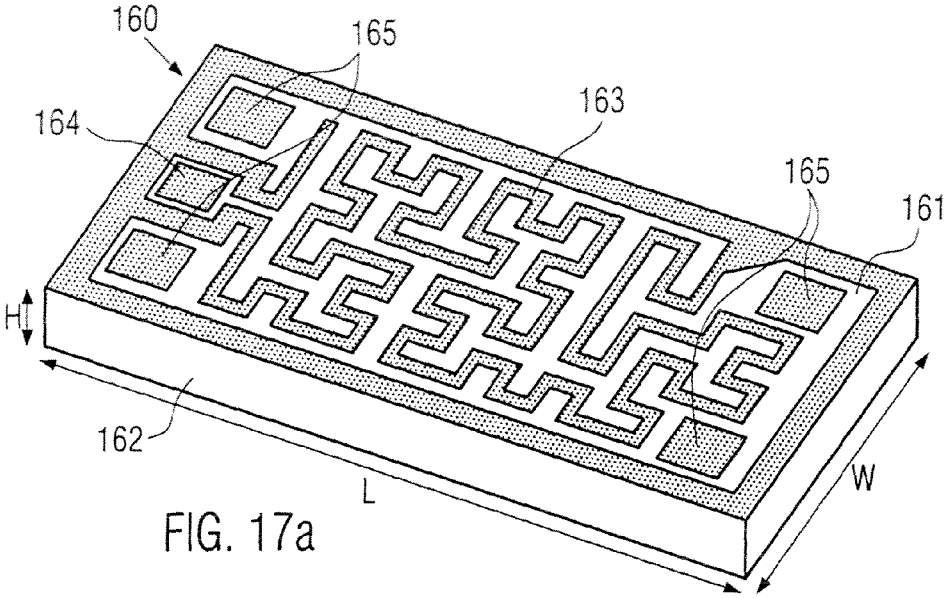
Figure 17B:
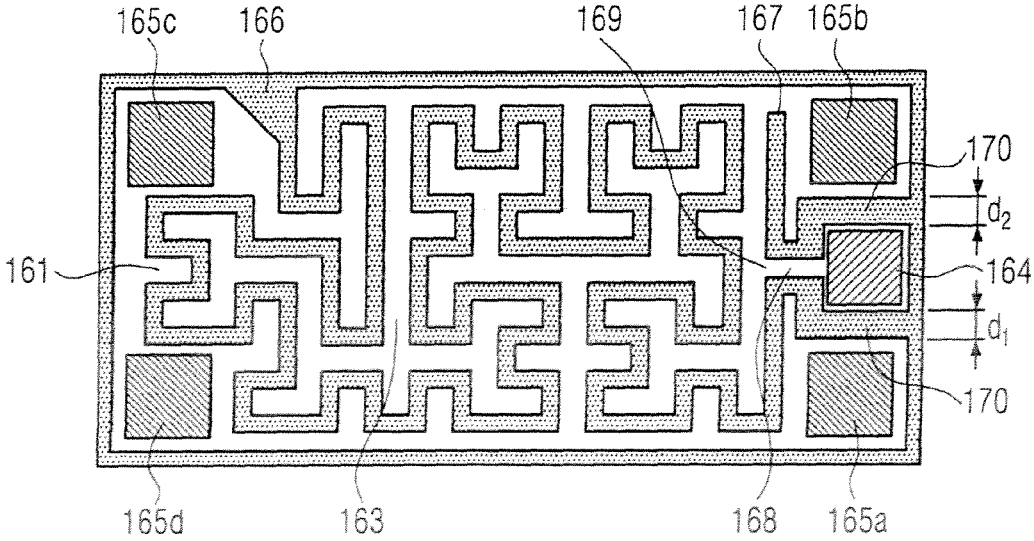

In FIG. 17 an example of a slot-antenna component 160 according to the present invention is shown which includes a conductive surface 161, in which a slot 163 has been created, a dielectric substrate 162, four grounding terminals 165 and feeding means comprising a feeding terminal 164. Here FIG. 17*a* shows a perspective bottom view of the slot-antenna component 160 and FIG. 17*b* a top view of the component 160 in which the dielectric substrate 162 has been removed to observe the slot 163 in the conductive surface 161 of the component 160 and the contact terminals 164, 165.

The slot-antenna component 160 of FIG. 17 has a feeding terminal 164 provided on or close to a short edge of the conducting surface 161 or the component 160.

In the embodiment of FIG. 17 the component 160 comprises four grounding terminals 165 and a feeding terminal 164. As it can be observed in FIG. 17*b*, a grounding terminal 165 is located close to each one of the four corners of the component 160. The feeding terminal 164 is located on the right-hand-side (short edge) of said component 160 between two grounding terminals 165*a* and 165*b*. Such an embodiment is advantageous as it reduces the count of grounding terminals 165 compared to the embodiment in FIG. 12, yet achieving the same grounding effect.

Another aspect of the invention refers to the feeding means used to excite the slot 113, 143, 163, 204 included in the SMT component 110, 140, 160, 200.

A slot-antenna component can be excited in an unbalanced mode or in a balanced mode. When a slot-antenna component is excited in an unbalanced manner, an unbalanced voltage is applied to the two opposite edges of the slot created in a conductive surface of the component, or to the two opposite edges of a slot section created in the ground plane of the PCB. A first edge is connected to a positive potential (referenced to a ground potential) and a second edge is connected to said ground potential. When a slot-antenna component is excited in a balanced manner, a balanced voltage is applied to the two opposite edges of the slot created in a conductive surface of the component, or to the two opposite edges of a slot section created in the ground plane of the PCB. A first edge is connected to a positive potential (referenced to a ground potential) and a second edge is connected to a negative potential (referenced to a ground potential) of the substantially same amplitude as said positive potential.

In some embodiments, such as for instance but not limited to the examples of FIGS. 12 and 17, the feeding means of the slot-antenna component 110, 160 comprise a feeding contact 114, 164 and a conductive strip 118, 168. Said conductive strip 118, 168 can be advantageously printed or etched on the same conductive surface 111, 161 as the slot 113, 163, thus making the feeding means coplanar with the slot 113, 163. The conductive strip 118, 168 connects the feeding terminal 114, 164 with the edge of slot 113, 163 that is farther from the contact terminal 114, 164 in region 119, 169 along the slot 113, 163. In the examples of FIGS. 12 and 17 the connection of the conductive strip 118, 168 with the edge of slot 113, 163 that is farther from the contact terminal 114, 164 occurs at a substantially right angle (i.e., an angle of approximately 90°), however said connection could also occur at angles smaller or larger than 90°.

In said region 119, 169, the edge of the slot 113, 163 that is closer to the feeding terminal 114, 164 is interrupted, so that the conductive strip 118, 168 can cross the slot 113, 163 reaching the farther edge of said slot 113, 163. A clearance region 120, 170 is created at both sides of the conductive strip 118, 168 and the feeding terminal 114, 164. The width of the clearance region 120, 170 does not need to be necessarily the same on both sides of the conductive strip 118, 168 and the feeding terminal 114, 164 ($d_1$ and $d_2$ do not need to be the same), although in some embodiments $d_1$ and $d_2$ will be substantially equal. The input impedance of the slot antenna can be appropriately selected by means of the distance of the region 119, 169 to an end of slot 117, 167, the width of the conductive strip 118, 168 and the widths $d_1$ and $d_2$ of the clearance region 120, 170 on each side of the conductive strip 118, 168 and the feeding terminal 114, 164.

In certain examples, the widths $d_1$ and $d_2$ will be substantially equal. In some cases, the width of the conductive strip 118, 168 and the widths $d_1$ and $d_2$ can be advantageously selected as to form a coplanar transmission line. The width of the conductive strip 118, 168 and the widths $d_1$ and $d_2$ will be preferably smaller than a maximum width. Some possible values for said maximum width comprise $1/2400$, $1/1200$, $1/800$, $1/600$, $1/480$, $1/400$, $1/300$, $1/240$, $1/200$, $1/150$ and $1/120$ of a free-space operating wavelength of the slot antenna.

In some cases, it will be advantageous to place a grounding terminal 115*e*, 115*a*, 165*a*, 165*b* at each side of the feeding terminal 114, 164. In other examples, the feeding terminal 114, 164 might not be coplanar with the slot 113, 163, making it necessary to couple a feeding signal from the feeding terminal 114, 164 to the conductive strip 118, 168 either by direct contact (such as for instance by means of a via hole), or by electromagnetic coupling (either capacitive or inductive). Capacitive (or inductive) coupling can be preferred in some cases to compensate for an inductive (or capacitive) component of the input impedance of the slot antenna, without having to use external circuit elements such as capacitors or inductors.

FIGS. 12 and 17 show two examples of slot-antenna components 110, 160 in which the slot antenna is excited in an unbalanced manner. In some other examples, a slot-antenna component could be excited in a balanced manner by including a first feeding terminal to provide a positive potential (referenced to a ground potential) and a second feeding terminal to provide a negative potential (referenced to said ground potential). In some cases, the component can also include a third feeding terminal to provide said ground potential.

In other embodiments, such as for instance but not limited to the example of FIG. 15, the feeding means of the slot-antenna component 140 comprises two contact terminals 144*a*, 144*b* that are used for feeding purposes of slot 143 created in the conductive surface 141 inside the component 140. The said contact terminals 144*a*, 144*b* couple the electric signal that excites the slot section 153 printed or etched on the ground plane of the PCB 151 with the slot 143. The slot antenna formed by the combination of the slot 143 and the slot section 153 can be excited by means of a balanced or an unbalanced electrical signal applied at a point 158 (see FIG. 18) along said slot section 153.

FIG. 18 provides examples of how a slot antenna formed by the combination of the slot-antenna component of FIG. 15 and the slot section on the PCB of FIG. 16 can be excited with an RF feeding signal.

Figure 18A:
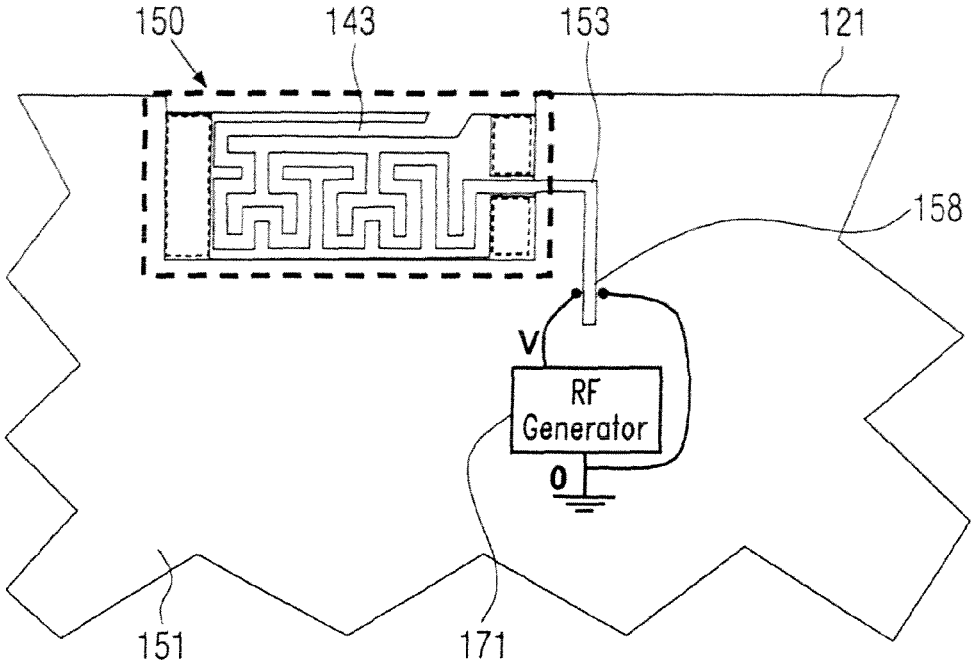

FIG. 18*a* shows an example of unbalanced feeding of the slot antenna. An RF generator 171 provides a positive potential V (referenced to a ground potential 0). Said positive potential V is applied to the left-hand-side edge of the slot section 153 in region 158. Said reference ground potential 0 is then applied to the opposite edge (the right-hand-side edge in this example) of the slot section 153 in region 158.

Figure 18B:
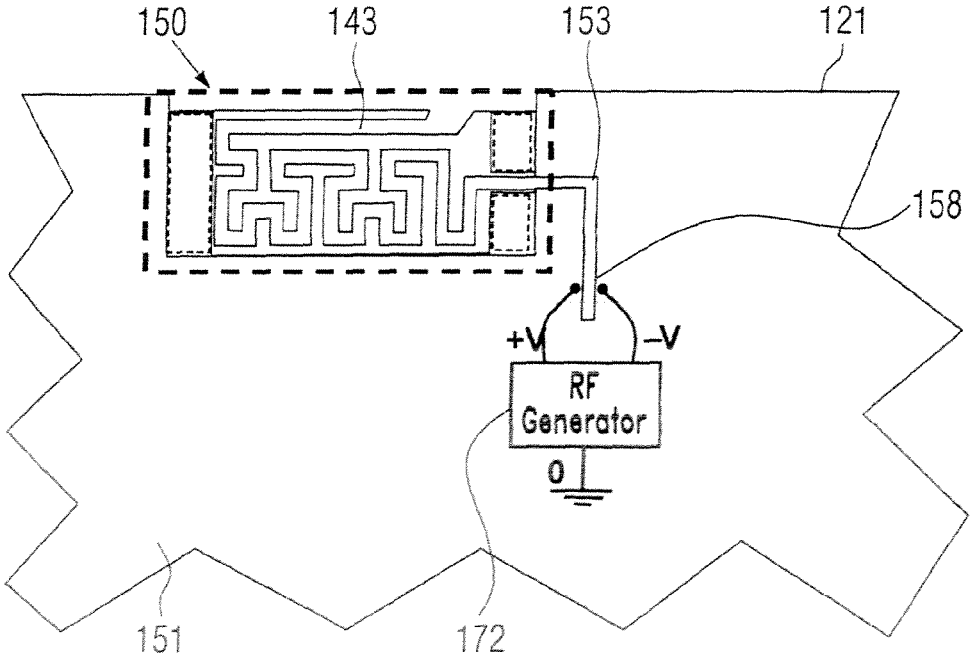

FIG. 18*b* shows an example of balanced feeding of the slot antenna. An RF generator 172 provides a positive potential +V (referenced to a ground potential 0) and a negative potential −V (referenced to the same ground potential 0), with approximately the same amplitude as said positive potential +V. Said positive potential +V is applied to the left-hand-side edge of the slot section 153 in region 158, while said negative potential −V is applied to the right-hand-side edge of the slot section 153 in region 158.

Figure 19A:
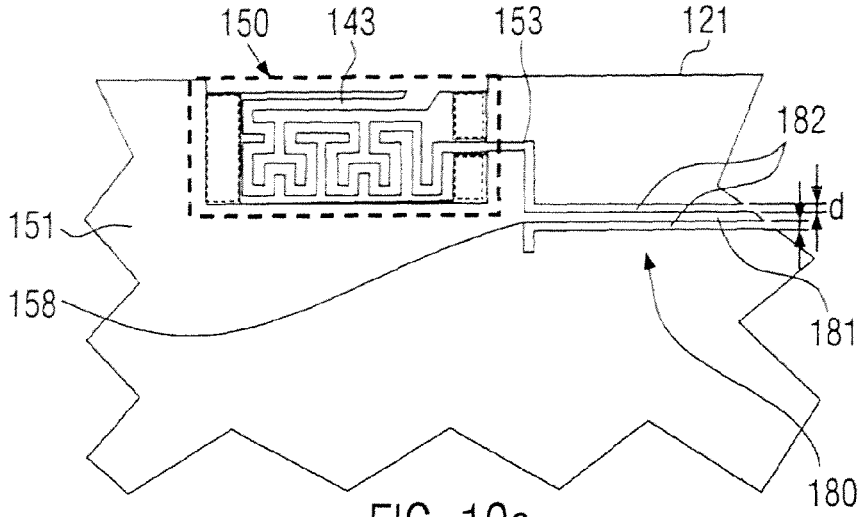
Figure 19B:
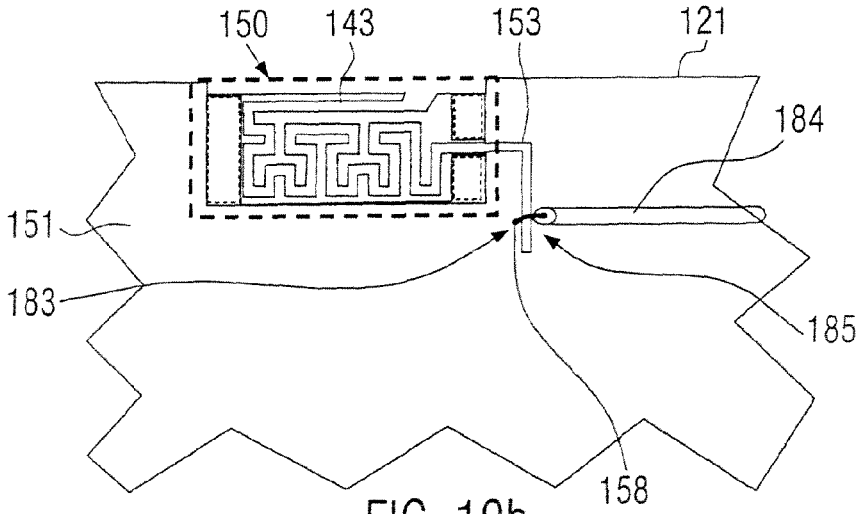
Figure 19C:
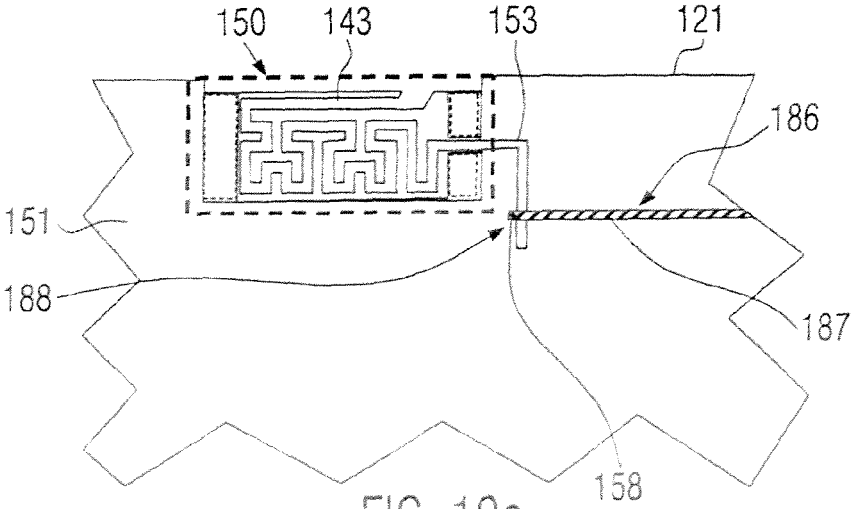

FIG. 19 provides examples showing how a slot antenna formed by the combination of the slot-antenna component 140 of FIG. 15 and the slot section 153 on the PCB of FIG. 16 can be excited in an unbalanced manner by coupling an electrical signal from an unbalanced transmission line with a coplanar transmission line (FIG. 19*a*), a coaxial transmission line (FIG. 19*b*) or a microstrip transmission line (FIG. 19*c*).

FIG. 19 represents different examples in which a slot antenna formed by the combination of the slot 143 contained in the component 140 and the slot section 153 printed or etched on the ground plane of the PCB 151 is excited in an unbalanced manner.

In the case of FIG. 19*a*, a coplanar transmission line 180 is created in the ground plane 151 of the PCB 121. Said coplanar transmission line 180 comprises a central conductive strip 181 and a region of clearance of ground plane 182 to each side of the conductive strip 181. The coplanar transmission line 181 excites the slot section 153 in region 158. In said region 158 one edge of the slot section 153 is interrupted, so that the conductive strip 181 can cross the slot section 153 reaching the opposite edge of said slot section 153. The width of the conductive strip 181 and the width d of the clearance region 182 on each side of the conductive strip 181 can be selected to provide a coplanar transmission line with the appropriate characteristic impedance required in each application.

The example in FIG. 19*b* shows coaxial transmission line 184 being used to excite the slot antenna. The core 183 of the coaxial transmission line 184 contacts an edge of the slot section 153 in region 158, while the outer conductor of the coaxial transmission line 185 contacts the opposite edge of the slot section 153 in region 185.

A further example is provided in FIG. 19*c*, in which a microstrip transmission line 186 is used. The microstrip transmission line 186 comprises a conductive strip 187 placed substantially parallel above the ground plane of the PCB 151 on which the slot section 153 is printed or etched. Said strip 187 crosses above the slot section 153 in region 158. A via hole 188 at the end of the conductive strip 187 is used to connect said conductive strip 187 with the last edge of the slot section 153 crossed by the conductive strip 187.

Examples of slot-antenna components comprising more than one conductive surfaces are shown in FIG. 20. Here in the conductive surfaces a slot, or a portion of slot, has been created. FIG. 20*a* provides an example of a slot-antenna component 190 comprising a first conducting surface 191 containing a first slot portion 193, and a second conducting surface 192 containing a second and a third slot portions 194, 195. The first conductive surface 191 is connected to the second conductive surface 192 by means of via holes 196, 197, 198, 199 to combine all the slot portions 193, 194, 195 into a single slot antenna. In FIG. 20*b* the same items as in FIG. 20*a* are shown, however the first and second conductive surfaces 191 and 192 are spaced apart in order to visualize more clearly the different slots and surfaces.

Figure 20A:
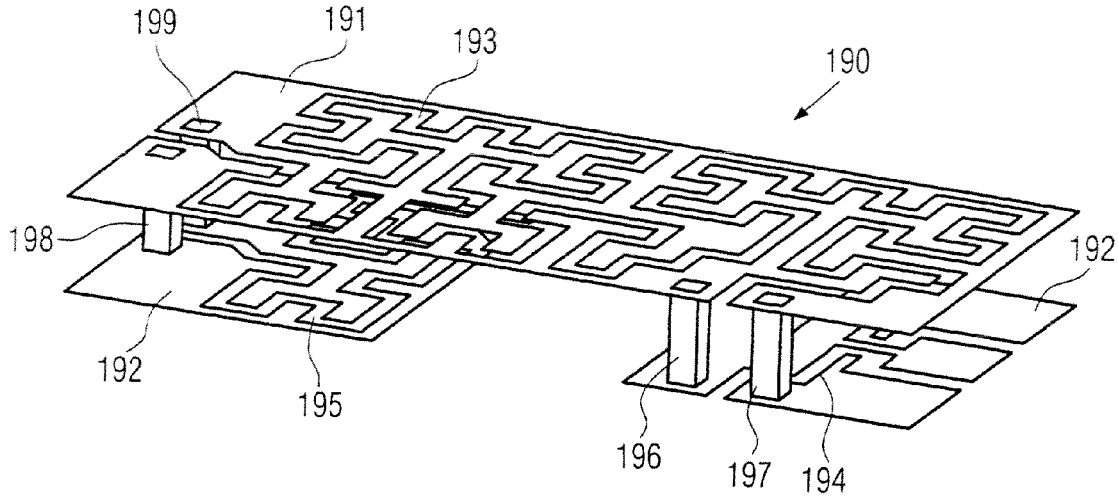
Figure 20B:
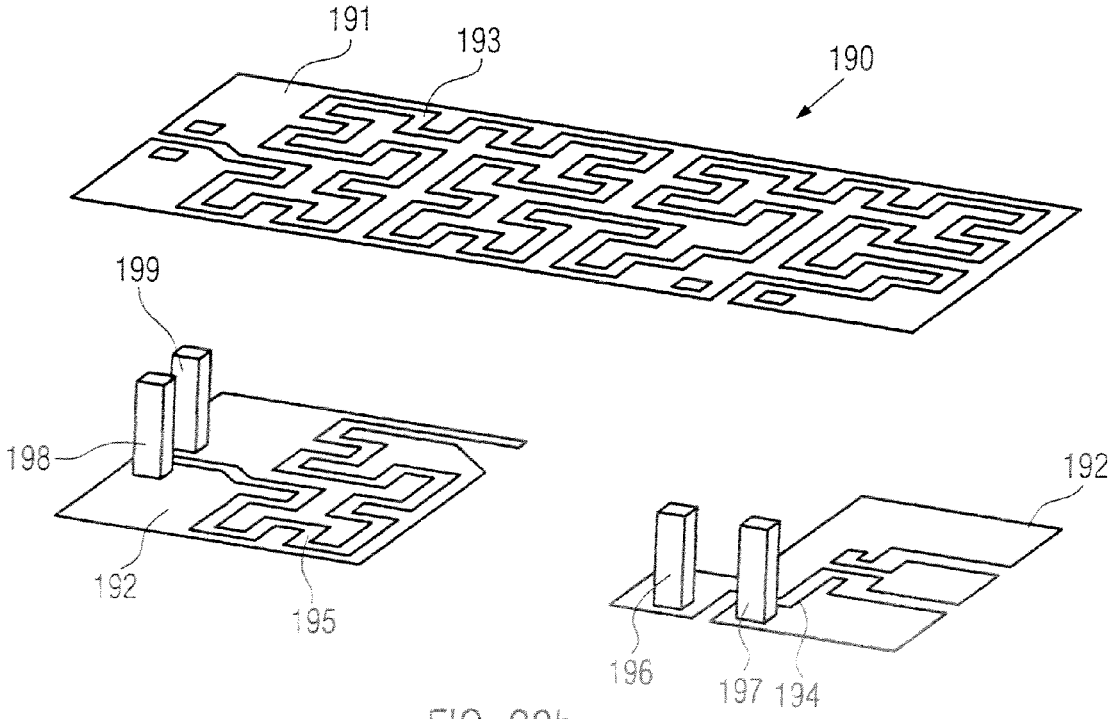
Figure 20C:
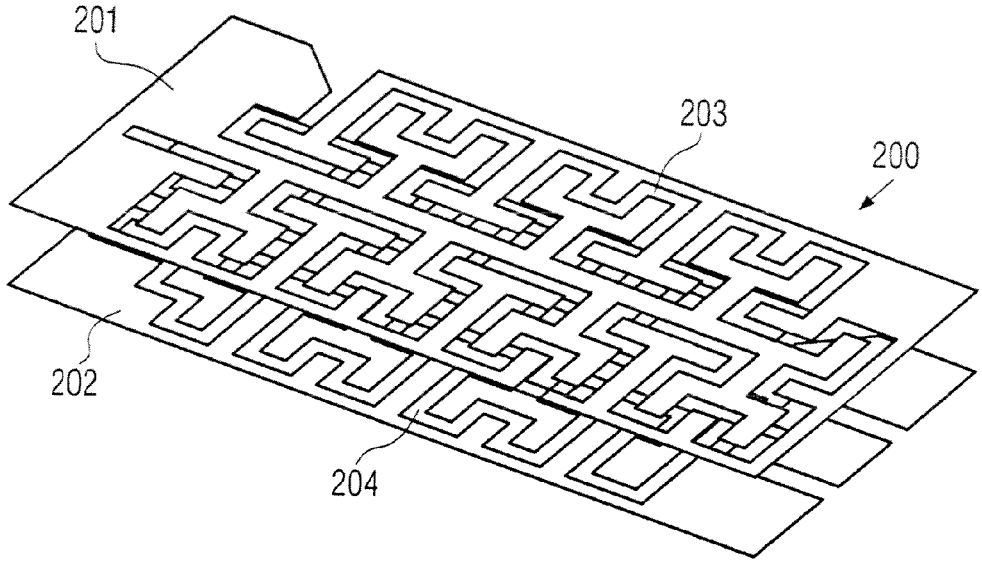

FIG. 20*c* shows an example of a slot-antenna component 200 comprising a first conducting surface 201 containing a first slot portion 203, and a second conducting surface 202 containing a second slot portion 204, wherein there is no electrical connection between the said first and second conductive surfaces 201, 202, so that one slot portion acts as a parasitic element.

Figure 20D:
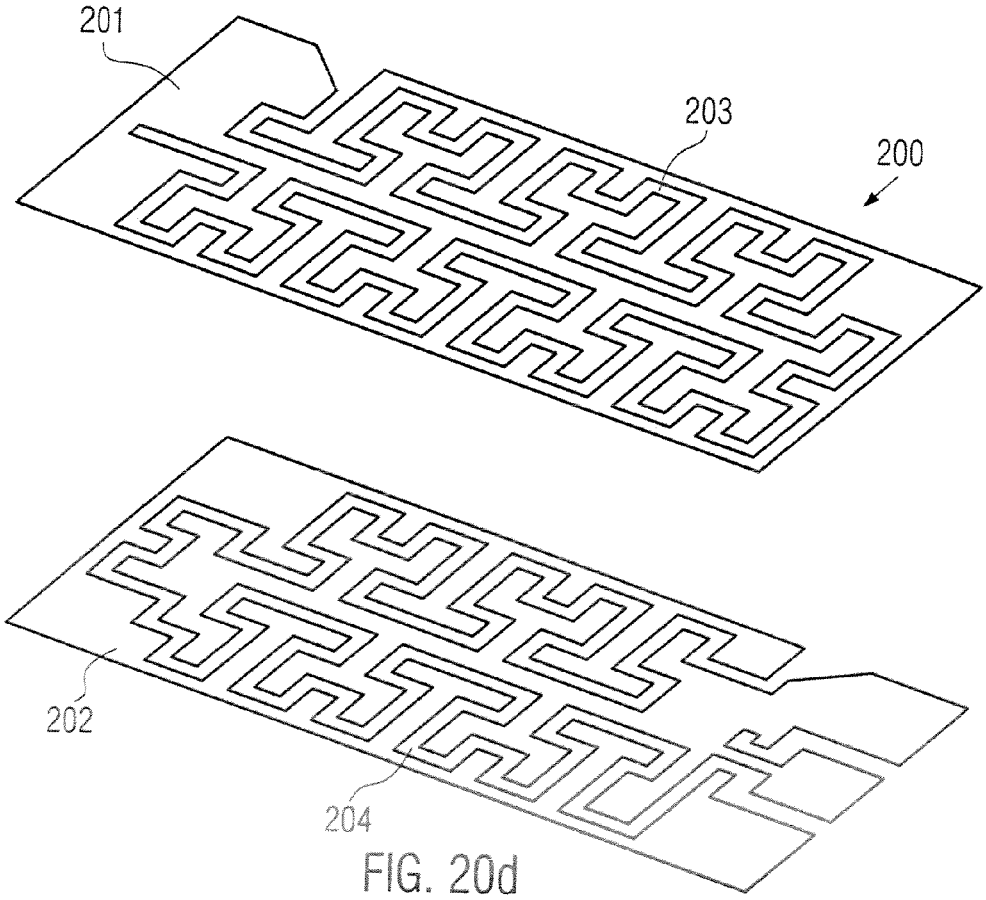

In FIG. 20*d* the two surfaces 201 and 202 are more separated in order to visualize the details of the two surfaces more clearly.

As mentioned above in some other embodiments, a slot-antenna component may comprise more than one conductive surface in which a slot is created. For instance, FIG. 20*a* shows a perspective top view of an example in which a slot-antenna component 190 comprises a first conductive surface 191 on the upper side of a dielectric substrate (not shown in FIG. 20*a*), and a second conductive surface 192 on the bottom side of said dielectric substrate. In this example, and without any limiting purpose, a first slot portion 193 is created in the first conductive surface 191, while a second slot portion 194 and a third slot portion 195 are contained in the second conductive surface 192. The first slot portion 193 is connected to the second slot portion 194 by means of two via holes 196, 197, and to the third slot portion 195 by means of other two via holes 198, 199. The via hole pairs 196, 197 and 198, 199 behave as the two edges of a vertical slot segment that allow to couple the electrical signal from one slot portion in a conductive surface to another slot portion in a different conductive surface, forming a single slot antenna. The second conductive surface 192 comprises one feeding terminal and four grounding terminals arranged in a similar way as in the example of FIG. 17.

As can be seen in FIG. 20 a slot longer than the one of e.g. FIG. 17 can be provided, however without increasing the required footprint area on the PCB due to the multiple surfaces of the antenna component.

In other cases it can be advantageous not to have electrical continuity between a slot portion created in a first conducting surface and another slot portion created in a second conductive surface, having thus an electrically driven slot portion and a parasitic slot portion. FIG. 20*c* and FIG. 20*d* represent a slot-antenna component 200 comprising a first conductive surface 201 on the upper side of a dielectric substrate (not shown in FIG. 20*c*), and a second conductive surface 202 on the bottom side of said dielectric substrate. Said first conductive surface 201 includes a first slot portion 203, while said second conductive surface 202 includes a second slot portion 204. Said first and second slot portions 203, 204 are not in electrical contact. The second conductive surface 202 comprises feeding means to feed said second slot portion 204, and also four grounding terminals arranged in a similar way as in the example of FIG. 17. Thus, the first slot portion 203 acts as a parasitic element.

An example of a wireless (e.g. handheld or portable) device comprising two slot-antenna components arranged on the PCB of said device is shown in FIG. 21. The two slot-antenna components are oriented along substantially orthogonal directions in order to have a slot antenna radiating with a polarization substantially orthogonal to the polarization of the other slot antenna.

FIG. 21 represents a wireless handheld or portable device 210 that comprises a first slot-antenna component 211 and a second slot-antenna component 212 mounted on a substantially rectangular PCB 213. The first slot-antenna component 211 is mounted substantially close to the top edge of the PCB 213 in such a way that the longer dimension of said first component 211 is substantially aligned with the top longer edge of the PCB 213. The second slot-antenna component 212 is placed substantially close to the left edge of the PCB 213 in such a way that the longer dimension of said second component 212 is substantially aligned with the left shorter edge of the PCB 213. In other words, the longer dimension of the first slot-antenna component 211 and that of the second slot-antenna component 212 are aligned along substantially orthogonal directions, which is advantageous in some embodiments in order to excite in the first slot-antenna component 211 a resonant mode substantially orthogonal to the resonant mode of the second slot-antenna component 212. Such an arrangement of a first slot-antenna component 211 and a second slot-antenna component 212 can be advantageously used to increase the isolation between two antennas in a wireless handheld or portable device and/or to implement an antenna diversity system.

In some embodiments the slot-antenna component 110, 140, 160, 190, 200 has advantageously a rectangular shape, while in others it is substantially square. In certain cases, the length L of the component 110, 140, 160, 190, 200 divided by a free-space operating wavelength of the slot antenna will be preferably smaller than, or approximately equal to, at least one of the following fractions: $1/5$, $1/8$, $1/10$, $1/12$, $1/13$, $1/14$, $1/15$, $1/16$, $1/18$ or $1/20$. In the same way, for some embodiments the width W of the component 110, 140, 160, 190, 200 divided by a free-space operating wavelength of the slot antenna will be smaller than, or approximately equal to, at least one of the following fractions: $1/10$, $1/15$, $1/18$, $1/20$, $1/21$, $1/22$, $1/23$, $1/24$, $1/25$ or $1/30$. In some other instances, it will be advantageous that the sum of the length L and the width W of the slot-antenna component 110, 140, 160, 190, 200 be smaller than ½ of the free-space operating wavelength, or even smaller than ¼ of the free-space operating wavelength. As far as height H is concerned, the slot-antenna component 110, 140, 160, 190, 200 features very low profile. In some instances the height H of the component 110, 140, 160, 190, 200 is less than a fortieth ($1/40$), a sixtieth ($1/60$) or even a one hundred twentieth ($1/120$) of a free-space operating wavelength of the slot antenna.

In some embodiments according to the present invention which comprise a slot 143 included in a component 140 and a slot section 153 printed or etched in the ground plane of a PCB 151, the unfolded length of the slot section 153 will be less than 50%, 40%, 30%, 25%, 20%, 18%, 16%, 14%, 12%, 10% or even 5% of the unfolded length of the combination of the slot 143 and the slot section 153.

Moreover, in some cases it will be advantageous that a slot-antenna component 140 together with a slot section 153 printed or etched on the ground plane of the PCB 151 fit within a rectangular area 156 (indicated in dotted line in FIG. 16*a*) of length L' and width W', wherein the sum of L' and W' is less than, or approximately equal to, 25%, 22.5%, 20%, 17.5%, 15%, 12.5%, or even 10% of a free-space operating wavelength of the slot antenna.

In the example of FIG. 12, the slot 113 has a first end 116 that intersects the perimeter of the conductive surface 111.

That is, the slot 113 is open-ended at said first end 116. Furthermore, the slot 113 has a second end 117 that does not intersect the perimeter of the conductive surface 111 (i.e., it is closed-ended).

In the case of FIG. 15, the slot 143 features a first end 146 and a second end 147 both intersecting the perimeter of the conducting surface 141. While said first end 146 is open-ended, the second end 147 is coupled to the slot section 153 of the ground plane of the PCB 151, as it can be seen in FIG. 16. The slot section 153 printed or etched on the ground plane 151 comprises a closed end 157. Therefore, the combination of the slot 143 with the slot section 153 forms a slot antenna with an open end 146 and a closed end 157.

In some preferred cases, the unfolded length of the slot antenna formed by a slot 113, 163 or by the combination of a slot 143 and a slot section on the ground plane of the PCB 153, will be approximately a quarter of an operating wavelength of the slot antenna. In some other cases, the unfolded length of the slot 113, 163, or the combination of the slot 143 and the slot section on the ground plane of the PCB 153, will be approximately three times, or approximately five times, or approximately another odd integer number of times, the length of one quarter of an operating wavelength of the slot antenna.

In other embodiments, a first end 116, 166 and a second end 117, 167 of the slot 113, 163 might both intersect the perimeter of the conductive layer 111, 161 of the slot-antenna component 110, 160. Yet in some other embodiments, both the first end 116, 166 and the second end 117, 167 of the slot 113, 163 might be closed-ended. In other embodiments, a first end 146 of the slot 143 intersects the perimeter of the conductive layer 141 of the slot-antenna component 140, while at the same time the end 157 of the slot section 153 intersects the perimeter of the ground plane 151.

In some embodiments in which a first end 116, 146, 166 and a second end 117, 167, or the end of slot section 157, are either both open-ended or both closed-ended, it might be advantageous that the unfolded length of the slot antenna formed by a slot 113, 163, or by the combination of a slot 143 and a slot section on the ground plane of the PCB 153, be approximately twice, or approximately four times, or approximately another even integer number of times, the length of one quarter of an operating wavelength of the slot antenna.

In some other embodiments, an open end of the slot 116, 146, 166 included in the slot-antenna component 110, 140, 160 can be coupled to a slot section printed or etched on the ground plane of a PCB. In that case, a slot-antenna component 110, 140, 160 should include an additional contact terminal on each edge of the slot 113, 143, 163 near said open end 116, 146, 166 to allow the coupling of an electrical signal from the slot 113, 143, 163 to a slot section created in the ground plane of the PCB. For example, in the embodiments of FIGS. 12 and 17, a slot antenna would be formed by the combination of the slot 113, 163 included in the component 110, 160, and a slot section created in the ground plane of the PCB and coupled to the open-ended end 116, 166. Similarly, in the example of FIG. 15 a slot antenna would be formed by the combination of the slot section 153 printed or etched in the ground plane of the PCB 151, the slot 143 included in the component 140, and an additional slot section created also in the ground plane of the PCB and coupled to the open end of the slot 146.

The shape of a slot 113, 143, 163, 193, 194, 195, 203, 204 inside a slot-antenna component 110, 140, 160, 190, 200 and/or a slot section on the PCB 153 can comprise straight and curved segments, not necessarily all segments being of the same length. In the same way, the separation between the conductive edges of each segment of the slot 113, 143, 163, 193, 194, 195, 203, 204, and/or a slot section on the PCB 153, does not have to be the same for all segments, nor constant for any given segment (i.e., any segment of the slot 113, 143, 163, 193, 194, 195, 203, 204 or the slot section on the PCB 153 can be tapered).

Furthermore, it will be advantageous in some cases that the separation between the two edges of a slot 113, 143, 163, 193, 194, 195, 203, 204 and/or a slot section on the PCB 153 be within a range from approximately the 0.08% of the free-space operating wavelength to approximately the 8% of the free-space operating wavelength, including any subinterval of said range. Some possible upper bounds for a subinterval of said range include: 4%, 2%, 1% or 0.5%. Some possible lower bounds for a subinterval of said range include: 0.12%, 0.16%, 0.20% or 0.24%.

In some examples, the slot 113, 143, 163, 193, 194, 195, 203, 204, and/or the slot section on the PCB 153 might have one, two, three, or more bends. In general, as the number of bends in the slot 113, 143, 163, 193, 194, 195, 203, 204 and/or in the slot section on the PCB 153 increases, the shape of the slot 113, 143, 163, 193, 194, 195, 203, 204 and/or the slot section on the PCB 153 becomes more and more convoluted, leading to a higher degree of miniaturization of the resulting slot antenna.

For miniaturization purposes, at least a portion of the curve defining the slot 113, 143, 163, 193, 194, 195, 203, 204 or the slot section on the PCB 153 will advantageously be a space-filling curve, a box-counting curve, a grid-dimension curve, or a fractal based curve. The curve defining said slot 113, 143, 163, 193, 194, 195, 203, 204 and/or said slot section 153 might take the form of a single curve, or might branch-out in two or more curves, which at the same time in some embodiments will be also of the space-filling, box-counting, grid-dimension, or fractal kinds. Additionally, in some embodiments a part of the curve will be coupled either through direct contact or electromagnetic coupling to a conducting polygonal or multilevel surface.

One aspect of the present invention relates to the connection of a slot-antenna component 110, 140, 160 to the ground plane 131, 151 of the PCB on which it is mounted in order to ensure a good electrical continuity between the conductive surface 111, 141, 161 contained in the component 110, 140, 160 and said ground plane 131, 151.

In the example of FIG. 12*b*, the component 110 has five grounding terminals 115 and they are distributed around the extension of the conductive surface 111 in order to ensure a good electrical continuity with the ground plane 131. Two grounding terminals 115*a*, 115*b* are located close to the right-hand-side edge of component 110 opposite to other two grounding terminals 115*c*, 115*d* located close to the left-hand-side edge of the component 110. Moreover, grounding terminals 115*a*, 115*b*, 115*c*, 115*d* are on at least two of the four corners of component 110, specifically one on each corner.

The slot component 140 in FIG. 15*b* comprises three contact terminals 144*a*, 144*b*, 145 used for grounding purposes. Contact terminals 144 are placed substantially close to the right-hand-side edge of the component 140, while contact terminal 145 is located close to the left-hand-side edge of the component 140. Again, the grounding terminals are arranged in such a manner that they are substantially close to at least two of the corners of the component 140. Grounding terminal 145 extends along one of the short edges of the component 140 being at the same time substantially close to two of the four corners of the component.

Furthermore, in some examples it can be advantageous to place grounding terminals at two sides of a feeding terminal and substantially close to said feeding terminal. In FIG. 12*b*, the slot-antenna component 110 comprises a first grounding terminal 115*e* on the left-hand-side of the feeding terminal 114, and a second grounding terminal 115*a* on the right-hand-side of said feeding terminal 114.

In some other embodiments, in order to guarantee good grounding of the component 110, 140, 160 it will be advantageous to have one, two, three, four, five, six, or even more grounding terminals 115, 144, 145, 165 in the slot-antenna component 110, 140, 160.

In some cases, a slot antenna comprising a slot-antenna component 110, 140, 160 will be advantageously excited by applying a voltage difference between the opposite conductive edges of a slot 113, 163, or between the opposite conductive edges of a slot section 153, at a particular point 119, 158, 169 along the geometry of the slot 113, 163, or slot section 153. In some embodiments, said point 119, 158, 169 will be closer to a closed end of the slot 117, 167, or a closed end 157 of a slot section 153, than to an open end of the slot 116, 146, 166. In certain examples, the distance between said point 119, 158, 169 and a closed end 117, 167 of the slot 113, 163, or a closed end 157 of a slot section 153, will be less than, or equal to, 0.2%, 0.4%, 0.8%, 1.2% 1.6%, 2.5%, 3.3%, 4%, 8%, 10% or 15% of a free-space operating wavelength of the slot antenna.

A further aspect of the present invention relates to the control on the electrical parameters of the slot-antenna component by appropriately selecting the orientation and placement of the component on a PCB. The polarization of the radiating mode of the slot-antenna component 110, 140, 160, 190, 200 mounted as depicted in FIG. 13*c* is substantially orthogonal to the radiating mode of the same slot-antenna component 110, 140, 160, 190, 200 mounted as depicted in FIG. 13*a*. Moreover, when the slot-antenna component 110, 140, 160, 190, 200 is mounted as depicted in FIG. 13*b* (i.e., in such a way that the longer dimension of the component is aligned with the one of the longer edges of the PCB and substantially close to a corner of said edge), the polarization of the radiating mode of the antenna is tilted with respect to the radiating mode of the same slot-antenna component 110, 140, 160, 190, 200 mounted as depicted in FIG. 13*a*.

Space Filling Curves

In some examples, at least one antenna of the antenna diversity system may be miniaturized by shaping at least a portion of the conducting trace, conducting wire or contour of a conducting sheet of the antenna (e.g., a part of the arms of a dipole, the perimeter of the patch of a patch antenna, the slot in a slot antenna, the loop perimeter in a loop antenna, or other portions of the antenna) as a space-filling curve (SFC).

In some examples, at least one slot antenna of the slot-antenna component may be miniaturized by shaping at least a portion of the slot of said at least one slot antenna as a space-filling curve (SFC). Also a portion of a slot in a ground plane or a combined slot of a slot portion in a ground plane and a slot portion in an slot-antenna component may be shaped as a space filling curve.

A SFC is a curve that is large in terms of physical length but small in terms of the area in which the curve can be included. More precisely, for the purposes of this patent document, a SFC is defined as follows: a curve having at least five segments, or identifiable sections, that are connected in such a way that each segment forms an angle with any adjacent segments, such that no pair of adjacent segments define a larger straight segment. In addition, a SFC does not intersect with itself at any point except possibly the initial and final point (that is, the whole curve can be arranged as a closed curve or loop, but none of the lesser parts of the curve form a closed curve or loop).

A space-filling curve can be fitted over a flat or curved surface, and due to the angles between segments, the physical length of the curve is larger than that of any straight line that can be fitted in the same area (surface) as the space-filling curve.

Additionally, to shape the structure of a miniature antenna, the segments of the SFCs should be shorter than at least one fifth of the free-space operating wavelength, and possibly shorter than one tenth of the free-space operating wavelength. The space-filling curve should include at least five segments in order to provide some antenna size reduction, however a larger number of segments may be used. In general, the larger the number of segments, and the narrower the angles between them, the smaller the size of the final antenna.

Box-Counting Curves

In other examples, at least one antenna of the antenna diversity system may be miniaturized by shaping at least a portion of the conducting trace, conducting wire or contour of a conducting sheet of the antenna to have a selected box-counting dimension.

In other examples, at least one slot antenna of the slot-antenna component may be miniaturized by shaping at least a portion of the slot of said at least one slot antenna to have a selected box-counting dimension. Also a portion of a slot in a ground plane or a combined slot of a slot portion in a ground plane and a slot portion in an slot-antenna component may be shaped as a box-counting curve.

For a given geometry lying on a surface, the box-counting dimension is computed as follows. First, a grid with substantially squared identical cells boxes of size L1 is placed over the geometry, such that the grid completely covers the geometry, that is, no part of the curve is out of the grid. The number of boxes N1 that include at least a point of the geometry are then counted. Second, a grid with boxes of size L2 (L2 being smaller than L1) is also placed over the geometry, such that the grid completely covers the geometry, and the number of boxes N2 that include at least a point of the geometry are counted. The box-counting dimension D is then computed as:

$$D = -\frac{\log(N2) - \log(N1)}{\log(L2) - \log(L1)}$$

For the purposes of the antennas of the antenna diversity system described herein, the box-counting dimension may be computed by placing the first and second grids inside a minimum rectangular area enclosing the conducting trace, conducting wire or contour of a conducting sheet of the antenna and applying the above algorithm.

For the purposes of the slot antenna of the slot-antenna component described herein, the box-counting dimension may be computed by placing the first and second grids inside a minimum rectangular area enclosing the curve of the antenna and applying the above algorithm.

The first grid should be chosen such that the rectangular area is meshed in an array of at least 5×5 boxes or cells, and the second grid should be chosen such that L2=½ L and such that the second grid includes at least 10×10 boxes. The minimum rectangular area is an area in which there is not an entire row or column on the perimeter of the grid that does not contain any piece of the curve.

The desired box-counting dimension for the curve may be selected to achieve a desired amount of miniaturization. The box-counting dimension should be larger than 1.1 in order to achieve some antenna size reduction. If a larger degree of miniaturization is desired, then a larger box-counting dimension may be selected, such as a box-counting dimension ranging from 1.5 to 3. For the purposes of this patent document, curves in which at least a portion of the geometry of the curve has a box-counting dimension larger than 1.1 are referred to as box-counting curves.

For very small antennas, for example antennas that fit within a rectangle having maximum size equal to one-twentieth the longest free-space operating wavelength of the antenna, the box-counting dimension may be computed using a finer grid. In such a case, the first grid may include a mesh of 10×10 equal cells, and the second grid may include a mesh of 20×20 equal cells. The box-counting dimension (D) may then be calculated using the above equation.

In general, for a given resonant frequency of the antenna, the larger the box-counting dimension, the higher the degree of miniaturization that will be achieved by the antenna. One way to enhance the miniaturization capabilities of the antenna is to arrange the several segments of the curve of the antenna pattern in such a way that the curve intersects at least one point of at least 14 boxes of the first grid with 5×5 boxes or cells enclosing the curve. If a higher degree of miniaturization is desired, then the curve may be arranged to cross at least one of the boxes twice within the 5×5 grid, that is, the curve may include two non-adjacent portions inside at least one of the cells or boxes of the grid.

FIG. 22 illustrates an example of how the box-counting dimension of a curve 1200 is calculated. The example curve 1200 is placed under a 5×5 grid 1201 and under a 10×10 grid 1202. As illustrated, the curve 1200 touches N1=25 boxes in the 5×5 grid 1201 and touches N2=78 boxes in the 10×10 grid 1202. In this case, the size of the boxes in the 5×5 grid 1201 is twice the size of the boxes in the 10×10 grid 1202. By applying the above equation, the box-counting dimension of the example curve 1200 may be calculated as D=1.6415. In addition, further miniaturization is achieved in this example because the curve 1200 crosses more than 14 of the 25 boxes in grid 1201, and also crosses at least one box twice, that is, at least one box contains two non-adjacent segments of the curve. More specifically, the curve 1200 in the illustrated example crosses twice in 13 boxes out of the 25 boxes.

Grid Dimension Curves

In further examples, at least one antenna of the antenna diversity system may be miniaturized by shaping at least a portion of the conducting trace, conducting wire or contour of a conducting sheet of the antenna to include a grid dimension curve.

In further examples, at least one slot antenna of the slot-antenna component may be miniaturized by shaping at least a portion of the slot of said at least one slot antenna to include a grid dimension curve. Also a portion of a slot in a ground plane or a combined slot of a slot portion in a ground plane and a slot portion in an slot-antenna component may be shaped as a box-counting curve.

For a given geometry lying on a planar or curved surface, the grid dimension of curve may be calculated as follows. First, a grid with substantially identical cells of size L1 is placed over the geometry of the curve, such that the grid completely covers the geometry, and the number of cells N1 that include at least a point of the geometry are counted. Second, a grid with cells of size L2 (L2 being smaller than L1) is also placed over the geometry, such that the grid completely covers the geometry, and the number of cells N2 that include at least a point of the geometry are counted again. The grid dimension D is then computed as:

$$D = -\frac{\log(N2) - \log(N1)}{\log(L2) - \log(L1)}$$

For the purposes of the antennas of the antenna diversity system described herein, the grid dimension may be calculated by placing the first and second grids inside the minimum rectangular area enclosing the curve of the antenna and applying the above algorithm.

For the purposes of the slot antenna of the slot-antenna component described herein, the grid dimension may be calculated by placing the first and second grids inside the minimum rectangular area enclosing the curve of the antenna and applying the above algorithm.

The minimum rectangular area is an area in which there is not an entire row or column on the perimeter of the grid that does not contain any piece of the curve.

The first grid may, for example, be chosen such that the rectangular area is meshed in an array of at least 25 substantially equal cells. The second grid may, for example, be chosen such that each cell of the first grid is divided in 4 equal cells, such that the size of the new cells is L2=½ L1, and the second grid includes at least 100 cells.

The desired grid dimension for the curve may be selected to achieve a desired amount of miniaturization. The grid dimension should be larger than 1 in order to achieve some antenna size reduction. If a larger degree of miniaturization is desired, then a larger grid dimension may be selected, such as a grid dimension ranging from 1.5-3 (e.g., in case of volumetric structures). In some examples, a curve having a grid dimension of about 2 may be desired. For the purposes of this patent document, a curve having a grid dimension larger than 1 is referred to as a grid dimension curve.

In general, for a given resonant frequency of the antenna, the larger the grid dimension the higher the degree of miniaturization that will be achieved by the antenna. One example way of enhancing the miniaturization capabilities of the antenna is to arrange the several segments of the curve of the antenna pattern in such a way that the curve intersects at least one point of at least 50% of the cells of the first grid with at least 25 cells enclosing the curve. In another example, a high degree of miniaturization may be achieved by arranging the antenna such that the curve crosses at least one of the cells twice within the 25-cell grid, that is, the curve includes two non-adjacent portions inside at least one of the cells or cells of the grid.

An example of a grid dimension curve 1300 is shown in FIG. 23. The grid dimension curve of FIG. 23 placed in a first grid 1400 is shown in FIG. 24. The same curve in a second grid 1500 is shown in FIG. 25 and in a third grid 1600 in FIG. 26.

Multilevel Structures

In some examples, at least a portion of the conducting trace, conducting wire or conducting sheet of at least one antenna of the antenna diversity system may be coupled, either through direct contact or electromagnetic coupling, to a conducting surface, such as a conducting polygonal or multilevel surface.

In some examples, at least a portion of the slot of at least one slot antenna of the slot-antenna component may be coupled, either through direct contact or electromagnetic coupling, to a conducting surface, such as a conducting polygonal or multilevel surface. Also the slot or a portion of a slot may be shaped as multilevel structure or polygonal.

A multilevel structure is formed by gathering several polygons or polyhedrons of the same type (e.g., triangles, parallelepipeds, pentagons, hexagons, circles or ellipses as special limiting cases of a polygon with a large number of sides, as well as tetrahedral, hexahedra, prisms, dodecahedra, etc.) and coupling these structures to each other electromagnetically, whether by proximity or by direct contact between elements. The majority of the component elements of a multilevel have more than 50% of their perimeter (for polygons) not in contact with any of the other elements of the structure. Thus, the component elements of a multilevel structure may typically be identified and distinguished, presenting at least two levels of detail: that of the overall structure and that of the polygon or polyhedron elements that form it.

Additionally, several multilevel structures may be grouped and coupled electromagnetically to each other to form higher-level structures. In a single multilevel structure, all of the component elements are polygons with the same number of sides or are polyhedrons with the same number of faces. However, this characteristic may not be true if several multilevel structures of different natures are grouped and electromagnetically coupled to form meta-structures of a higher level.

A multilevel antenna includes at least two levels of detail in the body of the antenna: that of the overall structure and that of the majority of the elements (polygons or polyhedrons) which make it up. This may be achieved by ensuring that the area of contact or intersection (if it exists) between the majority of the elements forming the antenna is only a fraction of the perimeter or surrounding area of said polygons or polyhedrons.

One example property of multilevel antennae is that the radioelectric behavior of the antenna can be similar in more than one frequency band. Antenna input parameters (e.g., impedance and radiation pattern) remain similar for several frequency bands (i.e., the antenna has the same level of adaptation or standing wave relationship in each different band), and often the antenna presents almost identical radiation diagrams at different frequencies. The number of frequency bands is proportional to the number of scales or sizes of the polygonal elements or similar sets in which they are grouped contained in the geometry of the main radiating element.

In addition to their multiband behavior, multilevel structure antennae may have a smaller than usual size as compared to other antennae of a simpler structure (such as those consisting of a single polygon or polyhedron). Additionally, the edge-rich and discontinuity-rich structure of a multilevel antenna may enhance the radiation process, relatively increasing the radiation resistance of the antenna and reducing the quality factor Q (i.e., increasing its bandwidth).

A multilevel antenna structure may be used in many antenna configurations, such as dipoles, monopoles, patch or microstrip antennae, coplanar antennae, reflector antennae, wound antennae, antenna arrays, or other antenna configurations. In addition, multilevel antenna structures may be formed using many manufacturing techniques, such as printing on a dielectric substrate by photolithography (printed circuit technique); dieing on metal plate, repulsion on dielectric, or others.

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

The invention claimed is:

1. A wireless device including an antenna diversity system comprising:

a first antenna;

a second antenna; and an elongated printed circuit board, said elongated printed circuit board including a ground plane common to the first antenna and the second antenna;

wherein the second antenna is a slot antenna forming a slot having an open end, said open end in contact with an edge of said ground plane;

wherein said slot is provided in a rectangular area having a longest dimension substantially parallel to a longest side of the elongated printed circuit board; and wherein the first antenna is located proximate to a shortest side of the elongated printed circuit board.

2. The wireless device according to claim 1, wherein the first antenna is an electric current source.

3. The wireless device according to claim 2, wherein the first antenna is selected from a group comprising: a monopole antenna, a patch antenna, an IFA, a PIFA and a multiband antenna.

4. The wireless device according to claim 3, wherein the first antenna is printed as a conductive layer on the elongated printed circuit board or is etched from a conductive layer of the elongated printed circuit board.

5. The wireless device according to claim 1, wherein said slot is inscribed in a rectangular area a width of which divided by a free-space operating wavelength of the slot antenna being smaller than, or equal to, at least one of the fractions of the group comprising: 1/10, 1/30, 1/50, 1/60, 1/70, or 1/80.

6. The wireless device according to claim 1, wherein said slot is inscribed in a rectangular area a length of which divided by a free-space operating wavelength of the slot antenna being smaller than, or equal to, at least one of the fractions of the group comprising: 1/2, 1/3, 1/4, 1/5, 1/6 or 1/8.

7. The wireless device according to claim 1, wherein the slot antenna is printed as a conductive layer on the elongated printed circuit board or etched from a conductive layer of the elongated printed circuit board.

8. The wireless device according to claim 7, wherein said conductive layer is the ground plane of the wireless device.

9. The wireless device according to claim 1, wherein the slot comprises a plurality of segments, and wherein at least two segments of said plurality of segments have different lengths.

10. The wireless device according to claim 9, wherein a separation between opposite edges of at least one segment is constant.

11. The wireless device according to claim 9, wherein a separation between opposite edges of at least one, two, three, four, or more segments is within a minimum and a maximum fraction of a free-space operating wavelength of said slot antenna, wherein said minimum and maximum fraction are selected from the set comprising: 0.08%, 0.16%, 0.32%, 0.5%, 1%, 2%, 4%, 6%, and 8%.

12. The wireless device according to claim 9, wherein the longest segment of the slot is substantially parallel to a longest symmetry axis of the elongated printed circuit board.

13. The wireless device according to claim 1, wherein the slot antenna is embedded in an SMT component.

14. The wireless device according to claim 13, wherein the slot comprises at least one curved segment.

15. The wireless device according to claim 14, wherein a separation between opposite edges of at least two segments is the same.

16. The wireless device according to claim 14, wherein a separation between opposite edges of at least one segment is within a minimum and a maximum fraction of a free-space operating wavelength of said slot antenna, wherein said minimum and maximum fraction are selected from the set comprising: 0.08%, 0.16%, 0.32%, 0.5%, 1%, 2%, 4%, 6%, and 8%.

17. The wireless device according to claim 14, wherein the longest segment, preferably the longest straight segment, of the slot is substantially parallel to the longest edge, extension or symmetry axis of the component.

18. The wireless device according to claim 13, wherein said open end is provided at an edge of the SMT component.

19. The wireless device according to claim 1, wherein the slot comprises a plurality of portions, and wherein at least two portions of said plurality of portions are parallel to each other.

20. The wireless device according to claim 1, wherein the area of a smallest possible rectangular area which completely encloses a perpendicular projection of the slot onto a plane of the elongated printed circuit board divided by the area of the elongated printed circuit board is equal to or less than a fraction of the group comprising: 1/5, 1/7, 1/10, 1/15, 1/20, 1/15, 1/30, 1/40, 1/50, 1/60, 1/70, 1/80, 1/90, 1/100, 1/120, 1/140, 1/160, 1/180, 1/200, 1/250, 1/300, 1/400, 1/500, 1/1000.

21. The wireless device according to claim 2, wherein electric currents excited on at least a portion of the ground plane by the radiating mode of the first antenna are substantially parallel to magnetic currents excited on at least a portion of an extension of the second antenna.

22. The wireless device according to claim 13, wherein the first antenna is a slot antenna.

23. The wireless device according to claim 22, wherein a longest side of a smallest rectangle enclosing the first slot antenna is substantially perpendicular to a longest side of a smallest rectangle enclosing the second slot antenna.

24. The wireless device according to claim 22, wherein the first slot antenna comprises a second slot having an open end on a second edge of said ground plane, said second edge being substantially perpendicular to said edge.

25. The wireless device according to claim 13, wherein magnetic currents excited on at least a portion of an extension of the first antenna are substantially orthogonal to magnetic currents excited on at least a portion of an extension of the second antenna.

26. The wireless device according to claim 1, wherein the first antenna is radiating with a first polarization, and the second antenna is radiating with a second polarization, wherein the first polarization and the second polarization are substantially orthogonal.

27. The wireless device according to claim 1, wherein at least one of the first antenna and the second antenna is a multiband antenna, and wherein the first antenna and the second antenna have at least one frequency band in common.

28. The wireless device according to claim 1, wherein at least one of the first antenna and the second antenna is located on a corner of the elongated printed circuit board or not separated from said corner more than 1%, 5%, 10% or 20% of a longest extension of said elongated printed circuit board carrying the antennas.

29. The wireless device according to claim 1, wherein at least one of the first antenna and the second antenna is located on a side of the elongated printed circuit board carrying the antennas or not further separated from said side than 1%, 5%, 10% or 20% of a longest extension of the elongated printed circuit board.

30. The wireless device according to claim 1, wherein at least one of the first antenna and the second antenna is covering the middle of a side or is not more separated from the middle than 1%, 5%, 10% or 20% of a longest extension of the elongated printed circuit board.

31. The wireless device according to claim 1, wherein a separation between the first antenna and the second antenna is not more than a percentage of a longest extension of the elongated printed circuit board carrying the antennas, the percentage being chosen from the group comprising: 1%, 2%, 3%, 5%, 7%, 10%, 12%, 15%, 20%, 30%, 40% and 50%.

32. The wireless device according to claim 1, wherein a separation between the first antenna and the second antenna is more than a percentage of a longest extension of the elongated printed circuit board carrying the antennas, the percentage being chosen from the group comprising: 50%, 60%, 70%, 75%, 80%, 85%, 90% and 95%.

33. The wireless device according to claim 1, wherein at least one of the first antenna and the second antenna is integrated in a semiconductor package.

34. The wireless device according to claim 33, wherein said semiconductor package includes an electronic circuit.

35. The wireless device according to claim 34, wherein said electronic circuit comprises an electronic die.

36. The wireless device according to claim 1, wherein at least one of the said at least two antennas is operating not only in the same frequency band as the other antennas, but is also operating, at least, at some other frequency band used for mobile telephone systems.

37. The wireless device according to claim 1, wherein at least a portion of at least one of the first antenna and the second antenna is shaped as a space-filing curve, a box-counting, a grid dimension curve, a fractal curve, or a combination thereof.

38. The wireless device according to claim 1, wherein at least a portion of at least one of the first antenna and the second antenna is a polygonal or multilevel structure or coupled to a polygonal or multilevel structure.

39. The wireless device according to claim 1, wherein the first antenna is a magnetic current source.

40. The wireless device according to claim 1, wherein the slot antenna is a magnetic current source.

41. A wireless device including an antenna diversity system comprising:

a first antenna for transmitting and receiving electromagnetic waves in at least one frequency band;

a second antenna for receiving electromagnetic waves in the at least one frequency band;

an elongated printed circuit board, said elongated printed circuit board including a ground plane common to the first antenna and the second antenna;

wherein the first antenna is provided as an electric current source and the second antenna is provided as a magnetic current source;

wherein the first antenna and the second antenna receive simultaneously;

wherein the second antenna is a slot antenna comprising a slot;

wherein the first antenna is located proximate to a first side of the elongated printed circuit board and the second antenna is located proximate to a second side of the elongated printed circuit board;

wherein said first side is substantially perpendicular to said second side; and wherein said slot is inscribed in a rectangular area having a longest dimension substantially parallel to the second side of the elongated printed circuit board.

42. The wireless device according to claim 41, wherein the device is at least one or a combination of wireless devices of a group of wireless devices comprising: a cellular phone, a mobile phone, a handheld phone, a smart phone, a satellite phone, a multimedia terminal, personal digital assistant (PDA), a portable music player, a radio, a digital camera, a USB dongle, a wireless headset, an ear phone, a hands-free kit, an electronic game, a remote control, an electric switch, a light switch, an alarm, a car kit, a computer card, a PCMCIA card, a sensor, a headset, a dongle, a computer interface a computer mouse, a keyboard, a personal computer, a MP3 player, a portable DVD/CD player, a smoke detector, a switch, a motion sensor, a pressure sensor, a temperature sensor, a medical sensor, a meter, a short/medium range wireless connectivity application, a Mini-PCI, a Notebook, PC with WiFi module integrated, a compact flash wireless card, a UART dongle, a pocket PC with integrated Wi-Fi, an access point for a hot spot, a wireless wrist watch, a wireless wrist sensor, a bracelet FM radio, an MP3 player, a radio frequency identification tag, key remote entry system, an air pressure sensor e.g. in a tire, a radio controlled toy, a laptop and a cardbus 32 card.

43. The wireless device according to claim 42, wherein the device is configured for operation in one, two, three or more of the wireless communication systems preferably selected from the group comprising: Bluetooth, 2.4 GHz Bluetooth, 2.4 GHz WiMAX, ZigBee, ZigBee at 860 MHz, ZigBee at 915 MHz, GPS, GPS at 1.575 GHz, GPS at 1.227 GHz, Galileo, GSM 450, GSM 850, GSM 900, GSM 1800, American GSM, DCS-1800, UMTS, CDMA, DMB, DVB-H, WLAN, WLAN at 2.4 GHz-6 GHz, PCS 1900, KPCS, WCDMA, SDARs, XDARS, DAB, WiFi, UWB, 2.4-2.483 GHz band, 2.471-2.497 GHz band, IEEE802.11ba, IEEE802.11b, IEEE802.11g and FM.

44. The wireless device according to claim 41, wherein the first antenna is selected from a group comprising: a monopole antenna, a patch antenna, an IFA, a PIFA and a multiband antenna.

45. The wireless device according to claim 44, wherein the first antenna is printed as a conductive layer on the elongated printed circuit board or is etched from a conductive layer of the elongated printed circuit board.

46. The wireless device according to claim 41, wherein said slot is inscribed in a rectangular area a width of which divided by a free-space operating wavelength of the slot antenna being smaller than, or equal to, at least one of the fractions of the group comprising: $1/10$, $1/30$, $1/50$, $1/60$, $1/70$, or $1/80$.

47. The wireless device according to claim 41, wherein said slot is inscribed in a rectangular area a length of which divided by a free-space operating wavelength of the slot antenna being smaller than, or equal to, at least one of the fractions of the group comprising: $1/2$, $1/3$, $1/4$, $1/5$, $1/6$or $1/8$.

48. The wireless device according to claim 41, wherein said slot antenna is printed as a conductive layer on the elongated printed circuit board or etched from a conductive layer of the elongated printed circuit board.

49. The wireless device according to claim 48, wherein said conductive layer is the ground plane of the wireless device.

50. The wireless device according to claim 41, wherein the slot comprises a plurality of segments, and wherein at least two segments of said plurality of segments have different lengths.

51. The wireless device according to claim 50, wherein a separation between opposite edges of at least one segment is constant.

52. The wireless device according to claim 50, wherein a separation between opposite edges of at least one, two, three, four, or more segments is within a minimum and a maximum fraction of a free-space operating wavelength of said slot antenna, wherein said minimum and maximum fraction are selected from the set comprising: 0.08%, 0.16%, 0.32%, 0.5%, 1%, 2%, 4%, 6%, and 8%.

53. The wireless device according to claim 50, wherein the longest segment of the slot is substantially parallel to a longest symmetry axis of the elongated printed circuit board.

54. The wireless device according to claim 41, wherein the slot has an open end which is provided at an edge of the ground plane.

55. The wireless device according to claim 41, wherein said slot antenna is embedded in an SMT component.

56. The wireless device according to claim 55, wherein the slot comprises at least one curved segment.

57. The wireless device according to claim 56, wherein a separation between opposite edges of at least two segments is the same.

58. The wireless device according to claim 56, wherein a separation between opposite edges of at least one segment is within a minimum and a maximum fraction of a free-space operating wavelength of said slot antenna, wherein said minimum and maximum fraction are selected from the set comprising: 0.08%, 0.16%, 0.32%, 0.5%, 1%, 2%, 4%, 6%, and 8%.

59. The wireless device according to claim 56, wherein the longest segment, preferably the longest straight segment, of the slot is substantially parallel to the longest edge, extension or symmetry axis of the component.

60. The wireless device according to claim 55, wherein an open end is provided at an edge of the SMT component.

61. The wireless device according to claim 41, wherein the slot comprises a plurality of portions, and wherein at least two portions of said plurality of portions are parallel to each other.

62. The wireless device according to claim 41, wherein the area of a smallest possible rectangular area which completely encloses a perpendicular projection of the slot onto a plane of the elongated printed circuit board divided by the area of the elongated printed circuit board is equal to or less than a fraction of the group comprising:

$1/5$, $1/7$, $1/10$, $1/15$, $1/20$, $1/15$, $1/30$, $1/40$, $1/50$, $1/60$, $1/70$, $1/80$, $1/90$, $1/100$, $1/120$, $1/140$, $1/160$, $1/180$, $1/200$, $1/250$, $1/300$, $1/400$, $1/500$, $1/1000$.

63. The wireless device according to claim 41, wherein electric currents excited on at least a portion of the ground plane by the radiating mode of the first antenna are substantially parallel to magnetic currents excited on at least a portion of an extension of the second antenna.

64. The wireless device according to claim 41, wherein the first antenna is radiating with a first polarization, and the second antenna is radiating with a second polarization, wherein the first polarization and the second polarization are substantially orthogonal.

65. The wireless device according to claim 41, wherein at least one of the first antenna and the second antenna is a multiband antenna.

66. The wireless device according to claim 41, wherein at least one of the first antenna and the second antenna is located on a corner of the elongated printed circuit board or not separated from said corner more than 1%, 5%, 10% or 20% of a longest extension of said elongated printed circuit board carrying the antennas.

67. The wireless device according to claim 41, wherein at least one of the first antenna and the second antenna is located on a side of the elongated printed circuit board carrying the antennas or not further separated from said side than 1%, 5%, 10% or 20% of a longest extension of the elongated printed circuit board.

68. The wireless device according to claim 41, wherein at least one of the first antenna and the second antenna is covering the middle of a side or is not more separated from the middle than 1%, 5%, 10% or 20% of a longest extension of the elongated printed circuit board.

69. The wireless device according to claim 41, wherein a separation between the first antenna and the second antenna is not more than a percentage of a longest extension of the elongated printed circuit board carrying the antennas, the percentage being chosen from the group comprising: 1%, 2%, 3%, 5%, 7%, 10%, 12%, 15%, 20%, 30%, 40% and 50%.

70. The wireless device according to claim 41, wherein a separation between the first antenna and the second antenna is more than a percentage of a longest extension of the elongated printed circuit board carrying the antennas, the percentage being chosen from the group comprising: 50%, 60%, 70%, 75%, 80%, 85%, 90% and 95%.

71. The wireless device according to claim 41, wherein at least one of the first antenna and the second antenna is integrated in a semiconductor package.

72. The wireless device according to claim 71, wherein said semiconductor package includes an electronic circuit.

73. The wireless device according to claim 72, wherein said electronic circuit comprises an electronic die.

74. The wireless device according to claim 41, wherein at least one of the said at least two antennas is operating not only in the same frequency band as the other antennas, but is also operating, at least, at some other frequency band used for mobile communication systems.

75. The wireless device according to claim 41, wherein at least a portion of at least one of the first antenna and the second antenna is shaped as a space-filing curve, a box-counting, a grid dimension curve, a fractal curve, or a combination thereof.

76. The wireless device according to claim 41, wherein at least a portion of at least one of the first antenna and the second antenna is a polygonal or multilevel structure or coupled to a polygonal or multilevel structure.

77. A wireless device including an antenna diversity system comprising:

a first antenna for transmitting and receiving electromagnetic waves in multiple frequency bands;

a second antenna for receiving electromagnetic waves in at least a frequency band;

wherein the second antenna is a slot antenna forming a slot having an open end, said open end in contact with an edge of said ground plane;

an elongated printed circuit board, said elongated printed circuit board including a ground plane common to the first antenna and the second antenna;

wherein the first antenna is inscribed in a rectangular area having a longest dimension substantially parallel to a first side of the elongated printed circuit board;

wherein the second antenna is inscribed in a rectangular area having a longest dimension substantially parallel to a second side of the elongated printed circuit board; wherein said first side is substantially perpendicular to said second side; and wherein the first antenna and the second antenna have at least a receiving frequency range of a frequency band in common.

78. The wireless device according to claim 77, wherein the device is at least one of a group of wireless devices comprising: a cellular phone, a mobile phone, a handheld phone, a smart phone, a satellite phone, personal digital assistant (PDA), a portable music player, a radio, a digital camera, a USB dongle, a wireless headset, an ear phone, a hands-free kit, an electronic game, a computer card, a PCMCIA card, a headset, a dongle, a personal computer, a Mini-PCI, a Notebook, a compact flash wireless card, a UART dongle, a pocket PC with integrated Wi-Fi, an access point for a hot spot, an MP3 player, a laptop, and a cardbus 32 card.

79. The wireless device according to claim 77, wherein the device is configured for operation in one, two, three or more of the wireless communication systems preferably selected from the group comprising: Bluetooth, 2.4 GHz Bluetooth, 2.4 GHz WiMAX, ZigBee, ZigBee at 860 MHz, ZigBee at 915 MHz, GPS, GPS at 1.575 GHz, GPS at 1.227 GHz, Galileo, GSM 450, GSM 850, GSM 900, GSM 1800, American GSM, DCS-1800, UMTS, CDMA, DMB, DVB-H, WLAN, WLAN at 2.4 GHz-6 GHz, PCS 1900, KPCS, WCDMA, SDARs, XDARS, DAB, WiFi, UWB, 2.4-2.483 GHz band, 2.471-2.497 GHz band, IEEE802.11ba, IEEE802.11b, IEEE802.11g and FM.

80. The wireless device according to claim 77, wherein said second antenna is a multiband antenna operating in a plurality of frequency bands.

81. The wireless device according to claim 77, wherein said wireless device is a portable communications device.

82. The wireless device according to claim 81, wherein said portable communications device is a handset.

83. The wireless device according to claim 82, wherein at least one of the first antenna and the second antenna operates in at least two frequency bands within the 700 MHz 3600 MHz frequency range.

84. The wireless device according to claim 82, wherein at least one of the first antenna and the second antenna operates in at least four frequency bands within the 700 MHz 3600 MHz frequency range.

85. The wireless device according to claim 82, wherein at least one of the first antenna and the second antenna operates in at least one of the frequency bands used by at least a GSM or UMTS communication service.

86. The wireless device according to claim 82, wherein the first antenna and the second antenna operate at least one frequency band used by at least a GSM or UMTS communication service.

87. The wireless device according to claim 81, wherein the first antenna and the second antenna operate at least one frequency band used by at least a Bluetooth or WiFi connectivity service.

88. The wireless device according to claim 77, wherein the first antenna is an electric current source and the second antenna is a magnetic current source.

89. The wireless device according to claim 88, wherein the second antenna is a slot antenna.

90. The wireless device according to claim 88, wherein the first antenna is selected from a group comprising: a monopole antenna, a patch antenna, an IFA, a PIFA and a multiband antenna.

91. The wireless device according to claim 90, wherein the first antenna is printed as a conductive layer on the elongated printed circuit board or is etched from a conductive layer of the elongated printed circuit board.

92. The wireless device according to claim 89, wherein said slot is inscribed in a rectangular area a width of which divided by a free-space operating wavelength of the slot antenna being smaller than, or equal to, at least one of the fractions of the group comprising: $1/10$, $1/30$, $1/50$, $1/60$, $1/70$, or $1/80$.

93. The wireless device according to claim 89, wherein said slot is inscribed in a rectangular area a length of which divided by a free-space operating wavelength of the slot antenna being smaller than, or equal to, at least one of the fractions of the group comprising: $1/2$, $1/3$, $1/4$, $1/5$, $1/6$or $1/8$.

94. The wireless device according to claim 89, wherein the said slot antenna is printed as a conductive layer on the elongated printed circuit board or etched from a conductive layer of the elongated printed circuit board.

95. The wireless device according to claim 94, wherein said conductive layer is the ground plane of the wireless device.

96. The wireless device according to claim 89, wherein the slot has an open end which is provided at one edge of the ground plane.

97. The wireless device according to claim 89, wherein the slot antenna is embedded in an SMT component.

98. The wireless device according to claim 89, wherein the area of a smallest possible rectangular area which completely encloses a perpendicular projection of the slot onto a plane of the elongated printed circuit board divided by the area of the elongated printed circuit board is equal to or less than a fraction of the group comprising:

$1/5$, $1/7$, $1/10$, $1/15$, $1/20$, $1/15$, $1/30$, $1/40$, $1/50$, $1/60$, $1/70$, $1/80$, $1/90$, $1/100$, $1/120$, $1/140$, $1/160$, $1/180$, $1/200$, $1/250$, $1/300$, $1/400$, $1/500$, $1/1000$.

99. The wireless device according to claim 88, wherein electric currents excited on at least a portion of the ground plane by the radiating mode of the first antenna are substantially parallel to magnetic currents excited on at least a portion of an extension of the second antenna.

100. The wireless device according to claim 77, wherein the first antenna and the second antenna are magnetic current sources.

101. The wireless device according to claim 100, wherein the first and the second antenna are slot antennas.

102. The wireless device according to claim 101, wherein a longest side of a smallest rectangle enclosing the first slot antenna is substantially perpendicular to a longest side of a smallest rectangle enclosing the second slot antenna.

103. The wireless device according to claim 101, wherein the first slot antenna comprises a first slot having an open end on a first edge of said ground plane and the second slot antenna has an open end on a second edge of said ground plane, said first and second edges being substantially perpendicular.

104. The wireless device according to claim 100, wherein magnetic currents excited on at least a portion of an extension of the first antenna are substantially orthogonal to magnetic currents excited on at least a portion of an extension of the second antenna.

105. The wireless device according to claim 77, wherein the first antenna and the second antenna behave as electric current sources.

106. An antenna diversity system according to claim 105, wherein the electric currents excited on a printed circuit board, by the radiating mode of the first antenna, are substantially orthogonal to the electric currents excited on the said printed circuit board by the radiating mode of the second antenna, in at least a portion of the printed circuit board.

107. An antenna diversity system according to claim 105, wherein the first and/or the second antenna is selected from the group comprising: a monopole antenna, patch antenna, IFA, a PIFA and a multiband antenna.

108. The wireless device according to claim 77, wherein the first antenna is radiating with a first polarization, and the second antenna is radiating with a second polarization, wherein the first polarization and the second polarization are substantially orthogonal.

109. The wireless device according to claim 77, wherein a separation between the first antenna and the second antenna is not more than a percentage of a longest extension of the elongated printed circuit board carrying the antennas, the percentage being chosen from the group comprising: 1%, 2%, 3%, 5%, 7%, 10%, 12%, 15%, 20%, 30%, 40% and 50%.

110. A wireless portable device comprising a circuit board and a slot-antenna component, wherein said circuit board comprises a ground plane, and wherein said slot-antenna component comprises:

at least one conductive surface, different from the ground plane of the circuit board, on which a pattern of a slot is created;

a dielectric substrate that backs said at least one conductive surface, or in which said at least one conducting surface is embedded;

at least one contact terminal named grounding terminal accessible from the exterior of said slot-antenna component to electrically connect said at least one conductive surface included in the slot-antenna component with the ground plane of the circuit board;

and at least one contact terminal named feeding terminal to couple a radio-frequency feeding signal from the outside of the slot-antenna component with the slot defined in said at least one conductive surface;

wherein said slot-antenna component has a rectangular shape with a length smaller than $1/10$ of a free-space operating wavelength of the slot antenna, a width smaller than $1/15$ of a free-space operating wavelength of the slot antenna and a height smaller than $1/60$ of a free-space operating wavelength of the slot antenna;

wherein the unfolded length of the slot antenna comprising the slot created in said at least one conductive surface of the slot-antenna component is approximately a quarter of an operating wavelength of the slot antenna;

wherein at least a portion of the slot created in said at least one conductive surface of the slot-antenna component is shaped as a space-filling curve, or a box-counting curve, or a grid dimension curve;

wherein the slot-antenna component comprises a second grounding terminal;

wherein the first and second grounding terminals are close to two opposite edges of said slot-antenna component;

wherein the slot-antenna component comprises feeding means including a conductive strip connected to the at least one feeding terminal, and having a width smaller than $1/300$ of a free-space operating wavelength of the slot antenna;

wherein said conductive strip is connected to an edge of the slot created in the at least one conductive surface of the slot-antenna component at a distance from a closed end of said slot smaller than 8% of a free-space operating wavelength of the slot antenna;

and wherein the wireless device is operating at one, two, three or more communication and connectivity services selected from the group comprising GSM850, GSM900, GSM1800, American GSM, PCS1900, GSM450, UMTS, WCDMA, CDMA, Bluetooth™, IEEE802.11a, IEEE802.11b, IEEE802.11g, WLAN, WiFi, UWB, ZigBee, GPS, Galileo, SDARs, XDARS, WiMAX, DAB, FM, DMB, and DVB-H.

* * * * *